US007885819B2

(12) United States Patent
Koishida et al.

(10) Patent No.: US 7,885,819 B2
(45) Date of Patent: Feb. 8, 2011

(54) BITSTREAM SYNTAX FOR MULTI-PROCESS AUDIO DECODING

(75) Inventors: Kazuhito Koishida, Redmond, WA (US); Sanjeev Mehrotra, Kirkland, WA (US); Chao He, Redmond, WA (US); Wei-Ge Chen, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 893 days.

(21) Appl. No.: 11/772,091

(22) Filed: Jun. 29, 2007

(65) Prior Publication Data

US 2009/0006103 A1 Jan. 1, 2009

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS 3,684,838 A * 8/1972 Kahn ..... 704/227
4,776,014 A * 10/1988 Zinser, Jr. ..... 704/262
5,040,217 A 8/1991 Brandenburg et al.
5,079,547 A 1/1992 Fuchigama et al.
5,260,980 A 11/1993 Akagiri et al.
5,295,203 A 3/1994 Krause et al.
5,388,181 A 2/1995 Anderson et al.
5,438,643 A 8/1995 Akagiri et al.
5,455,874 A 10/1995 Ormsby et al.
5,539,829 A 7/1996 Lokhoff et al.
5,581,653 A 12/1996 Todd
5,627,938 A 5/1997 Johnston
5,640,486 A 6/1997 Lim
5,654,702 A 8/1997 Ran
5,661,755 A 8/1997 Van De Kerkhof et al.
5,682,461 A 10/1997 Silzle et al.
5,686,964 A 11/1997 Tabatabai et al.
5,737,720 A 4/1998 Miyamori et al.
5,777,678 A 7/1998 Ogata et al.
5,812,971 A 9/1998 Herre
5,819,214 A 10/1998 Suzuki et al.
5,842,160 A * 11/1998 Zinser ..... 704/229
5,845,243 A 12/1998 Smart (Continued)

FOREIGN PATENT DOCUMENTS

EP 0663740 7/1995

(Continued)

OTHER PUBLICATIONS

Herre et al., "MP3 Surround: Efficient and Compatible Coding of Multi-Channel Audio," *116th Audio Engineering Society Convention*, 2004, 14 pages.

(Continued)

*Primary Examiner*—Jakieda R Jackson
(74) *Attorney, Agent, or Firm*—Klarquist Sparkman, LLP

(57) ABSTRACT

An audio decoder provides a combination of decoding components including components implementing base band decoding, spectral peak decoding, frequency extension decoding and channel extension decoding techniques. The audio decoder decodes a compressed bitstream structured by a bitstream syntax scheme to permit the various decoding components to extract the appropriate parameters for their respective decoding technique.

23 Claims, 28 Drawing Sheets

U.S. PATENT DOCUMENTS 5,852,806 A 12/1998 Johnston et al.
5,870,480 A 2/1999 Griesinger
5,886,276 A 3/1999 Levine et al.
5,956,674 A 9/1999 Smyth et al.
5,974,380 A 10/1999 Smyth et al.
5,995,151 A 11/1999 Naveen et al.
6,014,621 A * 1/2000 Chen ..... 704/220
6,021,386 A 2/2000 Davis et al.
6,029,126 A 2/2000 Malvar
6,058,362 A 5/2000 Malvar
6,115,688 A 9/2000 Brandenburg et al.
6,115,689 A 9/2000 Malvar
6,122,607 A 9/2000 Ekudden et al.
6,182,034 B1 1/2001 Malvar
6,226,616 B1 5/2001 You et al.
6,230,124 B1 5/2001 Maeda
6,240,380 B1 5/2001 Malvar
6,341,165 B1 1/2002 Gbur et al.
6,351,730 B2 * 2/2002 Chen ..... 704/229
6,393,392 B1 5/2002 Minde
6,449,596 B1 9/2002 Ejima
6,498,865 B1 12/2002 Brailean et al.
6,601,032 B1 7/2003 Surucu
6,680,972 B1 1/2004 Liljeryd
6,708,145 B1 * 3/2004 Liljeryd et al. ..... 704/200.1
6,735,567 B2 5/2004 Gao et al.
6,760,698 B2 7/2004 Gao
6,766,293 B1 7/2004 Herre
6,771,777 B1 8/2004 Gbur et al.
6,778,709 B1 8/2004 Taubman
6,804,643 B1 10/2004 Kiss
6,882,731 B2 4/2005 Irwan et al.
6,934,677 B2 8/2005 Chen et al.
6,999,512 B2 2/2006 Yoo et al.
7,010,041 B2 3/2006 Graziani et al.
7,043,423 B2 5/2006 Vinton et al.
7,062,445 B2 6/2006 Kadatch
7,107,211 B2 9/2006 Griesinger
7,193,538 B2 3/2007 Craven et al.
7,310,598 B1 12/2007 Mikhael et al.
7,447,631 B2 * 11/2008 Truman et al. ..... 704/230
7,548,852 B2 * 6/2009 Den Brinker et al. ..... 704/219
7,647,222 B2 * 1/2010 Dimkovic et al. ..... 704/222
7,689,427 B2 * 3/2010 Vasilache ..... 704/500
2001/0017941 A1 8/2001 Chaddha
2003/0093271 A1 5/2003 Tsushima et al.
2003/0115041 A1 6/2003 Chen et al.
2003/0115042 A1 6/2003 Chen et al.
2003/0115050 A1 6/2003 Chen et al.
2003/0115051 A1 6/2003 Chen et al.
2003/0115052 A1 6/2003 Chen et al.
2003/0193900 A1 10/2003 Zhang et al.
2003/0233234 A1 12/2003 Truman et al.
2003/0233236 A1 12/2003 Davidson et al.
2003/0236580 A1 12/2003 Wilson et al.
2004/0044527 A1 3/2004 Thumpudi et al.
2004/0114687 A1 * 6/2004 Ferris et al. ..... 375/240.11
2004/0133423 A1 7/2004 Crockett
2004/0165737 A1 8/2004 Monro
2004/0243397 A1 12/2004 Averty et al.
2005/0065780 A1 3/2005 Wiser et al.
2005/0074127 A1 4/2005 Herre et al.
2005/0108007 A1 5/2005 Bessette et al.
2005/0149322 A1 7/2005 Bruhn et al.
2005/0159941 A1 7/2005 Kolesnik et al.
2005/0165611 A1 7/2005 Mehrotra et al.
2005/0195981 A1 9/2005 Faller et al.
2006/0004566 A1 1/2006 Oh et al.
2006/0025991 A1 2/2006 Kim
2006/0074642 A1 4/2006 You
2006/0095269 A1 5/2006 Smith et al.
2006/0106597 A1 5/2006 Stein
2006/0140412 A1 6/2006 Villemoes et al.
2007/0016406 A1 1/2007 Thumpudi et al.
2007/0016415 A1 1/2007 Thumpudi et al.
2007/0016427 A1 1/2007 Thumpudi et al.
2007/0036360 A1 2/2007 Breebaart
2007/0063877 A1 3/2007 Shmunk et al.
2007/0127733 A1 6/2007 Henn et al.
2008/0027711 A1 * 1/2008 Rajendran et al. ..... 704/201
2008/0052068 A1 2/2008 Aguilar et al.

FOREIGN PATENT DOCUMENTS

EP 0910927 4/1999
EP 0931386 7/1999
EP 1396841 3/2004
EP 1783745 A1 5/2007
WO WO 02/43054 5/2002

OTHER PUBLICATIONS

Rijkse, "H.263: Video Coding for Low-Bit-Rate Communication," *IEEE Comm.*, vol. 34, No. 12, Dec. 1996, pp. 42-45.
Scheirer, "The MPEG-4 Structured Audio standard," *Proc 1998 IEEE ICASSP*, 1998, pp. 3801-3804.
Todd et. al., "AC-3: Flexible Perceptual Coding for Audio Transmission and Storage," *96th Conv. of AES*, Feb. 1994, 16 pages.
Tucker, "Low bit-rate frequency extension coding," *IEEE Colloquium on Audio and Music Technology*, Nov. 1998, 5 pages.
Search Report from PCT/US04/24935, dated Feb. 24, 2005.
Search Report from PCT/US06/27238, dated Aug. 15, 2007.
Search Report from PCT/US06/27420, dated Apr. 26, 2007.
Advanced Television Systems Committee, ATSC Standard: Digital Audio Compression (AC-3), Revision A, 140 pp. (1995).
Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).
Brandenburg, "ASPEC Coding", AES 10th International Conference, pp. 81-90 (1991).
Caetano et al., "Rate Control Strategy for Embedded Wavelet Video Coders," Electronics Letters, pp. 1815-1817 (Oct. 14, 1999).
De Luca, "AN1090 Application Note: STA013 MPEG 2.5 Layer III Source Decoder," STMicroelectronics, 17 pp. (1999).
de Queiroz et al., "Time-Varying Lapped Transforms and Wavelet Packets," IEEE Transactions on Signal Processing, vol. 41, pp. 3293-3305 (1993).
Dolby Laboratories, "AAC Technology," 4 pp. [Downloaded from the web site aac-audio.com on World Wide Web on Nov. 21, 2001.].
Faller et al., "Binaural Cue Coding Applied to Stereo and Multi-Channel Audio Compression," Audio Engineering Society, Presented at the 112th Convention, May 2002, 9 pages.
Fraunhofer-Gesellschaft, "MPEG Audio Layer-3," 4 pp. [Downloaded from the World Wide Web on Oct. 24, 2001.].
Fraunhofer-Gesellschaft, "MPEG-2 AAC," 3 pp. [Downloaded from the World Wide Web on Oct. 24, 2001.].
Gibson et al., Digital Compression for Multimedia, Title Page, Contents, "Chapter 7: Frequency Domain Coding," Morgan Kaufman Publishers, Inc., pp. iii, v-xi, and 227-262 (1998).
Mark Hasegawa-Johnson and Abeer Alwan, "Speech coding: fundamentals and applications," Handbook of Telecommunications, John Wiley and Sons, Inc., pp. 1-33 (2003). [available at http://citeseer.ist.psu.edu/617093.html].
Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
International Search Report and Written Opinion for PCT/US06/27420, dated Apr. 26, 2007, 8 pages.
"ISO/IEC 11172-3, Information Technology—Coding of Moving Pictures and Associated Audio for Digital Storage Media at Up to About 1.5 Mbit/s—Part 3: Audio," 154 pp. (1993).

"ISO/IEC 13818-7, Information Technology—Generic Coding of Moving Pictures and Associated Audio Information—Part 7: Advanced Audio Coding (AAC)," 174 pp. (1997).
"ISO/IEC 13818-7, Information Technology—Generic Coding of Moving Pictures and Associated Audio Information—Part 7: Advanced Audio Coding (AAC), Technical Corrigendum 1" 22 pp. (1998).
ITU, Recommendation ITU-R BS 1115, Low Bit-Rate Audio Coding, 9 pp. (1994).
ITU, Recommendation ITU-R BS 1387, Method for Objective Measurements of Perceived Audio Quality, 89 pp. (1998).
Jesteadt et al., "Forward Masking as a Function of Frequency, Masker Level, and Signal Delay," Journal of Acoustical Society of America, 71:950-962 (1982).
A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).
Korhonen et al., "Schemes for Error Resilient Streaming of Perceptually Coded Audio," Proceedings of the 2003 IEEE International Conference on Acoustics, Speech & Signal Processing, 2003, pp. 165-168.
Lau et al., "A Common Transform Engine for MPEG and AC3 Audio Decoder," IEEE Trans. Consumer Electron., vol. 43, Issue 3, Jun. 1997, pp. 559-566.
Lufti, "Additivity of Simultaneous Masking," Journal of Acoustic Society of America, 73:262-267 (1983).
Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).
H.S. Malvar, "Lapped Transforms for Efficient Transform/Subband Coding," IEEE Transactions on Acoustics, Speech and Signal Processing, vol. 38, No. 6, pp. 969-978 (1990).
H.S. Malvar, Signal Processing with Lapped Transforms, Artech House, Norwood, MA, pp. iv, vii-xi, 175-218, 353-57 (1992).
Najafzadeh-Azghandi, Hossein and Kabal, Peter, "Perceptual coding of narrowband audio signals at 8 Kbit/s" (1997), available at http://citeseer.ist.psu.edu/najafzadeh-azghandi97perceptual.html.
Noll, "Digital Audio Coding for Visual Communications," Proceedings of the IEEE, vol. 83, No. 6, Jun. 1995, pp. 925-943.
Opticom GmbH, "Objective Perceptual Measurement," 14 pp. [Downloaded from the World Wide Web on Oct. 24, 2001.].
Painter et al., "A Review of Algorithms for Perceptual Coding of Digital Audio Signals," Digital Signal Processing Proceedings, 1997, 30 pp.
Painter, T. and Spanias, A., "Perceptual Coding Of Digital Audio," Proceedings Of The IEEE, vol. 88, Issue 4, pp. 451-515, Apr. 2000, available at http://www.eas.asu.edu/~spanias/papers/paper-audio-tedspanias-00.pdf.
Phamdo, "Speech Compression," 13 pp. [Downloaded from the World Wide Web on Nov. 25, 2001.].
Ribas Corbera et al., "Rate Control in DCT Video Coding for Low-Delay Communications," IEEE Transactions on Circuits and Systems for Video Technology, vol. 9, No. 1, pp. 172-185 (Feb. 1999).
M. Schroeder, B. Atal, "Code-excited linear prediction (CELP): High-quality speech at very low bit rates," Proc. IEEE Int. Conf ASSP, pp. 937-940, 1985.
Schulz, D., "Improving audio codecs by noise substitution," Journal Of The AES, vol. 44, No. 7/8, pp. 593-598, Jul./Aug. 1996.
Seymour Shlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).
Solari, Digital Video and Audio Compression, Title Page, Contents, "Chapter 8: Sound and Audio," McGraw-Hill, Inc., pp. iii, v-vi, and 187-211 (1997).
Th. Sporer, Kh. Brandenburg, B. Edler, "The Use of Multirate Filter Banks for Coding of High Quality Digital Audio," 6th European Signal Processing Conference (EUSIPCO), Amsterdam, vol. 1, pp. 211-214, Jun. 1992.
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Terhardt, "Calculating Virtual Pitch," Hearing Research, 1:155-182 (1979).
Wragg et al., "An Optimised Software Solution for an ARM PoweredTM MP3 Decoder," 9 pp. [Downloaded from the World Wide Web on Oct. 27, 2001.].
Yang et al., "Progressive Syntax-Rich Coding of Multichannel Audio Sources," EURASIP Journal on Applied Signal Processing, 2003, pp. 980-992.
Zwicker et al., Das Ohr als Nachrichtenempfänger, Title Page, Table of Contents, "I: Schallschwingungen," Index, Hirzel-Verlag, Stuttgart, pp. III, IX-XI, 1-26, and 231-232 (1967).
Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).

* cited by examiner

Figure 19

$$\begin{bmatrix} C_0 \\ C_1 \end{bmatrix} \alpha \begin{bmatrix} C_0^* & C_1^* \end{bmatrix} = \begin{bmatrix} X_0 X_0^* & X_0 X_1^* \\ X_1 X_0^* & X_1 X_1^* \end{bmatrix}$$

$$C_0 C_0^* \alpha = X_0 X_0^*$$

$$C_1 C_1^* \alpha = X_1^* X_1^*$$

$$\mathrm{Re}(C_0 C_1^* \alpha) = \mathrm{Re}(X_0 X_1^*)$$

Figure 20

$$[C_0 C_0^* + C_1 C_1^* + 2\,\mathrm{Re}(C_0 C_1^*)] = \frac{1}{\beta^2}$$

$$|C_0|^2 + |C_1|^2 + 2|C_0||C_1|\cos(\phi_0 - \phi_1) = \frac{1}{\beta^2}$$

Figure 21

$$|C_0| = \sqrt{\frac{X_0 X_0^*}{\beta^2 (X_0 X_0^* + X_1^* X_1^* + 2\,\mathrm{Re}(X_0 X_1^*))}}$$

$$|C_1| = \sqrt{\frac{X_1 X_1^*}{\beta^2 (X_0 X_0^* + X_1^* X_1^* + 2\,\mathrm{Re}(X_0 X_1^*))}}$$

$$|C_0||C_1|\cos(\phi_0 - \phi_1) = \frac{\mathrm{Re}(X_0 X_1^*)}{\beta^2 (X_0 X_0^* + X_1^* X_1^* + 2\,\mathrm{Re}(X_0 X_1^*))}$$

Figure 22

$$\theta = \phi_0 - \phi_1 = \pm \mathrm{acos}\left( \frac{1 - \beta^2 |C_0|^2 - \beta^2 |C_1|^2}{2\beta^2 |C_0||C_1|} \right)$$

Figure 23

$$\mathrm{angle}[(|C_0| e^{j\phi_0} + |C_1| e^{j\phi_1})(B_0 X_0[l] + B_1 X_1[l])] = \mathrm{angle}(B_0 X_0[l] + B_1 X_1[l])$$

Figure 24

$$\phi_1 = \operatorname{atan}\left(\frac{-|C_0|\sin\theta}{|C_0|\cos\theta + |C_1|}\right)$$

$$\phi_0 = \operatorname{atan}\left(\frac{|C_1|\sin\theta}{|C_0| + |C_1|\cos\theta}\right) = \theta + \phi_1$$

Figure 25

$$|C_0|\cos\phi_0 = \frac{\beta^2|C_0|^2 - \beta^2|C_1|^2 + 1}{2\beta}$$

$$|C_1|\cos\phi_1 = \frac{\beta^2|C_1|^2 - \beta^2|C_0|^2 + 1}{2\beta}$$

Figure 26

$$|C_0|\sin\phi_0 = \sqrt{|C_0|^2 - (|C_0|\cos\phi_0)^2}$$

$$|C_1|\sin\phi_1 = \sqrt{|C_1|^2 - (|C_1|\cos\phi_0)^2}$$

Figure 27

$$\begin{bmatrix} W_0 \\ W_{0F} \\ W_1 \\ W_{1F} \end{bmatrix}$$

Figure 28

$$\begin{bmatrix} S_0 \\ S_1 \end{bmatrix} = \begin{bmatrix} a & b & 0 & 0 \\ 0 & 0 & c & d \end{bmatrix} \begin{bmatrix} W_0 \\ W_{0F} \\ W_1 \\ W_{1F} \end{bmatrix}$$

Figure 29

$$\begin{bmatrix} S_0 \\ S_1 \end{bmatrix} = \begin{bmatrix} aC_0 & bC_0 \\ cC_1 & dC_1 \end{bmatrix} \begin{bmatrix} Z_0 \\ Z_{0F} \end{bmatrix} = \begin{bmatrix} aC_0 & b/a & 0 \\ cC_1 & 0 & d/c \end{bmatrix} \begin{bmatrix} Z_0 \\ W_{0F} \\ W_{1F} \end{bmatrix}$$

Figure 30

$$R_{XX} = \begin{bmatrix} X_0X_0^* & X_0X_1^* \\ X_1X_0^* & X_1X_1^* \end{bmatrix} = U\Lambda U^*$$

Figure 31

$$\frac{R_{XX}}{\alpha} = \begin{bmatrix} |C_0|^2 & |C_0||C_1|\cos\theta + j\,\mathrm{Im}(X_0X_1^*)/\alpha \\ |C_0||C_1|\cos\theta - j\,\mathrm{Im}(X_0X_1^*)/\alpha & |C_1|^2 \end{bmatrix} = U\frac{\Lambda}{\alpha}U^*$$

Figure 32

$$\frac{R_{XX}}{|X_0||X_1|} = \begin{bmatrix} X_0X_0^*/|X_0||X_1| & X_0X_1^*/|X_0||X_1| \\ X_1X_0^*/|X_0||X_1| & X_1X_1^*/|X_0||X_1| \end{bmatrix} = \begin{bmatrix} R_{00} & R_{01} \\ R_{01}^* & 1/R_{00} \end{bmatrix}$$

Figure 33

$$\frac{|X_0||X_1|}{\alpha} = \frac{|X_0||X_1|}{[X_0X_0^* + X_1X_1^* + 2\,\mathrm{Re}(X_0X_1^*)]\beta^2} = \frac{1}{[R_{00} + (1/R_{00}) + 2\,\mathrm{Re}(R_{01})]\beta^2}$$

Figure 34

$$U\left(\frac{\Lambda}{\alpha}\right)^{1/2} V\alpha V^* \left(\frac{\Lambda}{\alpha}\right)^{1/2} U^* = U\Lambda U^*$$

$$U\left(\frac{\Lambda}{\alpha}\right)^{1/2} V = \begin{bmatrix} aC_0 & bC_0 \\ cC_1 & dC_1 \end{bmatrix}$$

Figure 35

$$U\left(\frac{\Lambda}{\alpha}\right)^{1/2}V=\begin{bmatrix}u_{00} & u_{01}\\ u_{10} & u_{11}\end{bmatrix}\begin{bmatrix}\cos\omega & \sin\omega\\ -\sin\omega & \cos\omega\end{bmatrix}=\begin{bmatrix}u_{00}\cos\omega-u_{10}\sin\omega & u_{00}\sin\omega+u_{01}\cos\omega\\ u_{10}\cos\omega-u_{11}\sin\omega & u_{10}\sin\omega+u_{11}\cos\omega\end{bmatrix}$$

Figure 36

$$u_{00}\sin\omega+u_{01}\cos\omega=-(u_{10}\sin\omega+u_{11}\cos\omega)$$
$$\omega=\text{atan2}(-u_{11}-u_{01},u_{00}+u_{10})$$

Figure 37

$$\begin{bmatrix}aC_0 & b/a & 0\\ cC_1 & 0 & d/c\end{bmatrix}$$

Figure 38

$$W'_{0F}=W_{0F}a|C_0|\left(\frac{|Z_0|}{|W_{0F}|}\right),$$
$$|W'_{0F}|=|Z_0|a|C_0|$$

Figure 39

If: $|W_{0F}|\geq|Z_0|a|C_0|*T$ then: $W'_{0F}=W_{0F}a|C_0|\left(\frac{|Z_0|}{|W_{0F}|}\right)T$ for some constant $T$.

BITSTREAM SYNTAX FOR MULTI-PROCESS AUDIO DECODING

BACKGROUND

Perceptual Transform Coding

The coding of audio utilizes coding techniques that exploit various perceptual models of human hearing. For example, many weaker tones near strong ones are masked so they do not need to be coded. In traditional perceptual audio coding, this is exploited as adaptive quantization of different frequency data. Perceptually important frequency data are allocated more bits and thus finer quantization and vice versa.

For example, transform coding is conventionally known as an efficient scheme for the compression of audio signals. In transform coding, a block of the input audio samples is transformed (e.g., via the Modified Discrete Cosine Transform or MDCT, which is the most widely used), processed, and quantized. The quantization of the transformed coefficients is performed based on the perceptual importance (e.g. masking effects and frequency sensitivity of human hearing), such as via a scalar quantizer.

When a scalar quantizer is used, the importance is mapped to relative weighting, and the quantizer resolution (step size) for each coefficient is derived from its weight and the global resolution. The global resolution can be determined from target quality, bit rate, etc. For a given step size, each coefficient is quantized into a level which is zero or non-zero integer value.

At lower bitrates, there are typically a lot more zero level coefficients than non-zero level coefficients. They can be coded with great efficiency using run-length coding. In run-length coding, all zero-level coefficients typically are represented by a value pair consisting of a zero run (i.e., length of a run of consecutive zero-level coefficients), and level of the non-zero coefficient following the zero run. The resulting sequence is $R_0$, $L_0$, $R_1$, $L_1$ . . . , where R is zero run and L is non-zero level.

By exploiting the redundancies between R and L, it is possible to further improve the coding performance. Run-level Huffman coding is a reasonable approach to achieve it, in which R and L are combined into a 2-D array (R,L) and Huffman-coded.

When transform coding at low bit rates, a large number of the transform coefficients tend to be quantized to zero to achieve a high compression ratio. This could result in there being large missing portions of the spectral data in the compressed bitstream. After decoding and reconstruction of the audio, these missing spectral portions can produce an unnatural and annoying distortion in the audio. Moreover, the distortion in the audio worsens as the missing portions of spectral data become larger. Further, a lack of high frequencies due to quantization makes the decoded audio sound muffled and unpleasant.

Wide-Sense Perceptual Similarity

Perceptual coding also can be taken to a broader sense. For example, some parts of the spectrum can be coded with appropriately shaped noise. When taking this approach, the coded signal may not aim to render an exact or near exact version of the original. Rather the goal is to make it sound similar and pleasant when compared with the original. For example, a wide-sense perceptual similarity technique may code a portion of the spectrum as a scaled version of a code-vector, where the code vector may be chosen from either a fixed predetermined codebook (e.g., a noise codebook), or a codebook taken from a baseband portion of the spectrum (e.g., a baseband codebook).

All these perceptual effects can be used to reduce the bit-rate needed for coding of audio signals. This is because some frequency components do not need to be accurately represented as present in the original signal, but can be either not coded or replaced with something that gives the same perceptual effect as in the original.

In low bit rate coding, a recent trend is to exploit this wide-sense perceptual similarity and use a vector quantization (e.g., as a gain and shape code-vector) to represent the high frequency components with very few bits, e.g., 3 kbps. This can alleviate the distortion and unpleasant muffled effect from missing high frequencies. The transform coefficients of the "spectral holes" also are encoded using the vector quantization scheme. It has been shown that this approach enhances the audio quality with a small increase of bit rate.

SUMMARY

The following Detailed Description concerns various audio encoding/decoding techniques and tools that provide a bitstream syntax to support decoding using multiple different decoding processes or decoder components. Each component separately extracts the parameters from the bitstream that it uses to process the coded audio content.

In one implementation, the decoding processes include a process for spectral hole filling in a base band spectrum region, a process for vector quantization decoding of an extension spectrum region (called "frequency extension"), a process for reconstructing multiple channels based on a coded subset of channels (called "channel extension"), and a process for decoding a spectrum region containing sparse spectral peaks.

This Summary is provided to introduce a selection of concepts in a simplified form that is further described below in the Detailed Description. This summary is not intended to identify key features or essential features of the claimed subject matter, nor is it intended to be used as an aid in determining the scope of the claimed subject matter. Additional features and advantages of the invention will be made apparent from the following detailed description of embodiments that proceeds with reference to the accompanying drawings.

BRIEF DESCRIPTION OF THE DRAWINGS

FIGS. 19-39 are equations and related matrix arrangements showing details of channel extension processing in some implementations.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
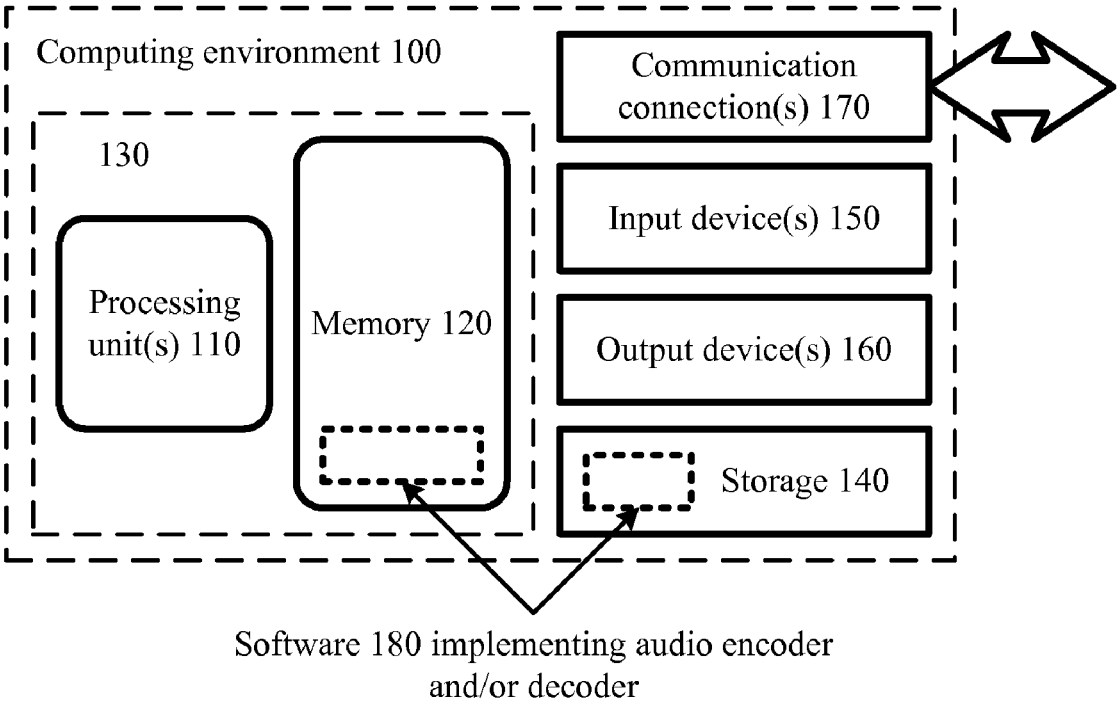
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The processing unit also can comprise a central processing unit and co-processors, and/or dedicated or special purpose processing units (e.g., an audio processor). The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touchscreen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication over a communication medium to one or more other computing entities. The communication medium conveys information such as computer-executable instructions, audio or video information, or other data in a data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable media include memory 120, storage 140, communication media, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
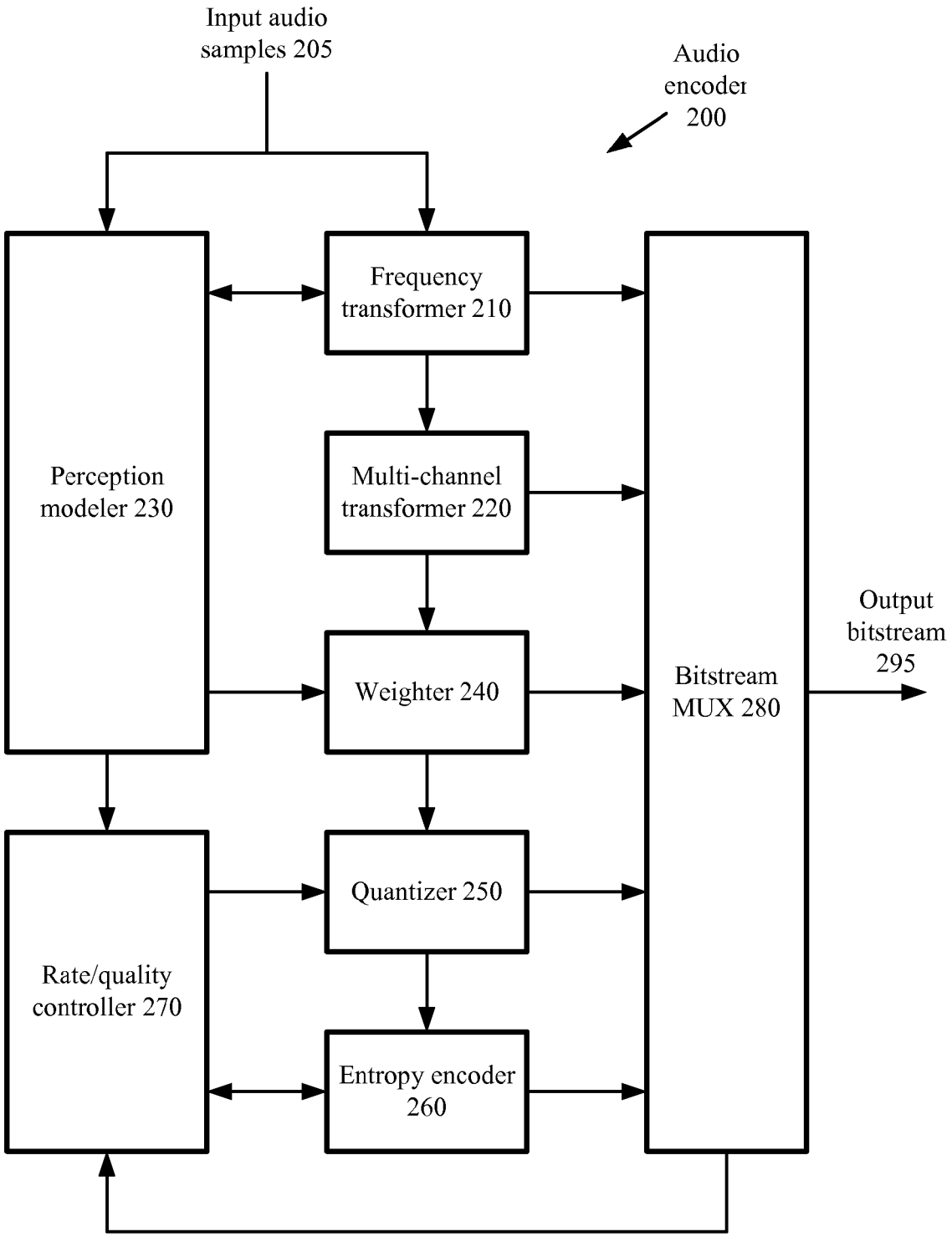
FIGS. 2, 3, 4, and 5 are block diagrams of generalized encoders and/or decoders in conjunction with which various described embodiments may be implemented.
Figure 3:
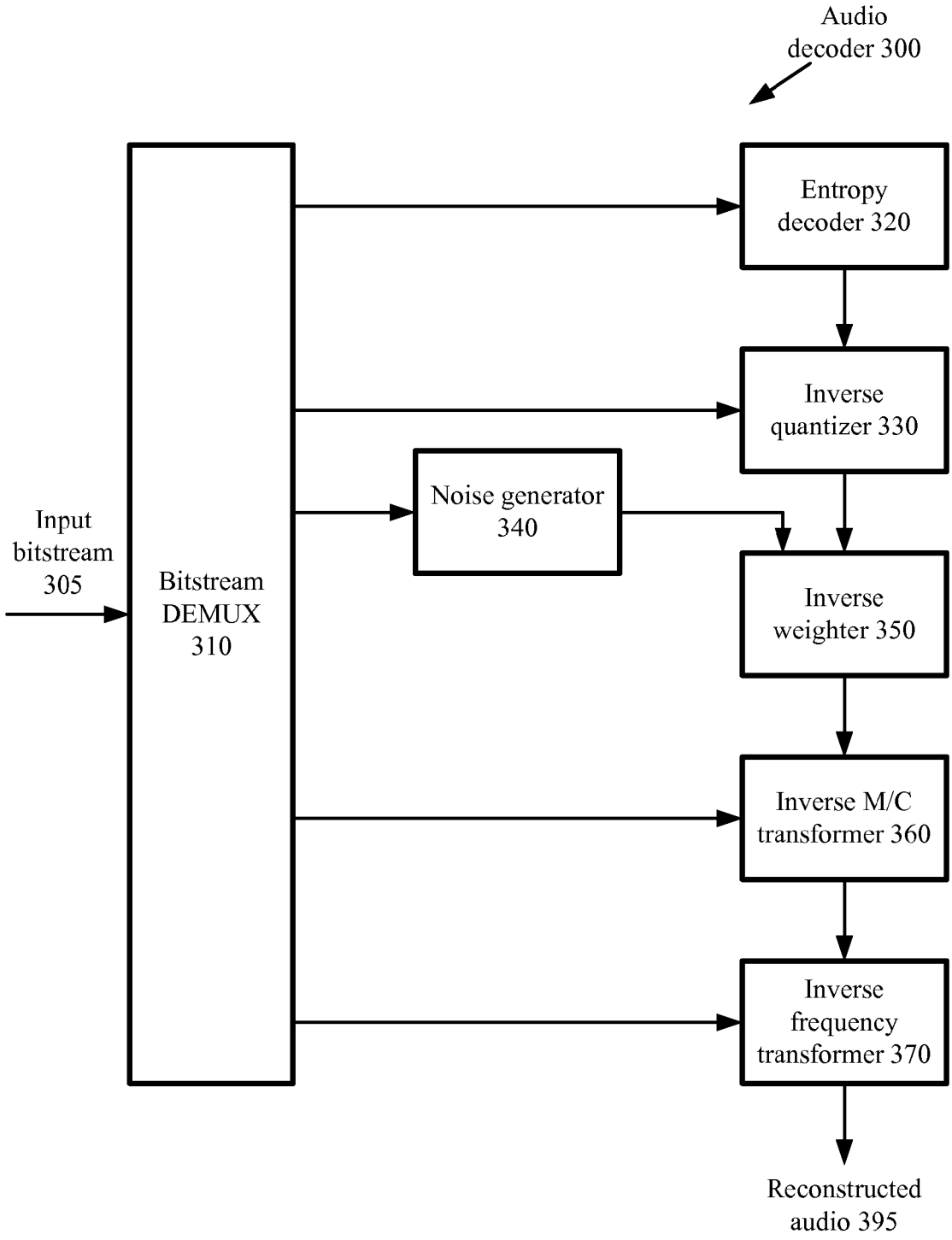

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
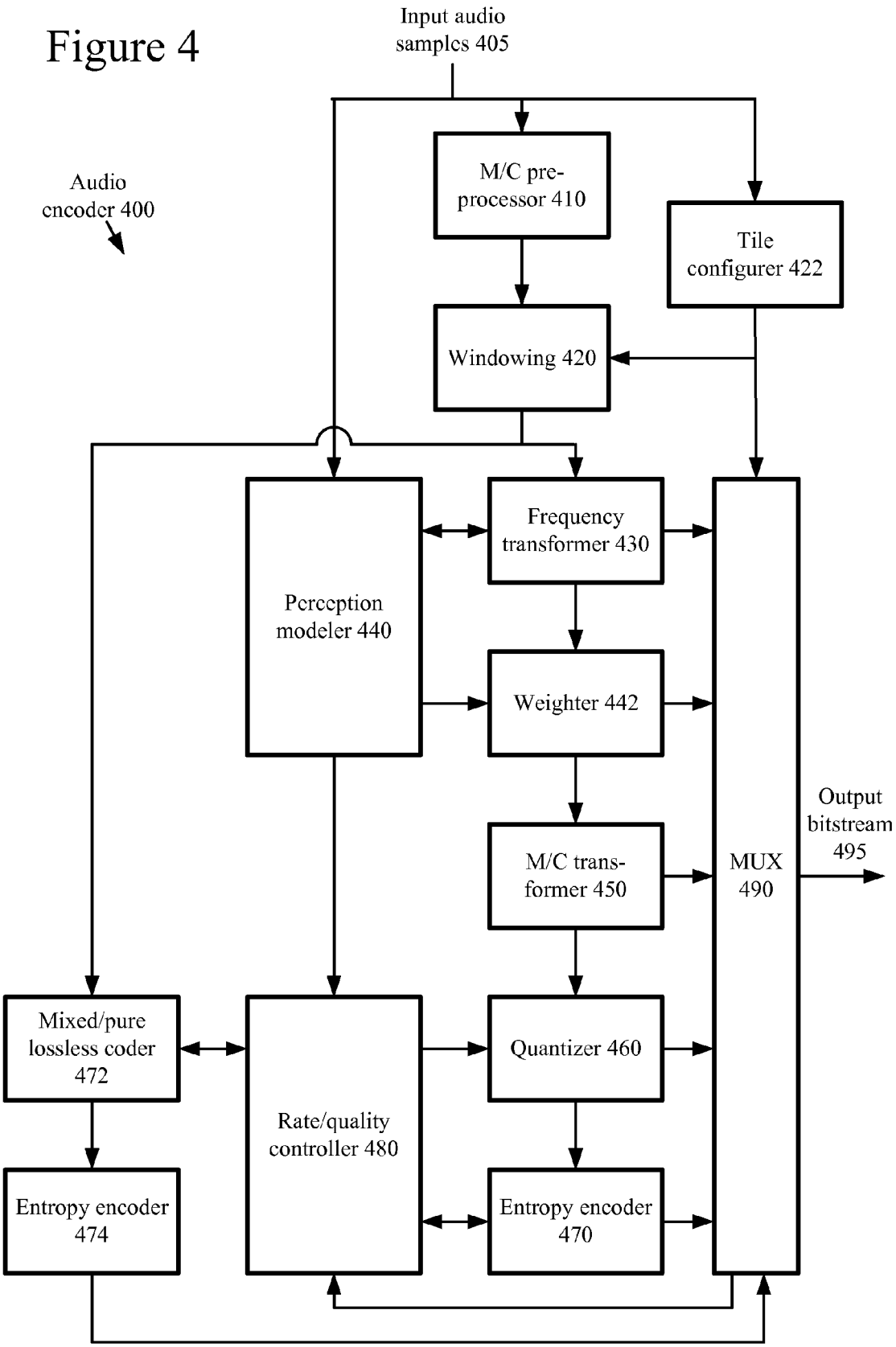
Figure 5:
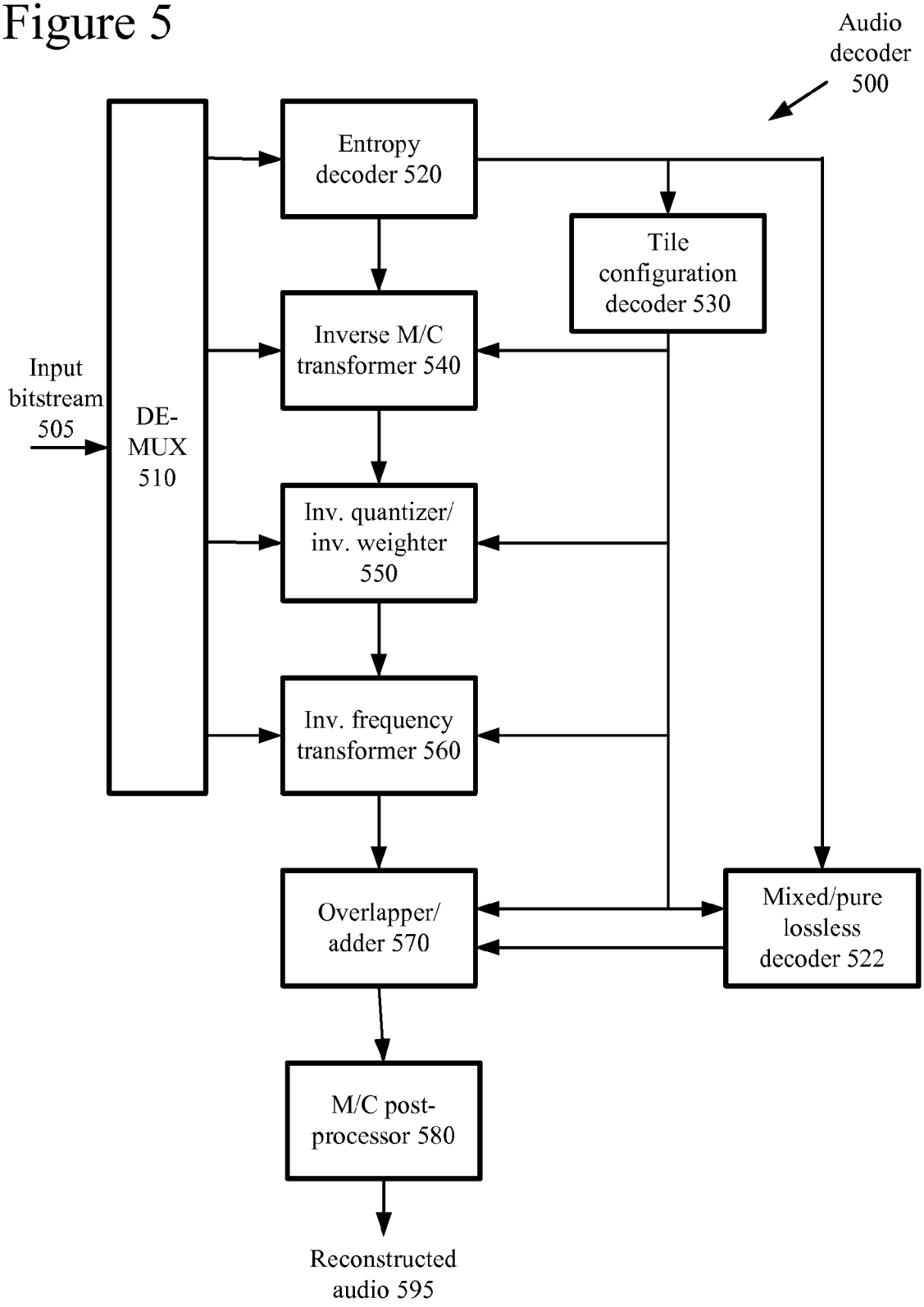

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bitrate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bitrate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bitrate and/or quality of the output of the encoder 200. The controller 270 outputs the quantization step size to the quantizer 250 with the goal of satisfying bitrate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bitrate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bitrate) compression. The lossy coding mode includes components such as the weighter 442 and quantizer 460 and is typically used for adjustable quality (and controlled bitrate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bitrate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

Figure 6:
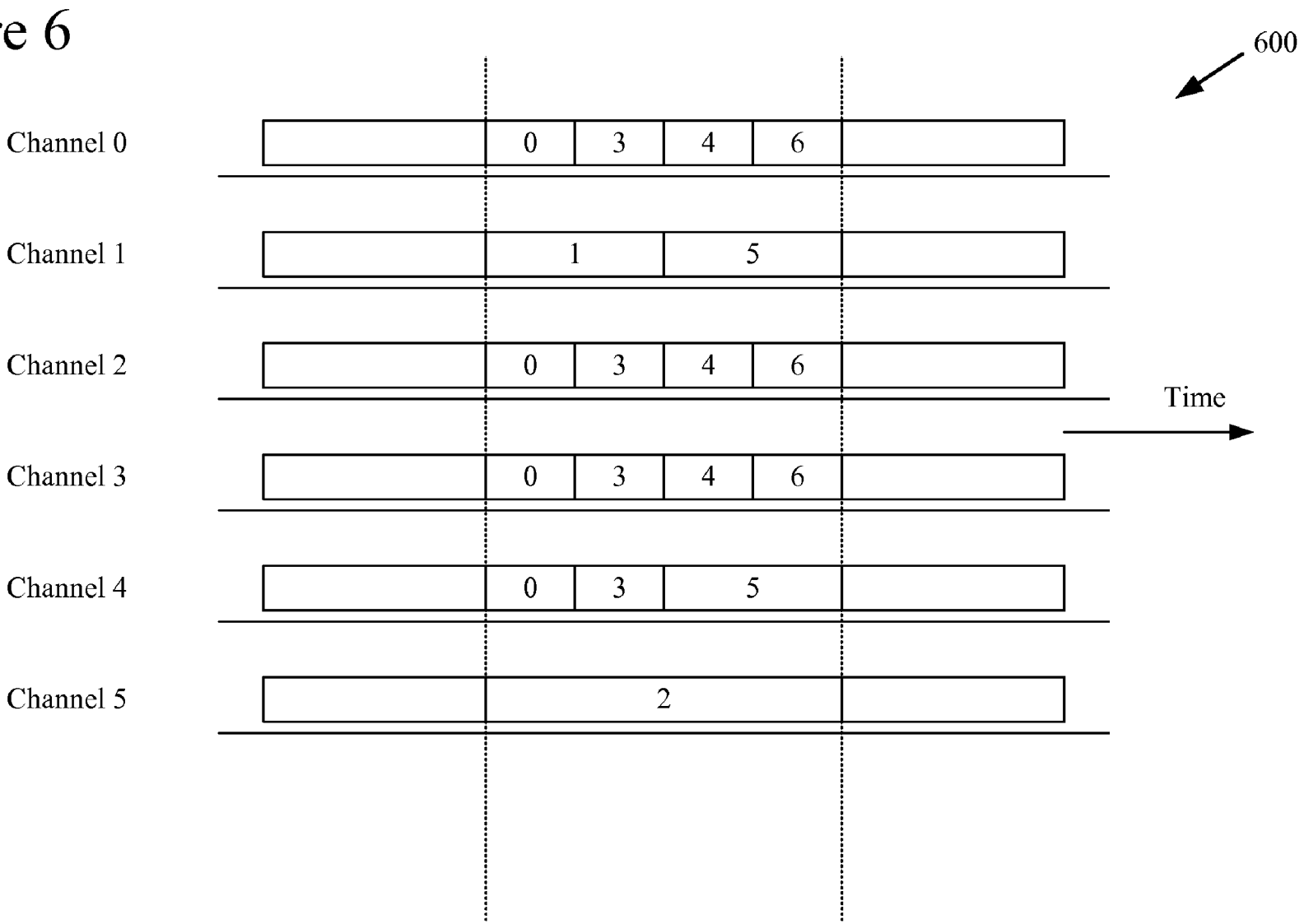
FIG. 6 is a diagram showing an example tile configuration.

FIG. 6 shows an example tile configuration 600 for a frame of 5.1 channel audio. The tile configuration 600 includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown, a particular tile can include windows in non-contiguous channels.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bitrate and/or quality of the output of the encoder 400. The controller 480 outputs the quantization factors to the quantizer 460 with the goal of satisfying quality and/or bitrate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bitrate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Encoder/Decoder with Multiple Decoding Processes/Components

Figure 7:
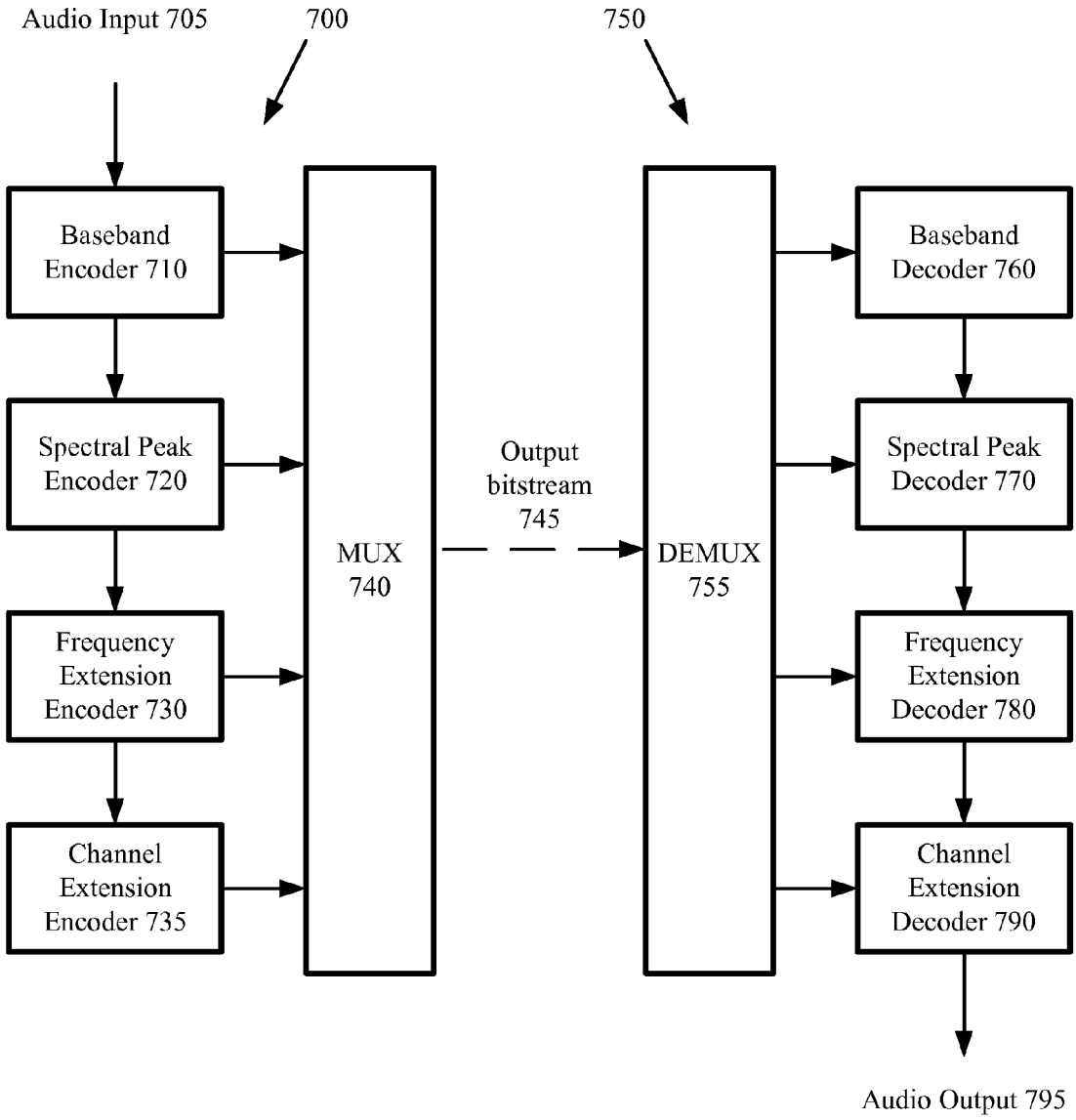
FIG. 7 is a data flow diagram of an audio encoding and decoding method that includes sparse spectral peak coding, and flexible frequency and time partitioning techniques.

FIG. 7 illustrates an extension of the above described transform-based, perceptual audio encoders/decoders of FIGS. 2-5 that further provides multiple distinct decoding processes or components for reconstructing separate spectrum regions and channels of audio. The decoding parameters used by the multiple decoding processes are signaled via a bitstream syntax (described more fully below) that allows the decoding parameters to be separately read from the encoded bitstream for processing via the appropriate decoding process.

In the illustrated extension 700, an audio encoder 700 processes audio received at an audio input 705, and encodes a representation of the audio as an output bitstream 745. An audio decoder 750 receives and processes this output bitstream to provide a reconstructed version of the audio at an audio output 795. In the audio encoder 700, portions of the encoding process are divided among a baseband encoder 710, a spectral peak encoder 720, a frequency extension encoder 730 and a channel extension encoder 735. A multiplexor 740 organizes the encoding data produced by the baseband encoder, spectral peak encoder, frequency extension encoder and channel extension coder into the output bitstream 745.

On the encoding end, the baseband encoder 710 first encodes a baseband portion of the audio. This baseband portion is a preset or variable "base" portion of the audio spectrum, such as a baseband up to an upper bound frequency of 4 KHz. The baseband alternatively can extend to a lower or higher upper bound frequency. The baseband encoder 710 can be implemented as the above-described encoders 200, 400 (FIGS. 2, 4) to use transform-based, perceptual audio encoding techniques to encode the baseband of the audio input 705.

The spectral peak encoder 720 encodes the transform coefficients above the upper bound of the baseband using an efficient spectral peak encoding. This spectral peak encoding uses a combination of intra-frame and inter-frame spectral peak encoding modes. The intra-frame spectral peak encoding mode encodes transform coefficients corresponding to a spectral peak as a value trio of a zero run, and the two transform coefficients following the zero run (e.g., $(R_0(L_0,L_1))$). This value trio is further separately or jointly entropy coded. The inter-frame spectral peak encoding mode uses predictive encoding of a position of the spectral peak relative to its position in a preceding frame.

The frequency extension encoder 730 is another technique used in the encoder 700 to encode the higher frequency portion of the spectrum. This technique (herein called "frequency extension") takes portions of the already coded spectrum or vectors from a fixed codebook, potentially applying a non-linear transform (such as, exponentiation or combination of two vectors) and scaling the frequency vector to represent a higher frequency portion of the audio input. The technique can be applied in the same transform domain as the baseband encoding, and can be alternatively or additionally applied in a transform domain with a different size (e.g., smaller) time window.

The channel extension encoder 740 implements techniques for encoding multi-channel audio. This "channel extension" technique takes a single channel of the audio and applies a bandwise scale factor in a transform domain having a smaller time window than that of the transform used by the baseband encoder. The channel extension encoder derives the scale factors from parameters that specify the normalized correlation matrix for channel groups. This allows the channel extension decoder 780 to reconstruct additional channels of the audio from a single encoded channel, such that a set of complex second order statistics (i.e., the channel correlation matrix) is matched to the encoded channel on a bandwise basis.

On the side of the audio decoder 750, a demultiplexor 755 again separates the encoded baseband, spectral peak, frequency extension and channel extension data from the output bitstream 745 for decoding by a baseband decoder 760, a spectral peak decoder 770, a frequency extension decoder 780 and a channel extension decoder 790. Based on the information sent from their counterpart encoders, the baseband decoder, spectral peak decoder, frequency extension decoder and channel extension decoder perform an inverse of the respective encoding processes, and together reconstruct the audio for output at the audio output 795 (e.g., the audio is played to output devices 160 in the computing environment 100 in FIG. 1).

A. Sparse Spectral Peak Encoding Component

The following section describes the encoding and decoding processes performed by the sparse spectral peak encoding and decoding components 720, 770 (FIG. 7) in more detail.

Figure 8:
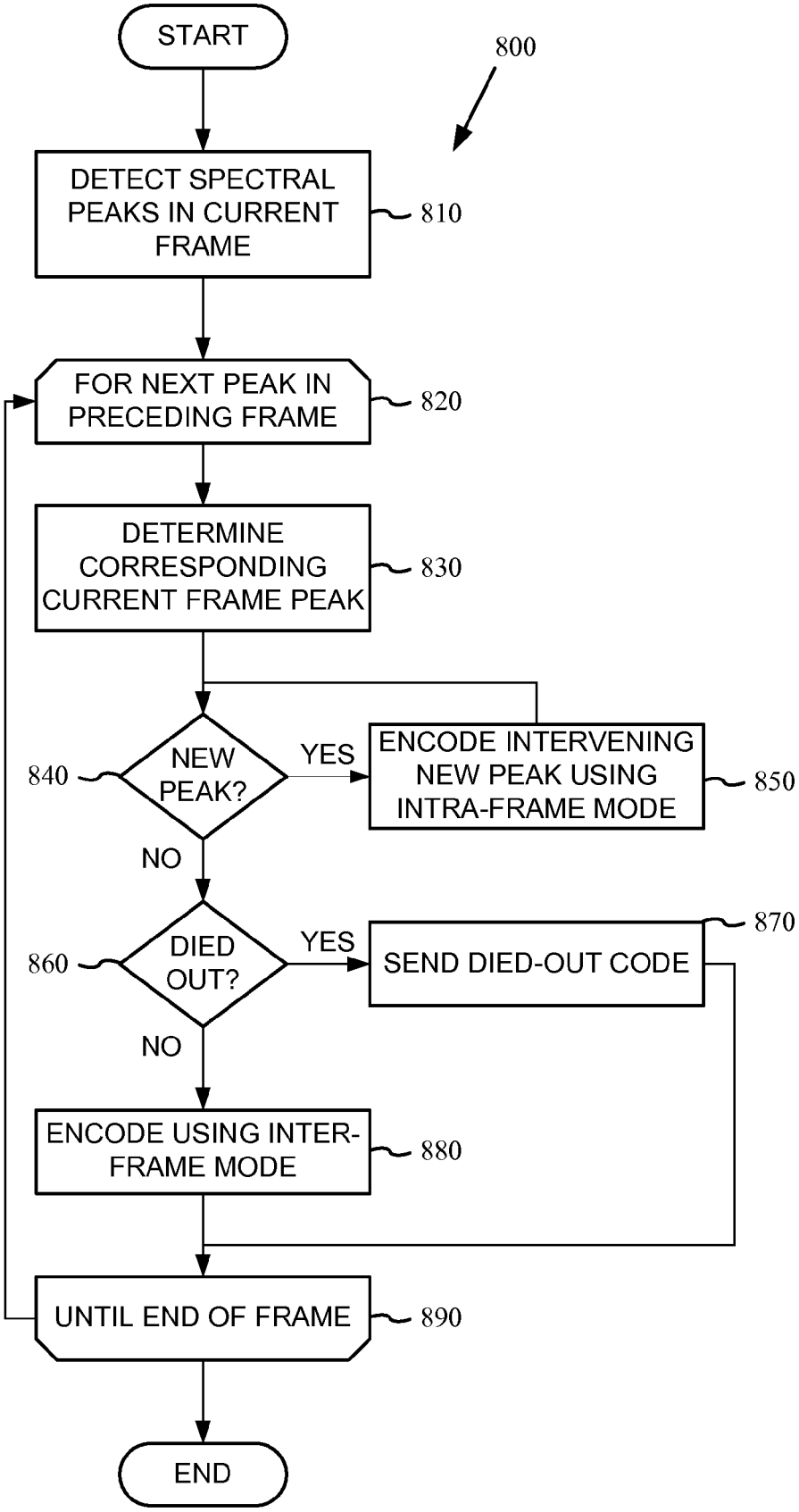
FIG. 8 is a flow diagram of a process for sparse spectral peak encoding.

FIG. 8 illustrates a procedure implemented by the spectral peak encoder 720 for encoding sparse spectral peak data. The encoder 700 invokes this procedure to encode the transform coefficients above the baseband's upper bound frequency (e.g., over 4 KHz) when this high frequency portion of the spectrum is determined to (or is likely to) contain sparse spectral peaks. This is most likely to occur after quantization of the transform coefficients for low bit rate encoding.

The spectral peak encoding procedure encodes the spectral peaks in this upper frequency band using two separate coding modes, which are referred to herein as intra-frame mode and inter-frame mode. In the intra-frame mode, the spectral peaks are coded without reference to data from previously coded frames. The transform coefficients of the spectral peak are coded as a value trio of a zero run (R), and two transform coefficient levels $(L_0,L_1)$. The zero run (R) is a length of a run of zero-value coefficients from a last coded transform coefficient. The transform coefficient levels are the quantized values of the next two non-zero transform coefficients. The quantization of the spectral peak coefficients may be modified from the base step size (e.g., via a mask modifier), as is shown in the syntax tables below). Alternatively, the quantization applied to the spectral peak coefficients can use a different quantizer separate from that applied to the base band coding (e.g., a different step size or even different quantization scheme, such as non-linear quantization). The value trio $(R, (L_0,L_1))$ is then entropy coded separately or jointly, such as via a Huffman coding.

The inter-frame mode uses predictive coding based on the position of spectral peaks in a previous frame of the audio. In the illustrated procedure, the position is predicted based on spectral peaks in an immediately preceding frame. However, alternative implementations of the procedure can apply predictions based on other or additional frames of the audio, including bi-directional prediction. In this inter-frame mode, the transform coefficients are encoded as a shift (S) or offset of the current frame spectral peak from its predicted position. For the illustrated implementation, the predicted position is that of the corresponding previous frame spectral peak. However, the predicted position in alternative implementations can be a linear or other combination of the previous frame spectral peak and other frame information. The position S and two transform coefficient levels $(L_0,L_1)$ are entropy coded separately or jointly with Huffman coding techniques. In the inter-frame mode, there are cases where some of the predicted position are unused by spectral peaks of the current frame. In one implementation to signal such "died-out" positions, the "died-out" code is embedded into the Huffman table of the shift (S).

In alternative implementations, the intra-frame coded value trio $(R,(L_0,L_1))$ and/or the inter-mode trio $(S,(L_0,L_1))$ could be coded by further predicting from previous trios in the current frame or previous frame when such coding further improves coding efficiency.

Each spectral peak in a frame is classified into intra-frame mode or inter-frame mode. One criteria of the classification can be to compare bit counts of coding the spectral peak with each mode, and choose the mode yielding the lower bit count. As a result, frames with spectral peaks can be intra-frame mode only, inter-frame mode only, or a combination of intra-frame and inter-frame mode coding.

First (action 810), the spectral peak encoder 720 detects spectral peaks in the transform coefficient data for a frame (the "current frame") of the audio input that is currently being encoded. These spectral peaks typically correspond to high frequency tonal components of the audio input, such as may be produced by high pitched string instruments. In the transform coefficient data, the spectral peaks are the transform coefficients whose levels form local maximums, and typically are separated by very long runs of zero-level transform coefficients (for sparse spectral peak data).

In a next loop of actions 820-890, the spectral peak encoder 720 then compares the positions of the current frame's spectral peaks to those of the predictive frame (e.g., the immediately preceding frame in the illustrated implementation of the procedure). In the special case of the first frame (or other seekable frames) of the audio, there is no preceding frame to use for inter-frame mode predictive coding. In which case, all spectral peaks are determined to be new peaks that are encoded using the intra-frame coding mode, as indicated at actions 840, 850.

Within the loop 820-890, the spectral peak encoder 720 traverses a list of spectral peaks that were detected during processing an immediately preceding frame of the audio input. For each previous frame spectral peak, the spectral peak encoder 720 searches among the spectral peaks of the current frame to determine whether there is a corresponding spectral peak in the current frame (action 830). For example, the spectral peak encoder 720 can determine that a current frame spectral peak corresponds to a previous frame spectral peak if the current frame spectral peak is closest to the previous frame spectral peak, and is also closer to that previous frame spectral peak than any other spectral peak of the current frame.

If the spectral peak encoder 720 encounters any intervening new spectral peaks before the corresponding current frame spectral peak (decision 840), the spectral peak encoder 720 encodes (action 850) the new spectral peak(s) using the intra-frame mode as a sequence of entropy coded value trios, $(R,(L_0,L_1))$.

If the spectral peak encoder 720 determines there is no corresponding current frame spectral peak for the previous frame spectral peak (i.e., the spectral peak has "died out," as indicated at decision 840), the spectral peak encoder 720 sends a code indicating the spectral peak has died out (action 850). For example, the spectral peak encoder 720 can determine there is no corresponding current frame spectral peak when a next current frame spectral peak is closer to the next previous frame spectral peak.

Otherwise, the spectral peak encoder 720 encodes the position of the current frame spectral peak using the inter-frame mode (action 880), as described above. If the shape of the current frame spectral peak has changed, the spectral peak encoder 720 further encodes the shape of the current frame spectral peak using the intra-frame mode coding (i.e., combined inter-frame/intra-frame mode), as also described above.

The spectral peak encoder 720 continues the loop 820-890 until all spectral peaks in the high frequency band are encoded.

B. Frequency Extension Coding Component

The following section describes the encoding and decoding processes performed by the frequency extension encoding and decoding components 730, 780 (FIG. 7) in more detail.

1. Band Partitioning Encoding Procedure

Figure 9:
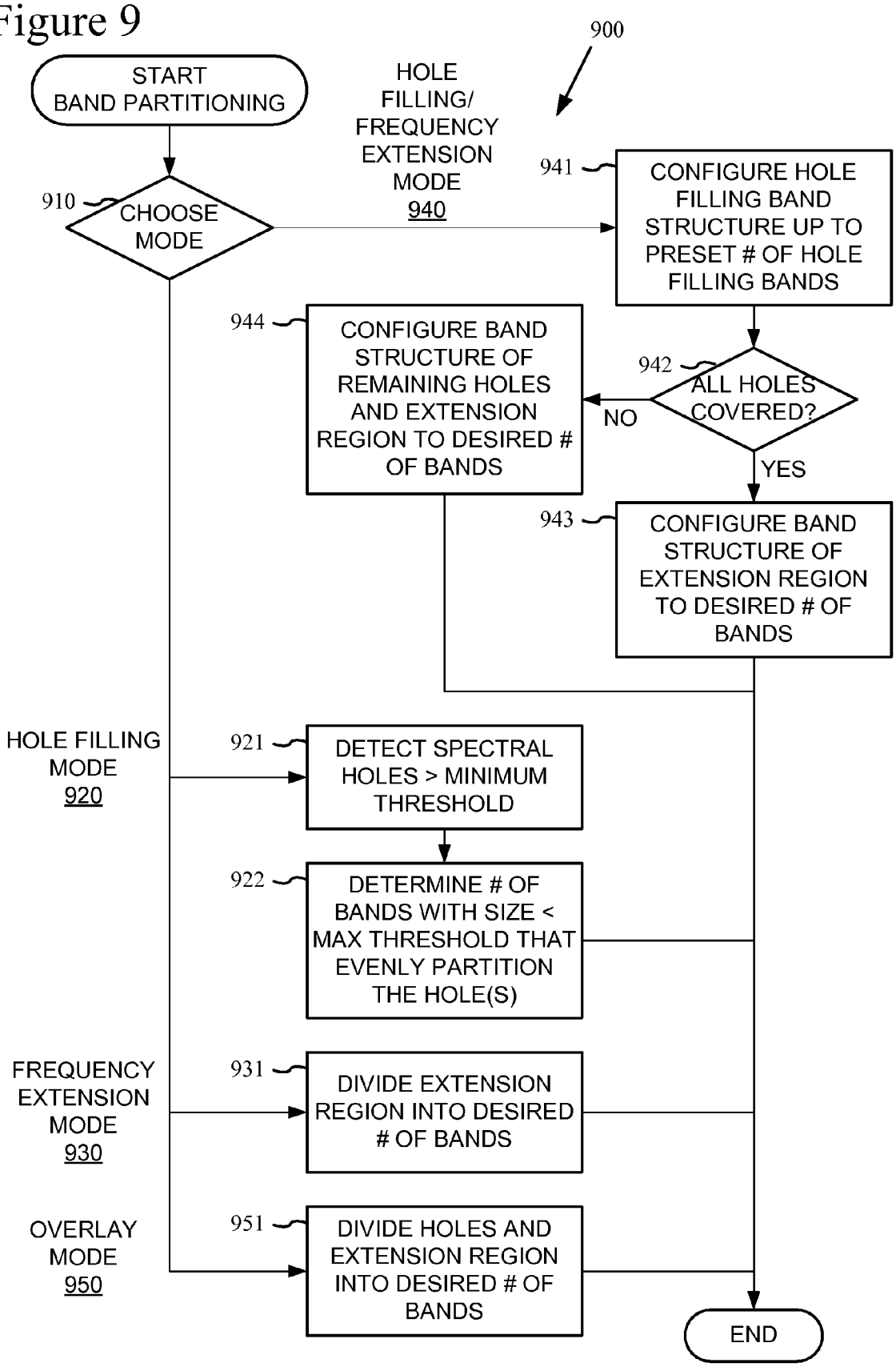
FIG. 9 is a flow diagram of a procedure for band partitioning of spectral hole and missing high frequency regions.

FIG. 9 illustrates a procedure 900 implemented by the frequency extension encoder 730 for partitioning any spectral holes and missing high frequency region into bands for vector quantization coding. The encoder 700 invokes this procedure to encode the transform coefficients that are determined to (or likely to) be missing in the high frequency region (i.e., above the baseband's upper bound frequency, which is 4 KHz in an example implementation) and/or form spectral holes in the baseband region. This is most likely to occur after quantization of the transform coefficients for low bit rate encoding, where more of the originally non-zero spectral coefficients are quantized to zero and form the missing high frequency region and spectral holes. The gaps between the base coding and sparse spectral peaks also are considered as spectral holes.

The band partitioning procedure 900 determines a band structure to cover the missing high frequency region and spectral holes using various band partitioning procedures. The missing spectral coefficients (both holes and higher frequencies) are coded in either the same transform domain or a smaller size transform domain. The holes are typically coded in the same transform domain as the base using the band partitioning procedure. Vector quantization in the base transform domain partitions the missing regions into bands, where each band is either a hole-filling band, overlay band, or a frequency extension band.

At start (decision step 910) of the band partitioning procedure 900, the encoder 700 chooses which of the band partitioning procedures to use. The choice of procedure can be based on the encoder first detecting the presence of spectral holes or missing high frequencies among the spectral coefficients encoded by the baseband encoder 710 and spectral peak encoder 720 for a current transform block of input audio samples. The presence of spectral holes in the spectral coefficients may be done, for example, by searching for runs of (originally non-zero) spectral coefficients that are quantized to zero level in the baseband region and that exceed a minimum length of run. The presence of a missing high frequency region can be detected based on the position of the last non-zero coefficients, the overall number of zero-level spectral coefficients in a frequency extension region (the region above the maximum baseband frequency, e.g., 4 KHz), or runs of zero-level spectral coefficients. In the case that the spectral coefficients contain significant spectral holes but not missing high frequencies, the encoder generally would choose the hole filling procedure 920. Conversely, in the case of missing high frequencies but few or no spectral holes, the encoder generally would choose the frequency extension procedure 930. If both spectral holes and missing high frequencies are present, the encoder generally uses hole filling, overlay and frequency extension bands. Alternatively, the band partitioning procedure can be determined based simply on the selected bit rate (e.g., the hole filling and frequency extension procedure 940 is appropriate to very low bit rate encoding, which tends to produce both spectral holes and missing high frequencies), or arbitrarily chosen.

In the hole filling procedure 920, the encoder 700 uses two thresholds to manage the number of bands allocated to fill spectral holes, which include a minimum hole size threshold and a maximum band size threshold. At a first action 921, the encoder detects spectral holes (i.e., a run of consecutive zero-level spectral coefficients in the baseband after quantization) that exceed the minimum hole size threshold. For each spectral hole over the minimum threshold, the encoder then evenly partitions the spectral hole into a number of bands, such that the size of the bands is equal to or smaller than a maximum band size threshold (action 922). For example, if a spectral hole has a width of 14 coefficients and the maximum band size threshold is 8, then the spectral hole would be partitioned into two bands having a width of 7 coefficients each. The encoder can then signal the resulting band structure in the compressed bit stream by coding two thresholds.

In the frequency extension procedure 930, the encoder 700 partitions the missing high frequency region into separate bands for vector quantization coding. As indicated at action 931, the encoder divides the frequency extension region (i.e., the spectral coefficients above the upper bound of the base band portion of the spectrum) into a desired number of bands. The bands can be structured such that successive bands are related by a ratio of their band size that is binary-increased, linearly-increased, or an arbitrary configuration.

In the overlay procedure 950, the encoder partitions both spectral holes (with size greater than the minimum hole threshold) and the missing high frequency region into a band structure using the frequency extension procedure 930 approach. In other words, the encoder partitions the holes and high frequency region into a desired number of bands that have a binary-increasing band size ratio, linearly-increasing band size ratio, or arbitrary configuration of band sizes.

Finally, the encoder can choose a fourth band partitioning procedure called the hole filling and frequency extension procedure 940. In the hole filling and frequency extension procedure 940, the encoder 700 partitions both spectral holes and the missing high frequency region into a band structure for vector quantization coding. First, as indicated by block 941, the encoder 700 configures a band structure to fill any spectral holes. As with the hole filling procedure 920 via the actions 921, 922, the encoder detects any spectral holes larger than a minimum hole size threshold. For each such hole, the encoder allocates a number of bands with size less than a maximum band size threshold in which to evenly partition the spectral hole. The encoder halts allocating bands in the band structure for hole filling upon reaching the preset number of hole filling bands. The decision step 942 checks if all spectral holes are filled by the action 941 (hole filling procedure). If all spectral holes are covered, the action 943 then configures a band structure for the missing high frequency region by allocating a desired total number of bands minus the number of bands allocated as hole filling bands, as with the frequency extension procedure 930 via the action 931. Otherwise, the whole of the unfilled spectral holes and missing high frequency region is partitioned to a desired total number of bands minus the number of bands allocated as hole filling bands by the action 944 as with the overlay procedure 950 via the action 951. Again, the encoder can choose a band size ratio of successive bands used in the actions 943, 944, from binary increasing, linearly increasing, or an arbitrary configuration.

2. Varying Transform Window Size with Vector Quantization Encoding Procedure

Figure 10:
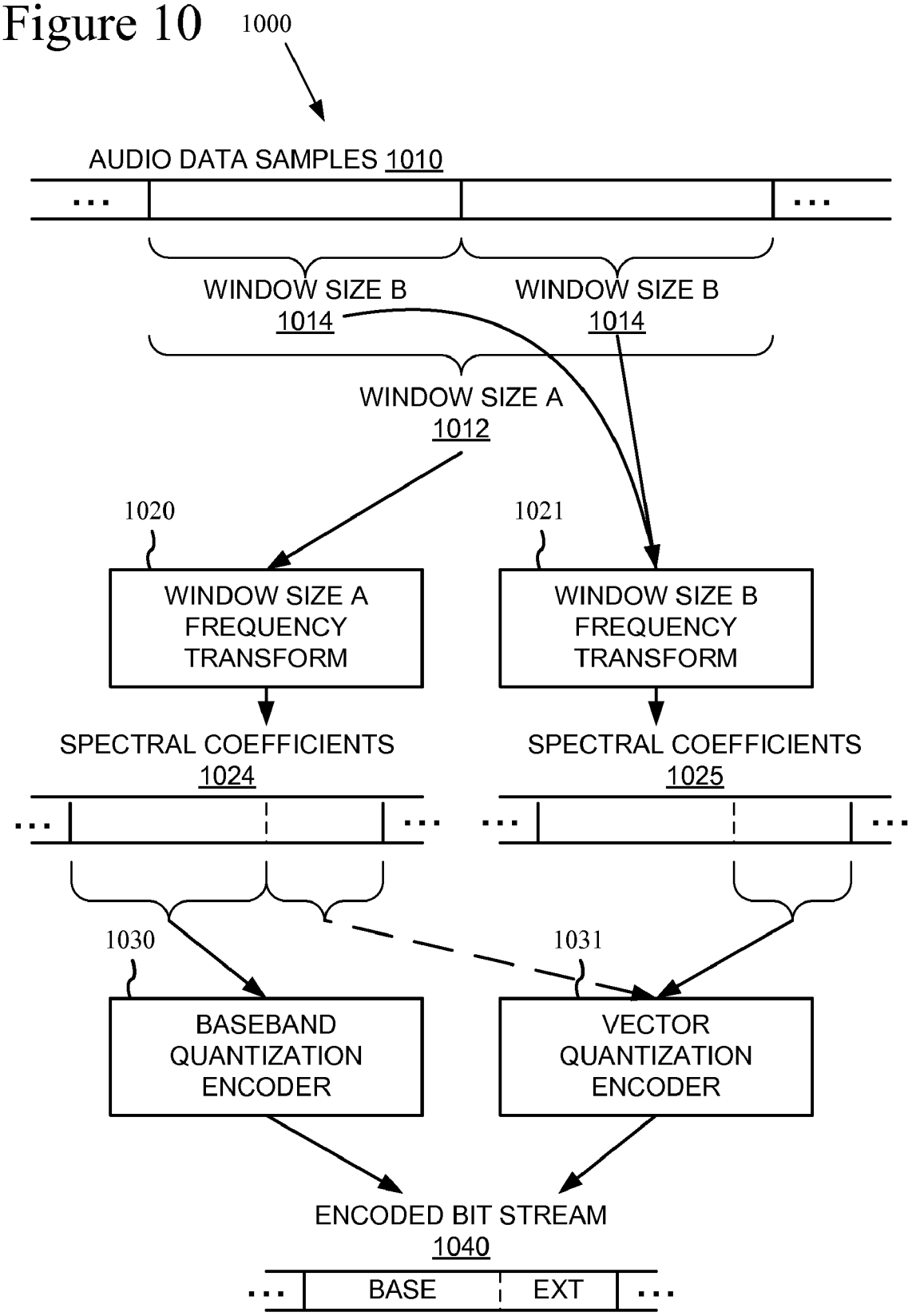
FIG. 10 is a flow diagram of a procedure for encoding using vector quantization with varying transform block ("window") sizes to adapt time resolution of transient versus tonal sounds.

FIG. 10 illustrates an encoding procedure 1000 for combining vector quantization coding with varying window (transform block) sizes. As remarked above, an audio signal generally consists of stationary (typically tonal) components as well as "transients." The tonal components desirably are encoded using a larger transform window size for better frequency resolution and compression efficiency, while a smaller transform window size better preserves the time resolution of the transients. The procedure 1000 provides a way to combine vector quantization with such transform window size switching for improved time resolution when coding transients.

With the encoding procedure 1000, the encoder 700 (FIG. 7) can flexibly combine use of normal quantization coding and vector quantization coding at potentially different transform window sizes. In an example implementation, the encoder chooses from the following coding and window size combinations:

1. In a first alternative combination, the normal quantization coding is applied to a portion of the spectrum (e.g., the "baseband" portion) using a wider transform window size ("window size A" 1012). Vector quantization coding also is applied to part of the spectrum (e.g., the "extension" portion) using the same wide window size A 1012. As shown in FIG. 10, a group of the audio data samples 1010 within the window size A 1012 are processed by a frequency transform 1020 appropriate to the width of window size A 1012. This produces a set of spectral coefficients 1024. The baseband portion of these spectral coefficients 1024 is coded using the baseband quantization encoder 1030, while an extension portion is encoded by a vector quantization encoder 1031. The coded baseband and extension portions are multiplexed into an encoded bit stream 1040.

2. In a second alternative combination, the normal quantization is applied to part of the spectrum (e.g., the "baseband" portion) using the window size A 1012, while the vector quantization is applied to another part of the spectrum (such as the high frequency "extension" region) with a narrower window size B 1014. In this example, the narrower window size B is half the width of the window size A. Alternatively, other ratios of wider and narrower window sizes can be used, such as 1:4, 1:8, 1:3, 2:3, etc. As shown in FIG. 10, a group of audio samples within the window size A are processed by window size A frequency transform 1020 to produce the spectral coefficients 1024. The audio samples within the narrower window size B 1014 also are transformed using a window size B frequency transform 1021 to produce spectral coefficients 1025. The baseband portion of the spectral coefficients 1024 produced by the window size A frequency transform 1020 are encoded via the baseband quantization encoder 1030. The extension region of the spectral coefficients 1025 produced by the window size B frequency transform 1021 are encoded by the vector quantization encoder 1031. The coded baseband and extension spectrum are multiplexed into the encoded bit stream 1040.

3. In a third alternative combination, the normal quantization is applied to part of the spectrum (e.g., the "baseband" region) using the window size A 1012, while the vector quantization is applied to another part of the spectrum (e.g., the "extension" region) also using the window size A. In addition, another vector quantization coding is applied to part of the spectrum with window size B 1014. As illustrated in FIG. 10, the audio sample 1010 within a window size A 1012 are processed by a window size A frequency transform 1020 to produce spectral coefficients 1024, whereas audio samples in block of window size B 1014 are processed by a window size B frequency transform 1021 to produce spectral coefficients 1025. A baseband part of the spectral coefficients 1024 from window size A are coded using the baseband quantization encoder 1030. An "extension" region of the spectrum of both spectral coefficients 1024 and 1025 are encoded via a vector quantization encoder 1031. The coded baseband and extension spectral coefficients are multiplexed into the encoded bit stream 1040. Although the illustrated example applies the normal quantization and vector quantization to separate regions of the spectrum, the parts of the spectrum encoded by each of the three quantization coding can overlap (i.e., be coincident at the same frequency location).

Figure 11:
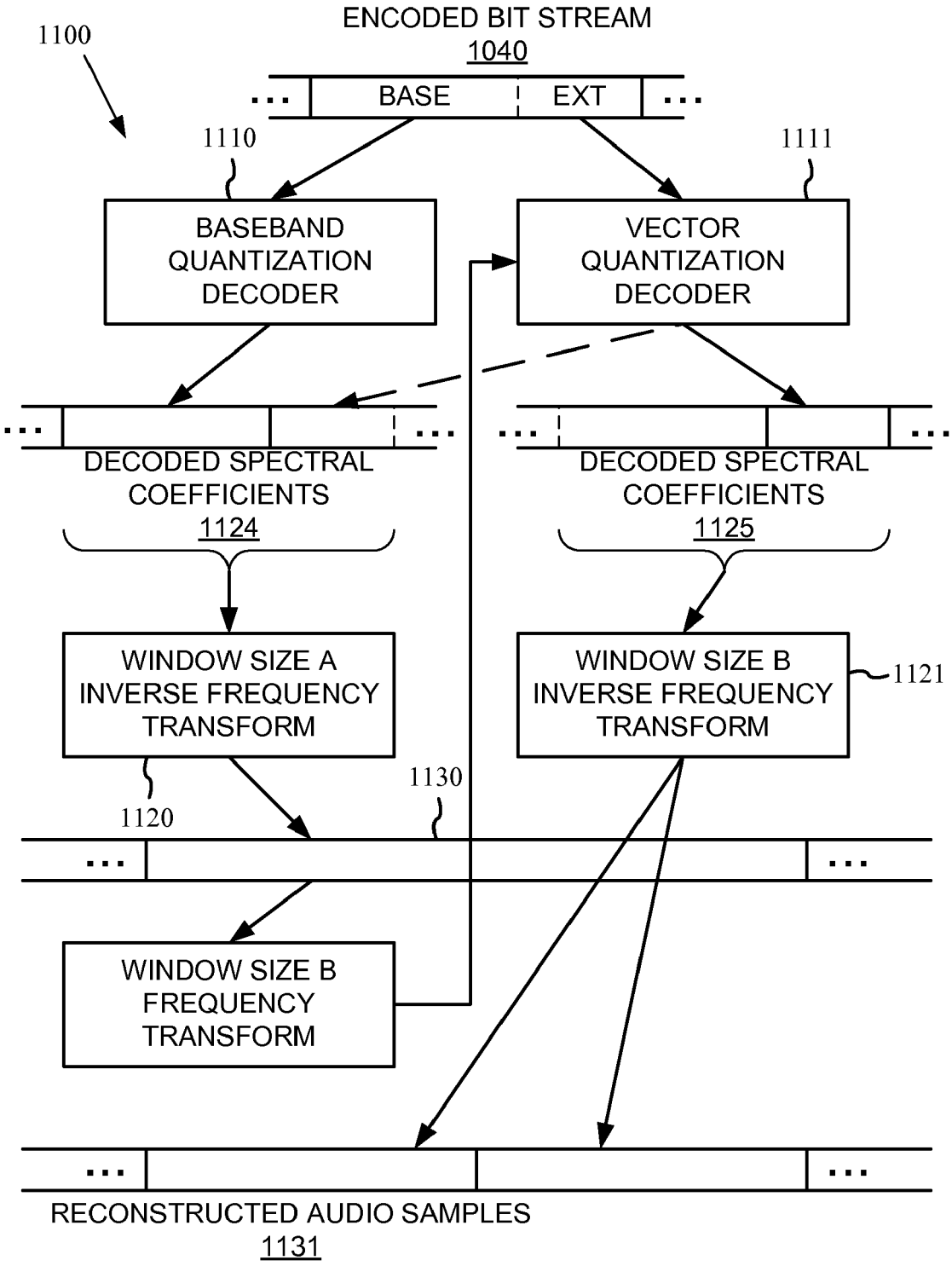
FIG. 11 is a flow diagram of a procedure for decoding using vector quantization with varying transform block ("window") sizes to adapt time resolution of transient versus tonal sounds.

With reference now to FIG. 11, a decoding procedure 1100 decodes the encoded bit stream 1040 at the decoder. The encoded baseband and extension data are separated from the encoded bit stream 1040 and decoded by the baseband quantization decoder 1110 and vector quantization decoder 1111. The baseband quantization decoder 1110 applies an inverse quantization process to the encoded baseband data to produce decoded baseband portion of the spectral coefficients 1124. The vector quantization decoder 1111 applies an inverse vector quantization process to the extension data to produce decoded extension portion for both the spectral coefficients 1124, 1125.

In the case of the first alternative combination, both the baseband and extension were encoded using the same window size A 1012. Therefore, the decoded baseband and decoded extension form the spectral coefficients 1124. An inverse frequency transform 1120 with window size A is then applied to the spectral coefficients 1124. This produces a single stream of reconstructed audio samples, such that no summing or transform to window size B transform domain of reconstructed audio sample for separate window size blocks is needed.

Otherwise, in the case of the second alternative combination, the window size A inverse frequency transform 1120 is applied to the decoded baseband coefficients 1124, while a window size B inverse frequency transform 1121 is applied to the decoded extension coefficients 1125. This produces two sets of audio samples in blocks of window size A 1130 and window size B 1131, respectively. However, the baseband region coefficients are needed for the inverse vector quantization. Accordingly, prior to the decoding and inverse transform using the window size B, the window size B forward transform 1121 is applied to the window size A blocks of reconstructed audio samples 1130 to transform into the transform domain of window size B. The resulting baseband spectral coefficients are combined by the vector quantization decoder to reconstruct the full set of spectral coefficients 1125 in the window size B transform domain. The window size B inverse frequency transform 1121 is applied to this set of spectral coefficients to form the final reconstructed audio sample stream 1131.

In the case of the third alternative combination, the vector quantization was applied to both the spectral coefficients in the extension region for the window size A and window size B transforms 1020 and 1021. Accordingly, the vector quantization decoder 1111 produces two sets of decoded extension spectral coefficients: one encoded from the window size A transform spectral coefficients and one for the window size B spectral coefficients. The window size A inverse frequency transform 1120 is applied to the decoded baseband coefficients 1124, and also applied to the decoded extension spectral coefficients for window size A to produce window size A blocks of audio samples 1130. Again, the baseband coefficients are needed for the window size B inverse vector quantization. Accordingly, the window size B frequency transform 1021 is applied to the window size A blocks of reconstructed audio samples to convert to the window size B transform domain. The window size B vector quantization decoder 1111 uses the converted baseband coefficients, and as applicable, sums the extension region spectral coefficients to produce the decoded spectral coefficients 1125. The window size B inverse frequency transform 1121 is applied to those decoded extension spectral coefficients to produce the final reconstructed audio samples 1131.

3. Example Band Partitioning

Figure 12:
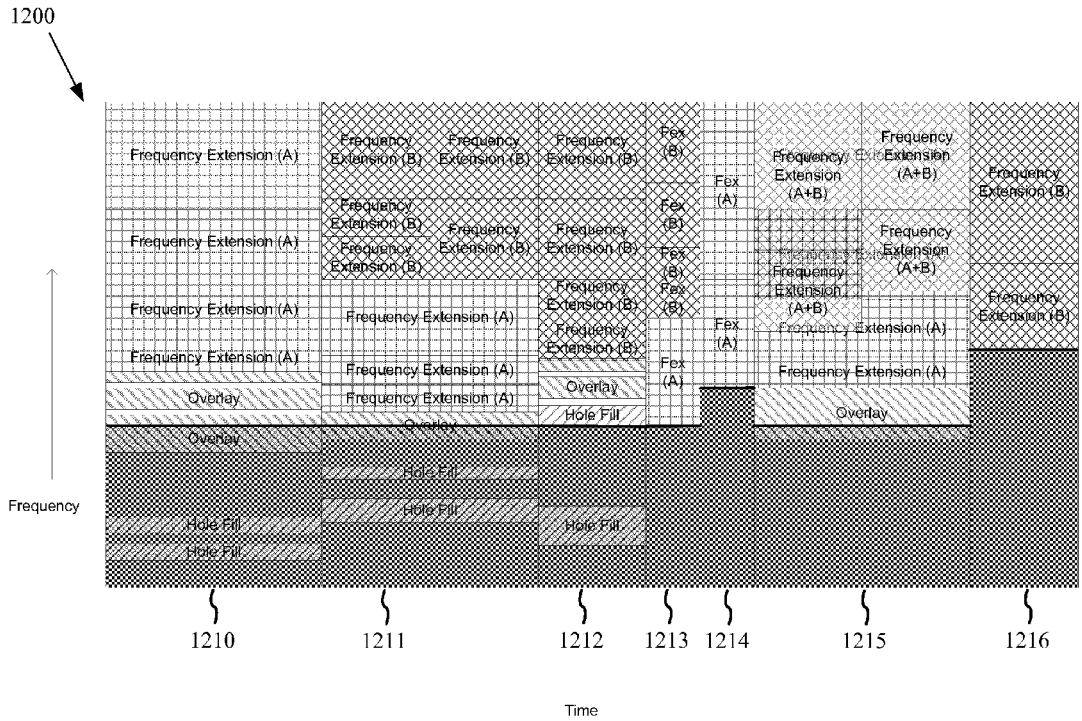
FIG. 12 is a diagram depicting coding techniques applied to various regions of an example audio stream.

FIG. 12 illustrates how various coding techniques are applied to spectral regions of an audio example. The diagram shows the coding techniques applied to spectral regions for 7 base tiles 1210-1216 in the encoded bit stream.

The first tile 1210 has two sparse spectral peaks coded beyond the base. In addition, there are spectral holes in the base. Two of these holes are filled with the hole-filling mode. Suppose the maximum number of hole-filling bands is 2. The final spectral holes in the base are filled with the overlay mode of the frequency extension. The spectral region between the base and the sparse spectral peaks is also filled with the overlay mode bands. After the last band which is used to fill the gaps between the base and sparse spectral peaks, regular frequency extension with the same transform size as the base is used to fill in the missing high frequencies.

The hole-filling is used on the second tile 1211 to fill spectral holes in the base (two of them). The remaining spectral holes are filled with the overlay band which crosses over the base into the missing high spectral frequency region. The remaining missing high frequencies are coded using frequency extension with the same transform size used to code the lower frequencies (where the tonal components happen to be), and a smaller transform size frequency extension used to code the higher frequencies (For the transients).

For the third tile 1212, the base region has one spectral hole only. Beyond the base region there are two coded sparse spectral peaks. Since there is only one spectral hole in the base, the gap between the last base coded coefficient and the first sparse spectral peak is coded using a hole-filling band. The missing coefficients between the first and second sparse spectral peak and beyond the second peak are coded using and overlay band. Beyond this, regular frequency extension using the small size frequency transform is used.

The base region of the fourth tile 1213 has no spectral peaks. Frequency extension is done in the two transform domains to fill in the missing higher frequencies.

The fifth tile 1214 is similar to the fourth tile 1213, except only the base transform domain is used.

For the sixth tile 1215, frequency extension coding in the same transform domain is used to code the lower frequencies and the tonal components in the higher frequencies. Transient components in higher frequencies are coded using a smaller size transform domain. Missing high frequency components are obtained by summing the two extensions.

The seventh tile 1216 also is similar to the fourth tile 1213, except the smaller transform domain is used.

C. Channel Extension Coding Component

The following section describes the encoding and decoding processes performed by the channel extension encoding and decoding components 735, 790 (FIG. 7) in more detail.

1. Overview of Multi-Channel Processing

This section is an overview of some multi-channel processing techniques used in some encoders and decoders, including multi-channel pre-processing techniques, flexible multi-channel transform techniques, and multi-channel post-processing techniques.

a. Multi-Channel Pre-Processing

Some encoders perform multi-channel pre-processing on input audio samples in the time domain.

In traditional encoders, when there are N source audio channels as input, the number of output channels produced by the encoder is also N. The number of coded channels may correspond one-to-one with the source channels, or the coded channels may be multi-channel transform-coded channels. When the coding complexity of the source makes compression difficult or when the encoder buffer is full, however, the encoder may alter or drop (i.e., not code) one or more of the original input audio channels or multi-channel transform-coded channels. This can be done to reduce coding complexity and improve the overall perceived quality of the audio. For quality-driven pre-processing, an encoder may perform multi-channel pre-processing in reaction to measured audio quality so as to smoothly control overall audio quality and/or channel separation.

For example, an encoder may alter a multi-channel audio image to make one or more channels less critical so that the channels are dropped at the encoder yet reconstructed at a decoder as "phantom" or uncoded channels. This helps to avoid the need for outright deletion of channels or severe quantization, which can have a dramatic effect on quality.

An encoder can indicate to the decoder what action to take when the number of coded channels is less than the number of channels for output. Then, a multi-channel post-processing transform can be used in a decoder to create phantom channels. For example, an encoder (through a bitstream) can instruct a decoder to create a phantom center by averaging decoded left and right channels. Later multi-channel transformations may exploit redundancy between averaged back left and back right channels (without post-processing), or an encoder may instruct a decoder to perform some multi-channel post-processing for back left and right channels. Or, an encoder can signal to a decoder to perform multi-channel post-processing for another purpose.

Figure 13:
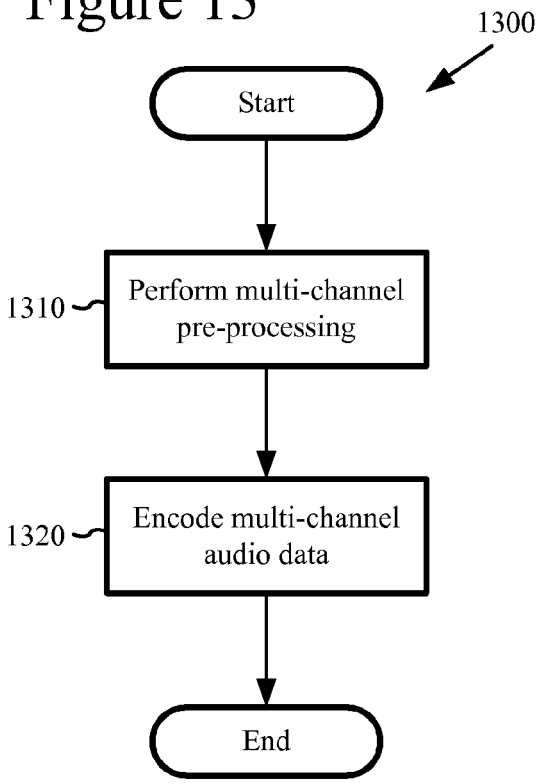
FIG. 13 is a flow chart showing a generalized technique for multi-channel pre-processing.

FIG. 13 shows a generalized technique 1300 for multi-channel pre-processing. An encoder performs (1310) multi-channel pre-processing on time-domain multi-channel audio data, producing transformed audio data in the time domain. For example, the pre-processing involves a general transform matrix with real, continuous valued elements. The general transform matrix can be chosen to artificially increase inter-channel correlation. This reduces complexity for the rest of the encoder, but at the cost of lost channel separation.

The output is then fed to the rest of the encoder, which, in addition to any other processing that the encoder may perform, encodes (1320) the data using techniques described with reference to FIG. 4 or other compression techniques, producing encoded multi-channel audio data.

A syntax used by an encoder and decoder may allow description of general or pre-defined post-processing multi-channel transform matrices, which can vary or be turned on/off on a frame-to-frame basis. An encoder can use this flexibility to limit stereo/surround image impairments, trading off channel separation for better overall quality in certain circumstances by artificially increasing inter-channel correlation. Alternatively, a decoder and encoder can use another syntax for multi-channel pre- and post-processing, for example, one that allows changes in transform matrices on a basis other than frame-to-frame.

b. Flexible Multi-Channel Transforms

Some encoders can perform flexible multi-channel transforms that effectively take advantage of inter-channel correlation. Corresponding decoders can perform corresponding inverse multi-channel transforms.

For example, an encoder can position a multi-channel transform after perceptual weighting (and the decoder can position the inverse multi-channel transform before inverse weighting) such that a cross-channel leaked signal is controlled, measurable, and has a spectrum like the original signal. An encoder can apply weighting factors to multi-channel audio in the frequency domain (e.g., both weighting factors and per-channel quantization step modifiers) before multi-channel transforms. An encoder can perform one or more multi-channel transforms on weighted audio data, and quantize multi-channel transformed audio data.

A decoder can collect samples from multiple channels at a particular frequency index into a vector and perform an inverse multi-channel transform to generate the output. Subsequently, a decoder can inverse quantize and inverse weight the multi-channel audio, coloring the output of the inverse multi-channel transform with mask(s). Thus, leakage that occurs across channels (due to quantization) can be spectrally shaped so that the leaked signal's audibility is measurable and controllable, and the leakage of other channels in a given reconstructed channel is spectrally shaped like the original uncorrupted signal of the given channel.

An encoder can group channels for multi-channel transforms to limit which channels get transformed together. For example, an encoder can determine which channels within a tile correlate and group the correlated channels. An encoder can consider pair-wise correlations between signals of channels as well as correlations between bands, or other and/or additional factors when grouping channels for multi-channel transformation. For example, an encoder can compute pair-wise correlations between signals in channels and then group channels accordingly. A channel that is not pair-wise correlated with any of the channels in a group may still be compatible with that group. For channels that are incompatible with a group, an encoder can check compatibility at band level and adjust one or more groups of channels accordingly. An encoder can identify channels that are compatible with a group in some bands, but incompatible in some other bands. Turning off a transform at incompatible bands can improve correlation among bands that actually get multi-channel transform coded and improve coding efficiency. Channels in a channel group need not be contiguous. A single tile may include multiple channel groups, and each channel group may have a different associated multi-channel transform. After deciding which channels are compatible, an encoder can put channel group information into a bitstream. A decoder can then retrieve and process the information from the bitstream.

An encoder can selectively turn multi-channel transforms on or off at the frequency band level to control which bands are transformed together. In this way, an encoder can selectively exclude bands that are not compatible in multi-channel transforms. When a multi-channel transform is turned off for a particular band, an encoder can use the identity transform for that band, passing through the data at that band without altering it. The number of frequency bands relates to the sampling frequency of the audio data and the tile size. In general, the higher the sampling frequency or larger the tile size, the greater the number of frequency bands. An encoder can selectively turn multi-channel transforms on or off at the frequency band level for channels of a channel group of a tile. A decoder can retrieve band on/off information for a multi-channel transform for a channel group of a tile from a bitstream according to a particular bitstream syntax.

An encoder can use hierarchical multi-channel transforms to limit computational complexity, especially in the decoder. With a hierarchical transform, an encoder can split an overall transformation into multiple stages, reducing the computational complexity of individual stages and in some cases reducing the amount of information needed to specify multi-channel transforms. Using this cascaded structure, an encoder can emulate the larger overall transform with smaller transforms, up to some accuracy. A decoder can then perform a corresponding hierarchical inverse transform. An encoder may combine frequency band on/off information for the multiple multi-channel transforms. A decoder can retrieve information for a hierarchy of multi-channel transforms for channel groups from a bitstream according to a particular bitstream syntax.

An encoder can use pre-defined multi-channel transform matrices to reduce the bitrate used to specify transform matrices. An encoder can select from among multiple available pre-defined matrix types and signal the selected matrix in the bitstream. Some types of matrices may require no additional signaling in the bitstream. Others may require additional specification. A decoder can retrieve the information indicating the matrix type and (if necessary) the additional information specifying the matrix.

An encoder can compute and apply quantization matrices for channels of tiles, per-channel quantization step modifiers, and overall quantization tile factors. This allows an encoder to shape noise according to an auditory model, balance noise between channels, and control overall distortion. A corresponding decoder can decode apply overall quantization tile factors, per-channel quantization step modifiers, and quantization matrices for channels of tiles, and can combine inverse quantization and inverse weighting steps c. Multi-Channel Post-Processing Some decoders perform multi-channel post-processing on reconstructed audio samples in the time domain.

For example, the number of decoded channels may be less than the number of channels for output (e.g., because the encoder did not code one or more input channels). If so, a multi-channel post-processing transform can be used to create one or more "phantom" channels based on actual data in the decoded channels. If the number of decoded channels equals the number of output channels, the post-processing transform can be used for arbitrary spatial rotation of the presentation, remapping of output channels between speaker positions, or other spatial or special effects. If the number of decoded channels is greater than the number of output channels (e.g., playing surround sound audio on stereo equipment), a post-processing transform can be used to "fold-down" channels. Transform matrices for these scenarios and applications can be provided or signaled by the encoder.

Figure 14:
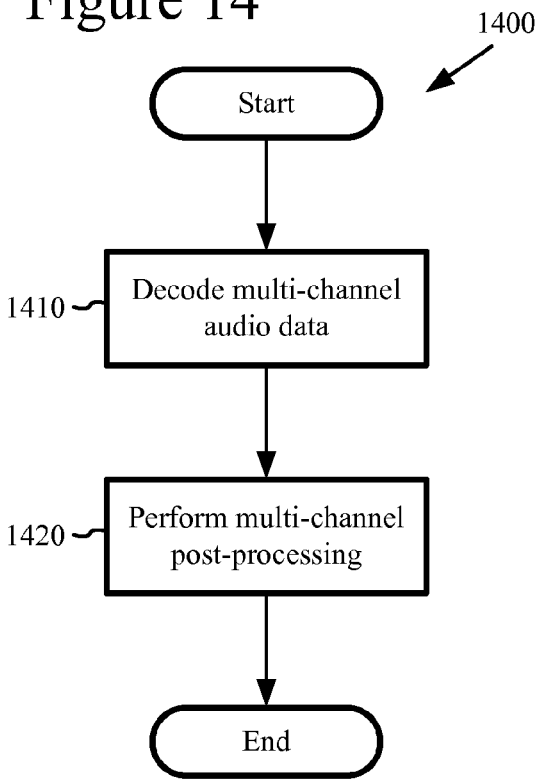
FIG. 14 is a flow chart showing a generalized technique for multi-channel post-processing.

FIG. 14 shows a generalized technique 1400 for multi-channel post-processing The decoder decodes (1410) encoded multi-channel audio data, producing reconstructed time-domain multi-channel audio data.

The decoder then performs (1420) multi-channel post-processing on the time-domain multi-channel audio data. When the encoder produces a number of coded channels and the decoder outputs a larger number of channels, the post-processing involves a general transform to produce the larger number of output channels from the smaller number of coded channels. For example, the decoder takes co-located (in time) samples, one from each of the reconstructed coded channels, then pads any channels that are missing (i.e., the channels dropped by the encoder) with zeros. The decoder multiplies the samples with a general post-processing transform matrix.

The general post-processing transform matrix can be a matrix with pre-determined elements, or it can be a general matrix with elements specified by the encoder. The encoder signals the decoder to use a pre-determined matrix (e.g., with one or more flag bits) or sends the elements of a general matrix to the decoder, or the decoder may be configured to always use the same general post-processing transform matrix. For additional flexibility, the multi-channel post-processing can be turned on/off on a frame-by-frame or other basis (in which case, the decoder may use an identity matrix to leave channels unaltered).

2. Channel Extension Processing for Multi-Channel Audio

In a typical coding scheme for coding a multi-channel source, a time-to-frequency transformation using a transform such as a modulated lapped transform ("MLT") or discrete cosine transform ("DCT") is performed at an encoder, with a corresponding inverse transform at the decoder. MLT or DCT coefficients for some of the channels are grouped together into a channel group and a linear transform is applied across the channels to obtain the channels that are to be coded. If the left and right channels of a stereo source are correlated, they can be coded using a sum-difference transform (also called M/S or mid/side coding). This removes correlation between the two channels, resulting in fewer bits needed to code them. However, at low bitrates, the difference channel may not be coded (resulting in loss of stereo image), or quality may suffer from heavy quantization of both channels.

Instead of coding sum and difference channels for channel groups (e.g., left/right pairs, front left/front right pairs, back left/back right pairs, or other groups), a desirable alternative to these typical joint coding schemes (e.g., mid/side coding, intensity stereo coding, etc.) is to code one or more combined channels (which may be sums of channels, a principal major component after applying a de-correlating transform, or some other combined channel) along with additional parameters to describe the cross-channel correlation and power of the respective physical channels and allow reconstruction of the physical channels that maintains the cross-channel correlation and power of the respective physical channels. In other words, second order statistics of the physical channels are maintained. Such processing can be referred to as channel extension processing.

For example, using complex transforms allows channel reconstruction that maintains cross-channel correlation and power of the respective channels. For a narrowband signal approximation, maintaining second-order statistics is sufficient to provide a reconstruction that maintains the power and phase of individual channels, without sending explicit correlation coefficient information or phase information.

The channel extension processing represents uncoded channels as modified versions of coded channels. Channels to be coded can be actual, physical channels or transformed versions of physical channels (using, for example, a linear transform applied to each sample). For example, the channel extension processing allows reconstruction of plural physical channels using one coded channel and plural parameters. In one implementation, the parameters include ratios of power (also referred to as intensity or energy) between two physical channels and a coded channel on a per-band basis. For example, to code a signal having left (L) and right (R) stereo channels, the power ratios are L/M and R/M, where M is the power of the coded channel (the "sum" or "mono" channel), L is the power of left channel, and R is the power of the right channel. Although channel extension coding can be used for all frequency ranges, this is not required. For example, for lower frequencies an encoder can code both channels of a channel transform (e.g., using sum and difference), while for higher frequencies an encoder can code the sum channel and plural parameters.

The channel extension processing can significantly reduce the bitrate needed to code a multi-channel source. The parameters for modifying the channels take up a small portion of the total bitrate, leaving more bitrate for coding combined channels. For example, for a two channel source, if coding the parameters takes 10% of the available bitrate, 90% of the bits can be used to code the combined channel. In many cases, this is a significant savings over coding both channels, even after accounting for cross-channel dependencies.

Channels can be reconstructed at a reconstructed channel/coded channel ratio other than the 2:1 ratio described above. For example, a decoder can reconstruct left and right channels and a center channel from a single coded channel. Other arrangements also are possible. Further, the parameters can be defined different ways. For example, the parameters may be defined on some basis other than a per-band basis.

a. Complex Transforms and Scale/Shape Parameters

In one prior approach to channel extension processing, an encoder forms a combined channel and provides parameters to a decoder for reconstruction of the channels that were used to form the combined channel. A decoder derives complex spectral coefficients (each having a real component and an imaginary component) for the combined channel using a forward complex time-frequency transform. Then, to reconstruct physical channels from the combined channel, the decoder scales the complex coefficients using the parameters provided by the encoder. For example, the decoder derives scale factors from the parameters provided by the encoder and uses them to scale the complex coefficients. The combined channel is often a sum channel (sometimes referred to as a mono channel) but also may be another combination of physical channels. The combined channel may be a difference channel (e.g., the difference between left and right channels) in cases where physical channels are out of phase and summing the channels would cause them to cancel each other out.

For example, the encoder sends a sum channel for left and right physical channels and plural parameters to a decoder which may include one or more complex parameters. (Complex parameters are derived in some way from one or more complex numbers, although a complex parameter sent by an encoder (e.g., a ratio that involves an imaginary number and a real number) may not itself be a complex number.) The encoder also may send only real parameters from which the decoder can derive complex scale factors for scaling spectral coefficients. (The encoder typically does not use a complex transform to encode the combined channel itself. Instead, the encoder can use any of several encoding techniques to encode the combined channel.)

Figure 15:
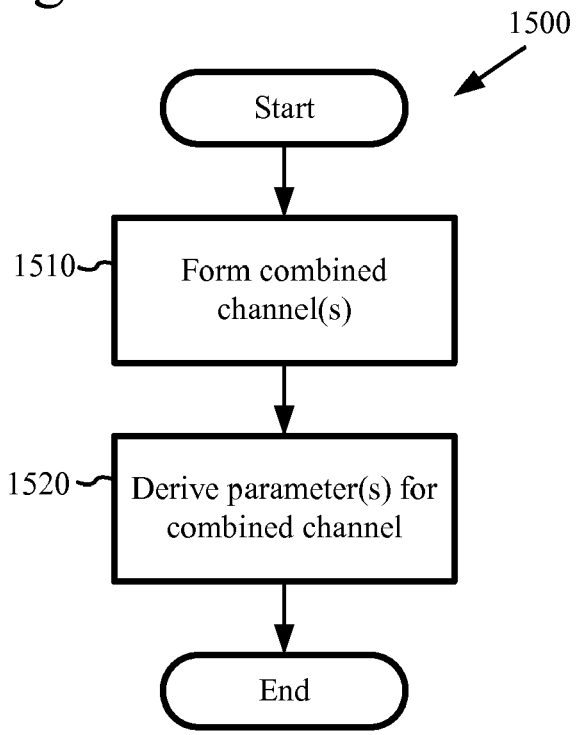
FIG. 15 is a flow chart showing a technique for deriving complex scale factors for combined channels in channel extension encoding.
Figure 16:
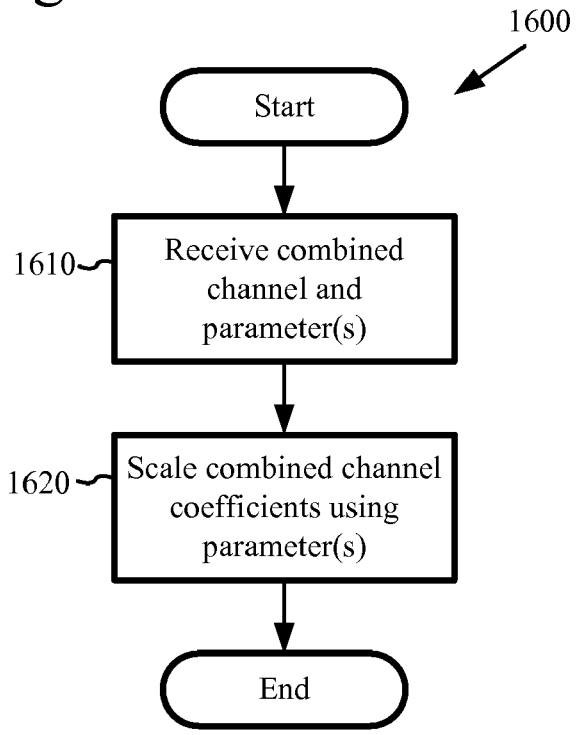
FIG. 16 is a flow chart showing a technique for using complex scale factors in channel extension decoding.

FIG. 15 shows a simplified channel extension coding technique 1500 performed by an encoder. At 1510, the encoder forms one or more combined channels (e.g., sum channels). Then, at 1520, the encoder derives one or more parameters to be sent along with the combined channel to a decoder. FIG. 16 shows a simplified inverse channel extension decoding technique 1600 performed by a decoder. At 1610, the decoder receives one or more parameters for one or more combined channels. Then, at 1620, the decoder scales combined channel coefficients using the parameters. For example, the decoder derives complex scale factors from the parameters and uses the scale factors to scale the coefficients.

After a time-to-frequency transform at an encoder, the spectrum of each channel is usually divided into sub-bands. In the channel extension coding technique, an encoder can determine different parameters for different frequency sub-bands, and a decoder can scale coefficients in a band of the combined channel for the respective band in the reconstructed channel using one or more parameters provided by the encoder. In a coding arrangement where left and right channels are to be reconstructed from one coded channel, each coefficient in the sub-band for each of the left and right channels is represented by a scaled version of a sub-band in the coded channel.

Figure 17:
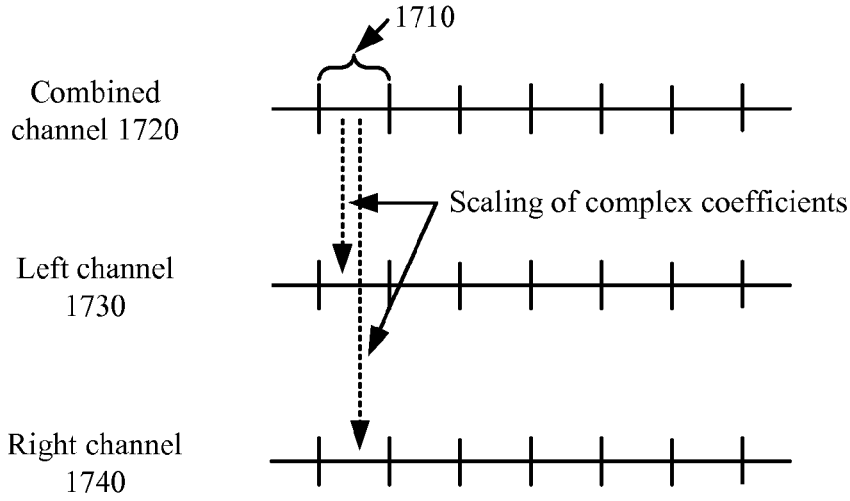
FIG. 17 is a diagram showing scaling of combined channel coefficients in channel reconstruction.

For example, FIG. 17 shows scaling of coefficients in a band 1710 of a combined channel 1720 during channel reconstruction. The decoder uses one or more parameters provided by the encoder to derive scaled coefficients in corresponding sub-bands for the left channel 1730 and the right channel 1740 being reconstructed by the decoder.

In one implementation, each sub-band in each of the left and right channels has a scale parameter and a shape parameter. The shape parameter may be determined by the encoder and sent to the decoder, or the shape parameter may be assumed by taking spectral coefficients in the same location as those being coded. The encoder represents all the frequencies in one channel using scaled version of the spectrum from one or more of the coded channels. A complex transform (having a real number component and an imaginary number component) is used, so that cross-channel second-order statistics of the channels can be maintained for each sub-band. Because coded channels are a linear transform of actual channels, parameters do not need to be sent for all channels. For example, if P channels are coded using N channels (where $N<P$), then parameters do not need to be sent for all P channels. More information on scale and shape parameters is provided below in Section III.C.4.

The parameters may change over time as the power ratios between the physical channels and the combined channel change. Accordingly, the parameters for the frequency bands in a frame may be determined on a frame by frame basis or some other basis. The parameters for a current band in a current frame are differentially coded based on parameters from other frequency bands and/or other frames in described embodiments.

The decoder performs a forward complex transform to derive the complex spectral coefficients of the combined channel. It then uses the parameters sent in the bitstream (such as power ratios and an imaginary-to-real ratio for the cross-correlation or a normalized correlation matrix) to scale the spectral coefficients. The output of the complex scaling is sent to the post processing filter. The output of this filter is scaled and added to reconstruct the physical channels.

Channel extension coding need not be performed for all frequency bands or for all time blocks. For example, channel extension coding can be adaptively switched on or off on a per band basis, a per block basis, or some other basis. In this way, an encoder can choose to perform this processing when it is efficient or otherwise beneficial to do so. The remaining bands or blocks can be processed by traditional channel decorrelation, without decorrelation, or using other methods.

The achievable complex scale factors in described embodiments are limited to values within certain bounds. For example, described embodiments encode parameters in the log domain, and the values are bound by the amount of possible cross-correlation between channels.

The channels that can be reconstructed from the combined channel using complex transforms are not limited to left and right channel pairs, nor are combined channels limited to combinations of left and right channels. For example, combined channels may represent two, three or more physical channels. The channels reconstructed from combined channels may be groups such as back-left/back-right, back-left/left, back-right/right, left/center, right/center, and left/center/right. Other groups also are possible. The reconstructed channels may all be reconstructed using complex transforms, or some channels may be reconstructed using complex transforms while others are not.

b. Interpolation of Parameters

An encoder can choose anchor points at which to determine explicit parameters and interpolate parameters between the anchor points. The amount of time between anchor points and the number of anchor points may be fixed or vary depending on content and/or encoder-side decisions. When an anchor point is selected at time t, the encoder can use that anchor point for all frequency bands in the spectrum. Alternatively, the encoder can select anchor points at different times for different frequency bands.

Figure 18:
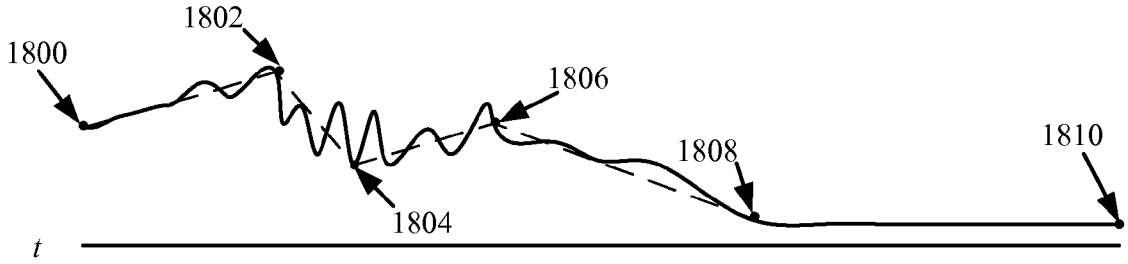
FIG. 18 is a chart showing a graphical comparison of actual power ratios and power ratios interpolated from power ratios at anchor points.

FIG. 18 is a graphical comparison of actual power ratios and power ratios interpolated from power ratios at anchor points. In the example shown in FIG. 18, interpolation smoothes variations in power ratios (e.g., between anchor points 1800 and 1802, 1802 and 1804, 1804 and 1806, and 1806 and 1808) which can help to avoid artifacts from frequently-changing power ratios. The encoder can turn interpolation on or off or not interpolate the parameters at all. For example, the encoder can choose to interpolate parameters when changes in the power ratios are gradual over time, or turn off interpolation when parameters are not changing very much from frame to frame (e.g., between anchor points 1808 and 1810 in FIG. 18), or when parameters are changing so rapidly that interpolation would provide inaccurate representation of the parameters.

c. Detailed Explanation

A general linear channel transform can be written as Y=AX, where X is a set of L vectors of coefficients from P channels (a P×L dimensional matrix), A is a P×P channel transform matrix, and Y is the set of L transformed vectors from the P channels that are to be coded (a P×L dimensional matrix). L (the vector dimension) is the band size for a given subframe on which the linear channel transform algorithm operates. If an encoder codes a subset N of the P channels in Y, this can be expressed as Z=BX, where the vector Z is an N×L matrix, and B is a N×P matrix formed by taking N rows of matrix Y corresponding to the N channels which are to be coded. Reconstruction from the N channels involves another matrix multiplication with a matrix C after coding the vector Z to obtain W=CQ(Z), where Q represents quantization of the vector Z. Substituting for Z gives the equation W=CQ(BX). Assuming quantization noise is negligible, W=CBX. C can be appropriately chosen to maintain cross-channel second-order statistics between the vector X and W. In equation form, this can be represented as WW*=CBXX*B*C*=XX*, where XX* is a symmetric P×P matrix.

Since XX* is a symmetric P×P matrix, there are P(P+1)/2 degrees of freedom in the matrix. If N>=(P+1)/2, then it may be possible to come up with a P×N matrix C such that the equation is satisfied. If N<(P+1)/2, then more information is needed to solve this. If that is the case, complex transforms can be used to come up with other solutions which satisfy some portion of the constraint.

For example, if X is a complex vector and C is a complex matrix, we can try to find C such that Re(CBXX*B*C*)=Re(XX*). According to this equation, for an appropriate complex matrix C the real portion of the symmetric matrix XX* is equal to the real portion of the symmetric matrix product CBXX*B*C.

Example 1

For the case where M=2 and N=1, then, BXX*B* is simply a real scalar (L×1) matrix, referred to as $\alpha$. We solve for the equations shown in FIG. 13. If $B_0=B_1=\beta$ (which is some constant) then the constraint in FIG. 14 holds. Solving, we get the values shown in FIG. 15 for $|C_0|$, $|C_1|$ and $|C_0||C_1|\cos(\phi_0-\phi_1)$. The encoder sends $|C_0|$ and $|C_1|$. Then we can solve using the constraint shown in FIG. 16. It should be clear from FIG. 15 that these quantities are essentially the power ratios L/M and R/M. The sign in the constraint shown in FIG. 16 can be used to control the sign of the phase so that it matches the imaginary portion of XX*. This allows solving for $\phi_0-\phi_1$, but not for the actual values. In order for to solve for the exact values, another assumption is made that the angle of the mono channel for each coefficient is maintained, as expressed in FIG. 17. To maintain this, it is sufficient that $|C_0|\sin\phi_0+|C_1|\sin\phi_1=0$, which gives the results for $\phi_0$ and $\phi_1$ shown in FIG. 18.

Using the constraint shown in FIG. 16, we can solve for the real and imaginary portions of the two scale factors. For example, the real portion of the two scale factors can be found by solving for $|C_0|\cos\phi_0$ and $|C_1|\cos\phi_1$, respectively, as shown in FIG. 25. The imaginary portion of the two scale factors can be found by solving for $|C_0|\sin\phi_0$ and $|C_1|\sin\phi_1$, respectively, as shown in FIG. 26.

Thus, when the encoder sends the magnitude of the complex scale factors, the decoder is able to reconstruct two individual channels which maintain cross-channel second order characteristics of the original, physical channels, and the two reconstructed channels maintain the proper phase of the coded channel.

Example 2

In Example 1, although the imaginary portion of the cross-channel second-order statistics is solved for (as shown in FIG. 26), only the real portion is maintained at the decoder, which is only reconstructing from a single mono source. However, the imaginary portion of the cross-channel second-order statistics also can be maintained if (in addition to the complex scaling) the output from the previous stage as described in Example 1 is post-processed to achieve an additional spatialization effect. The output is filtered through a linear filter, scaled, and added back to the output from the previous stage.

Suppose that in addition to the current signal from the previous analysis ($W_0$ and $W_1$ for the two channels, respectively), the decoder has the effect signal—a processed version of both the channels available ($W_{0F}$ and $W_{1F}$, respectively), as shown in FIG. 27. Then the overall transform can be represented as shown in FIG. 29, which assumes that $W_{0F}=C_0Z_{0F}$ and $W_{1F}=C_1Z_{0F}$. We show that by following the reconstruction procedure shown in FIG. 28 the decoder can maintain the second-order statistics of the original signal. The decoder takes a linear combination of the original and filtered versions of W to create a signal S which maintains the second-order statistics of X.

In Example 1, it was determined that the complex constants $C_0$ and $C_1$ can be chosen to match the real portion of the cross-channel second-order statistics by sending two parameters (e.g., left-to-mono (L/M) and right-to-mono (R/M) power ratios). If another parameter is sent by the encoder, then the entire cross-channel second-order statistics of a multi-channel source can be maintained.

For example, the encoder can send an additional, complex parameter that represents the imaginary-to-real ratio of the cross-correlation between the two channels to maintain the entire cross-channel second-order statistics of a two-channel source. Suppose that the correlation matrix is given by $R_{XX}$, as defined in FIG. 30, where U is an orthonormal matrix of complex Eigenvectors, and $\Lambda$ is a diagonal matrix of Eigenvalues. Note that this factorization must exist for any symmetric matrix. For any achievable power correlation matrix, the Eigenvalues must also be real. This factorization allows us to find a complex Karhunen-Loeve Transform ("KLT"). A KLT has been used to create de-correlated sources for compression. Here, we wish to do the reverse operation which is take uncorrelated sources and create a desired correlation. The KLT of vector X is given by U*, since $U^*U\Lambda U^*U=\Lambda$, a diagonal matrix. The power in Z is $\alpha$. Therefore if we choose a transform such as $$U\left(\frac{\Lambda}{\alpha}\right)^{1/2}=\begin{bmatrix} aC_0 & bC_0 \\ cC_1 & dC_1 \end{bmatrix},$$

and assume $W_{0F}$ and $W_{1F}$ have the same power as and are uncorrelated to $W_0$ and $W_1$ respectively, the reconstruction procedure in FIG. 23 or 22 produces the desired correlation matrix for the final output. In practice, the encoder sends power ratios $|C_0|$ and $|C_1|$, and the imaginary-to-real ratio $\mathrm{Im}(X_0X_1^*)/\alpha$. The decoder can reconstruct a normalized version of the cross correlation matrix (as shown in FIG. 31). The decoder can then calculate $\theta$ and find Eigenvalues and Eigenvectors, arriving at the desired transform.

Due to the relationship between $|C_0|$ and $|C_1|$, they cannot possess independent values. Hence, the encoder quantizes them jointly or conditionally. This applies to both Examples 1 and 2.

Other parameterizations are also possible, such as by sending from the encoder to the decoder a normalized version of the power matrix directly where we can normalize by the geometric mean of the powers, as shown in FIG. 32. Now the encoder can send just the first row of the matrix, which is sufficient since the product of the diagonals is 1. However, now the decoder scales the Eigenvalues as shown in FIG. 33.

Another parameterization is possible to represent U and Λ directly. It can be shown that U can be factorized into a series of Givens rotations. Each Givens rotation can be represented by an angle. The encoder transmits the Givens rotation angles and the Eigenvalues.

Also, both parameterizations can incorporate any additional arbitrary pre-rotation V and still produce the same correlation matrix since $VV^*=I$, where I stands for the identity matrix. That is, the relationship shown in FIG. 34 will work for any arbitrary rotation V. For example, the decoder chooses a pre-rotation such that the amount of filtered signal going into each channel is the same, as represented in FIG. 35. The decoder can choose ω such that the relationships in FIG. 36 hold.

Once the matrix shown in FIG. 37 is known, the decoder can do the reconstruction as before to obtain the channels $W_0$ and $W_1$. Then the decoder obtains $W_{0F}$ and $W_{1F}$ (the effect signals) by applying a linear filter to $W_0$ and $W_1$. For example, the decoder uses an all-pass filter and can take the output at any of the taps of the filter to obtain the effect signals. (For more information on uses of all-pass filters, see M. R. Schroeder and B. F. Logan, "Colorless' Artificial Reverberation," 12*th Ann. Meeting of the Audio Eng'g Soc.,* 18 pp. (1960).) The strength of the signal that is added as a post process is given in the matrix shown in FIG. 37.

The all-pass filter can be represented as a cascade of other all-pass filters. Depending on the amount of reverberation needed to accurately model the source, the output from any of the all-pass filters can be taken. This parameter can also be sent on either a band, subframe, or source basis. For example, the output of the first, second, or third stage in the all-pass filter cascade can be taken.

By taking the output of the filter, scaling it and adding it back to the original reconstruction, the decoder is able to maintain the cross-channel second-order statistics. Although the analysis makes certain assumptions on the power and the correlation structure on the effect signal, such assumptions are not always perfectly met in practice. Further processing and better approximation can be used to refine these assumptions. For example, if the filtered signals have a power which is larger than desired, the filtered signal can be scaled as shown in FIG. 38 so that it has the correct power. This ensures that the power is correctly maintained if the power is too large. A calculation for determining whether the power exceeds the threshold is shown in FIG. 39.

There can sometimes be cases when the signal in the two physical channels being combined is out of phase, and thus if sum coding is being used, the matrix will be singular. In such cases, the maximum norm of the matrix can be limited. This parameter (a threshold) to limit the maximum scaling of the matrix can also be sent in the bitstream on a band, subframe, or source basis.

As in Example 1, the analysis in this Example assumes that $B_0=B_1=\beta$. However, the same algebra principles can be used for any transform to obtain similar results.

3. Channel Extension Coding with Other Coding Transforms

The channel extension coding techniques and tools described in Section III.C.2 above can be used in combination with other techniques and tools. For example, an encoder can use base coding transforms, frequency extension coding transforms (e.g., extended-band perceptual similarity coding transforms) and channel extension coding transforms. (Frequency extension coding is described in Section III.C.3.a., below.) In the encoder, these transforms can be performed in a base coding module, a frequency extension coding module separate from the base coding module, and a channel extension coding module separate from the base coding module and frequency extension coding module. Or, different transforms can be performed in various combinations within the same module.

a. Overview of Frequency Extension Coding

This section is an overview of frequency extension coding techniques and tools used in some encoders and decoders to code higher-frequency spectral data as a function of baseband data in the spectrum (sometimes referred to as extended-band perceptual similarity frequency extension coding, or wide-sense perceptual similarity coding).

Coding spectral coefficients for transmission in an output bitstream to a decoder can consume a relatively large portion of the available bitrate. Therefore, at low bitrates, an encoder can choose to code a reduced number of coefficients by coding a baseband within the bandwidth of the spectral coefficients and representing coefficients outside the baseband as scaled and shaped versions of the baseband coefficients.

Figure 40:
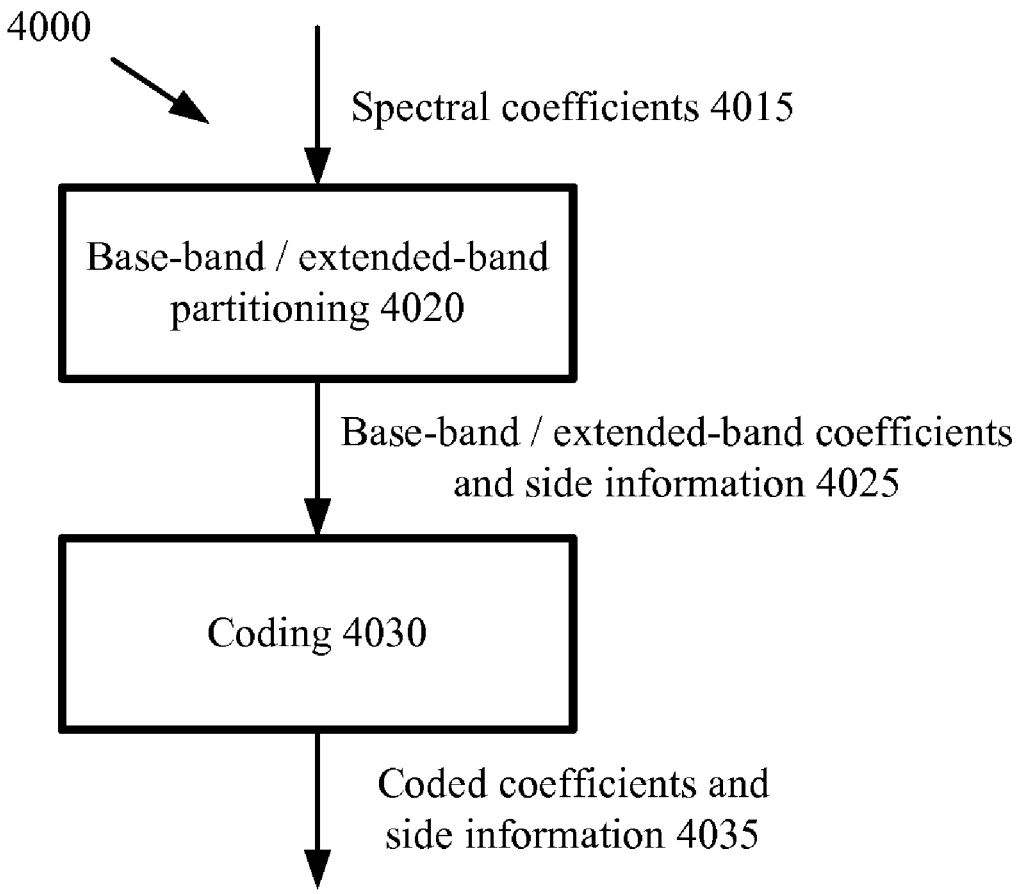
FIG. 40 is a block diagram of aspects of an encoder that performs frequency extension coding.

FIG. 40 illustrates a generalized module 4000 that can be used in an encoder. The illustrated module 4000 receives a set of spectral coefficients 4015. Therefore, at low bitrates, an encoder can choose to code a reduced number of coefficients: a baseband within the bandwidth of the spectral coefficients 4015, typically at the lower end of the spectrum. The spectral coefficients outside the baseband are referred to as "extended-band" spectral coefficients. Partitioning of the baseband and extended band is performed in the baseband/extended-band partitioning section 4020. Sub-band partitioning also can be performed (e.g., for extended-band sub-bands) in this section.

To avoid distortion (e.g., a muffled or low-pass sound) in the reconstructed audio, the extended-band spectral coefficients are represented as shaped noise, shaped versions of other frequency components, or a combination of the two. Extended-band spectral coefficients can be divided into a number of sub-bands (e.g., of 64 or 128 coefficients) which can be disjoint or overlapping. Even though the actual spectrum may be somewhat different, this extended-band coding provides a perceptual effect that is similar to the original.

The baseband/extended-band partitioning section 4020 outputs baseband spectral coefficients 4025, extended-band spectral coefficients, and side information (which can be compressed) describing, for example, baseband width and the individual sizes and number of extended-band sub-bands.

In the example shown in FIG. 40, the encoder codes coefficients and side information (4035) in coding module 4030. An encoder may include separate entropy coders for baseband and extended-band spectral coefficients and/or use different entropy coding techniques to code the different categories of coefficients. A corresponding decoder will typically use complementary decoding techniques. (To show another possible implementation, FIG. 36 shows separate decoding modules for baseband and extended-band coefficients.)

An extended-band coder can encode the sub-band using two parameters. One parameter (referred to as a scale parameter) is used to represent the total energy in the band. The other parameter (referred to as a shape parameter) is used to represent the shape of the spectrum within the band.

Figure 41:
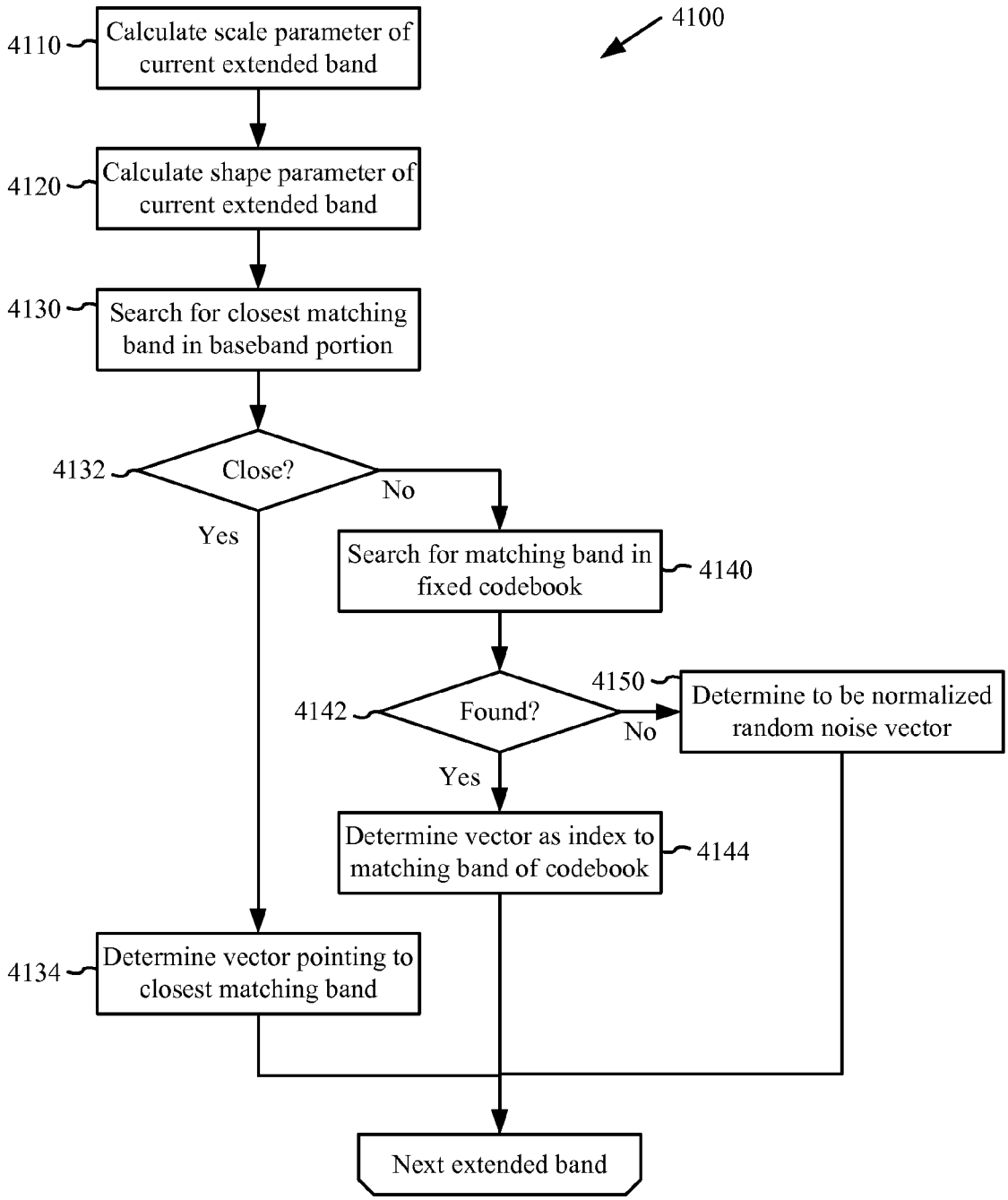
FIG. 41 is a flow chart showing an example technique for encoding extended-band sub-bands.

FIG. 41 shows an example technique 4100 for encoding each sub-band of the extended band in an extended-band coder. The extended-band coder calculates the scale parameter at 4110 and the shape parameter at 4120. Each sub-band coded by the extended-band coder can be represented as a product of a scale parameter and a shape parameter.

For example, the scale parameter can be the root-mean-square value of the coefficients within the current sub-band. This is found by taking the square root of the average squared value of all coefficients. The average squared value is found by taking the sum of the squared value of all the coefficients in the sub-band, and dividing by the number of coefficients.

The shape parameter can be a displacement vector that specifies a normalized version of a portion of the spectrum that has already been coded (e.g., a portion of baseband spectral coefficients coded with a baseband coder), a normalized random noise vector, or a vector for a spectral shape from a fixed codebook. A displacement vector that specifies another portion of the spectrum is useful in audio since there are typically harmonic components in tonal signals which repeat throughout the spectrum. The use of noise or some other fixed codebook can facilitate low bitrate coding of components which are not well-represented in a baseband-coded portion of the spectrum.

Some encoders allow modification of vectors to better represent spectral data. Some possible modifications include a linear or non-linear transform of the vector, or representing the vector as a combination of two or more other original or modified vectors. In the case of a combination of vectors, the modification can involve taking one or more portions of one vector and combining it with one or more portions of other vectors. When using vector modification, bits are sent to inform a decoder as to how to form a new vector. Despite the additional bits, the modification consumes fewer bits to represent spectral data than actual waveform coding.

The extended-band coder need not code a separate scale factor per sub-band of the extended band. Instead, the extended-band coder can represent the scale parameter for the sub-bands as a function of frequency, such as by coding a set of coefficients of a polynomial function that yields the scale parameters of the extended sub-bands as a function of their frequency. Further, the extended-band coder can code additional values characterizing the shape for an extended sub-band. For example, the extended-band coder can encode values to specify shifting or stretching of the portion of the baseband indicated by the motion vector. In such a case, the shape parameter is coded as a set of values (e.g., specifying position, shift, and/or stretch) to better represent the shape of the extended sub-band with respect to a vector from the coded baseband, fixed codebook, or random noise vector.

The scale and shape parameters that code each sub-band of the extended band both can be vectors. For example, the extended sub-bands can be represented as a vector product scale(f)·shape(f) in the time domain of a filter with frequency response scale(f) and an excitation with frequency response shape(f). This coding can be in the form of a linear predictive coding (LPC) filter and an excitation. The LPC filter is a low-order representation of the scale and shape of the extended sub-band, and the excitation represents pitch and/or noise characteristics of the extended sub-band. The excitation can come from analyzing the baseband-coded portion of the spectrum and identifying a portion of the baseband-coded spectrum, a fixed codebook spectrum or random noise that matches the excitation being coded. This represents the extended sub-band as a portion of the baseband-coded spectrum, but the matching is done in the time domain.

Referring again to FIG. 41, at 4130 the extended-band coder searches baseband spectral coefficients for a like band out of the baseband spectral coefficients having a similar shape as the current sub-band of the extended band (e.g., using a least-mean-square comparison to a normalized version of each portion of the baseband). At 4132, the extended-band coder checks whether this similar band out of the baseband spectral coefficients is sufficiently close in shape to the current extended band (e.g., the least-mean-square value is lower than a pre-selected threshold). If so, the extended-band coder determines a vector pointing to this similar band of baseband spectral coefficients at 4134. The vector can be the starting coefficient position in the baseband. Other methods (such as checking tonality vs. non-tonality) also can be used to see if the similar band of baseband spectral coefficients is sufficiently close in shape to the current extended band.

If no sufficiently similar portion of the baseband is found, the extended-band coder then looks to a fixed codebook (4140) of spectral shapes to represent the current sub-band. If found (4142), the extended-band coder uses its index in the code book as the shape parameter at 4144. Otherwise, at 4150, the extended-band coder represents the shape of the current sub-band as a normalized random noise vector.

Alternatively, the extended-band coder can decide how spectral coefficients can be represented with some other decision process.

The extended-band coder can compress scale and shape parameters (e.g., using predictive coding, quantization and/or entropy coding). For example, the scale parameter can be predictively coded based on a preceding extended sub-band. For multi-channel audio, scaling parameters for sub-bands can be predicted from a preceding sub-band in the channel. Scale parameters also can be predicted across channels, from more than one other sub-band, from the baseband spectrum, or from previous audio input blocks, among other variations. The prediction choice can be made by looking at which previous band (e.g., within the same extended band, channel or tile (input block)) provides higher correlations. The extended-band coder can quantize scale parameters using uniform or non-uniform quantization, and the resulting quantized value can be entropy coded. The extended-band coder also can use predictive coding (e.g., from a preceding sub-band), quantization, and entropy coding for shape parameters.

If sub-band sizes are variable for a given implementation, this provides the opportunity to size sub-bands to improve coding efficiency. Often, sub-bands which have similar characteristics may be merged with very little effect on quality. Sub-bands with highly variable data may be better represented if a sub-band is split. However, smaller sub-bands require more sub-bands (and, typically, more bits) to represent the same spectral data than larger sub-bands. To balance these interests, an encoder can make sub-band decisions based on quality measurements and bitrate information.

A decoder de-multiplexes a bitstream with baseband/extended-band partitioning and decodes the bands (e.g., in a baseband decoder and an extended-band decoder) using corresponding decoding techniques. The decoder may also perform additional functions.

Figure 42:
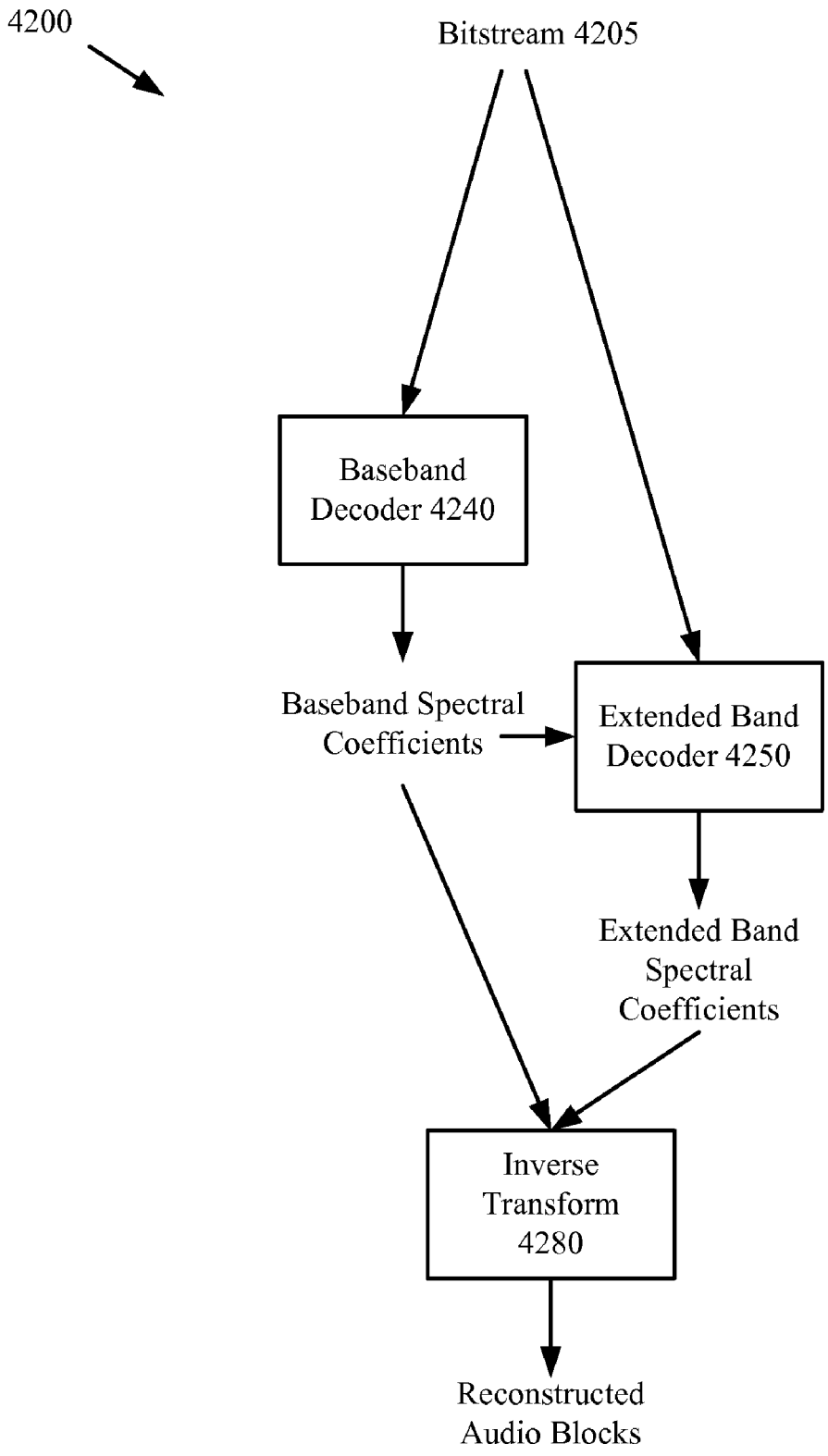
FIG. 42 is a block diagram of aspects of a decoder that performs frequency extension decoding.

FIG. 42 shows aspects of an audio decoder 4200 for decoding a bitstream produced by an encoder that uses frequency extension coding and separate encoding modules for baseband data and extended-band data. In FIG. 42, baseband data and extended-band data in the encoded bitstream 4205 is decoded in baseband decoder 4240 and extended-band decoder 4250, respectively. The baseband decoder 4240 decodes the baseband spectral coefficients using conventional decoding of the baseband codec. The extended-band decoder 4250 decodes the extended-band data, including by copying over portions of the baseband spectral coefficients pointed to by the motion vector of the shape parameter and scaling by the scaling factor of the scale parameter. The baseband and extended-band spectral coefficients are combined into a single spectrum, which is converted by inverse transform 4280 to reconstruct the audio signal.

Multi-channel coding in Section III.C.1 described techniques for representing all frequencies in a non-coded channel using a scaled version of the spectrum from one or more coded channels. Frequency extension coding differs in that extended-band coefficients are represented using scaled versions of the baseband coefficients. However, these techniques can be used together, such as by performing frequency extension coding on a combined channel and in other ways as described below.

b. Examples of Channel Extension Coding with Other Coding Transforms

Figure 43:
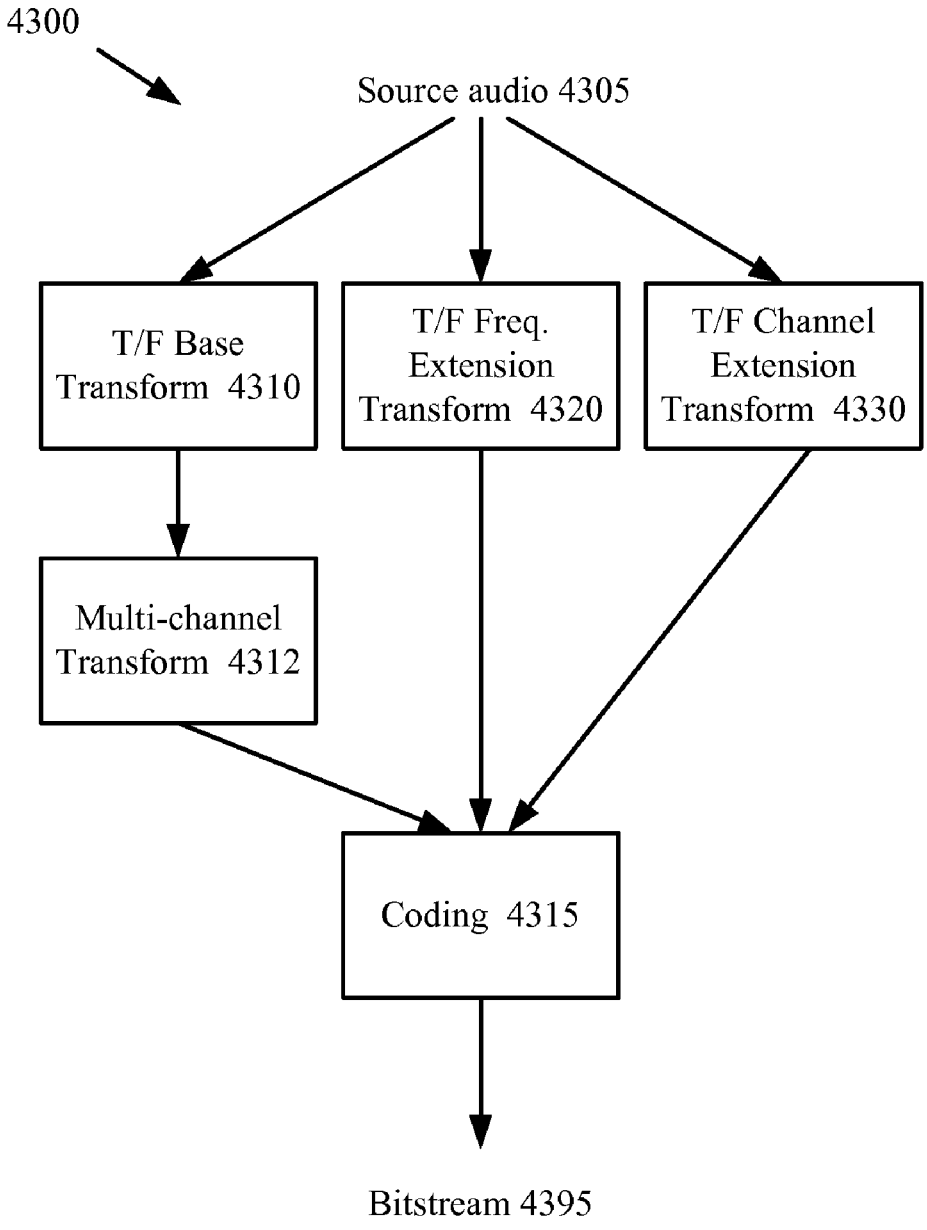
FIG. 43 is a block diagram of aspects of an encoder that performs channel extension coding and frequency extension coding.

FIG. 43 is a diagram showing aspects of an example encoder 4300 that uses a time-to-frequency (T/F) base transform 4310, a T/F frequency extension transform 4320, and a T/F channel extension transform 4330 to process multi-channel source audio 4305. (Other encoders may use different combinations or other transforms in addition to those shown.)

The T/F transform can be different for each of the three transforms.

For the base transform, after a multi-channel transform 4312, coding 4315 comprises coding of spectral coefficients. If channel extension coding is also being used, at least some frequency ranges for at least some of the multi-channel transform coded channels do not need to be coded. If frequency extension coding is also being used, at least some frequency ranges do not need to be coded. For the frequency extension transform, coding 4315 comprises coding of scale and shape parameters for bands in a subframe. If channel extension coding is also being used, then these parameters may not need to be sent for some frequency ranges for some of the channels. For the channel extension transform, coding 4315 comprises coding of parameters (e.g., power ratios and a complex parameter) to accurately maintain cross-channel correlation for bands in a subframe. For simplicity, coding is shown as being formed in a single coding module 4315. However, different coding tasks can be performed in different coding modules.

Figure 44:
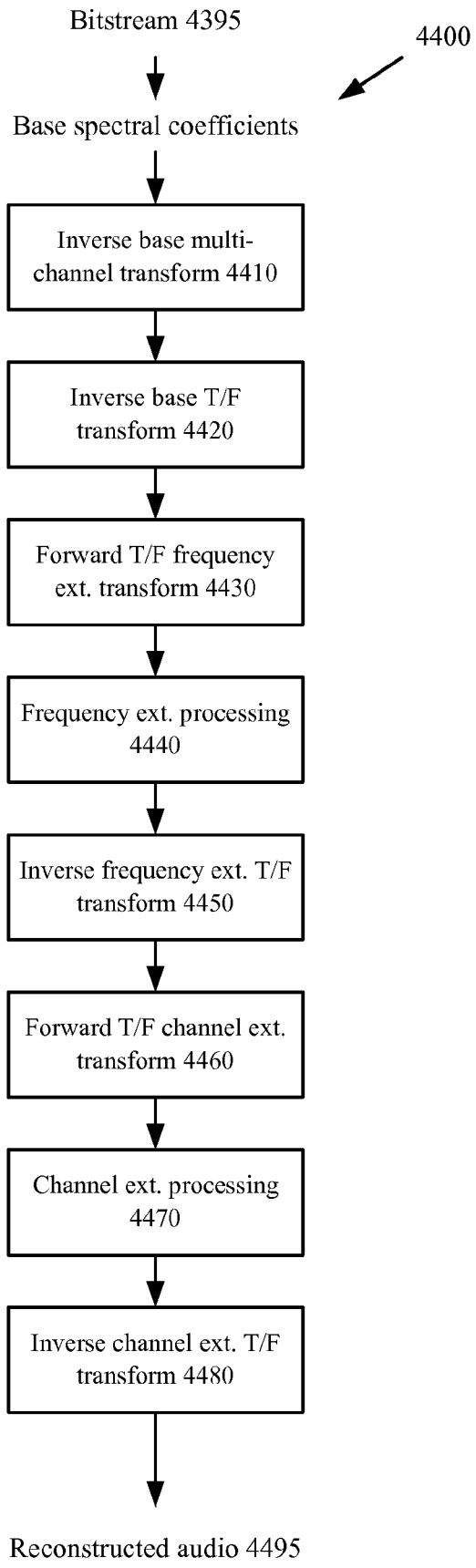
FIGS. 44, 45 and 46 are block diagrams of aspects of decoders that perform channel extension decoding and frequency extension decoding.
Figure 45:
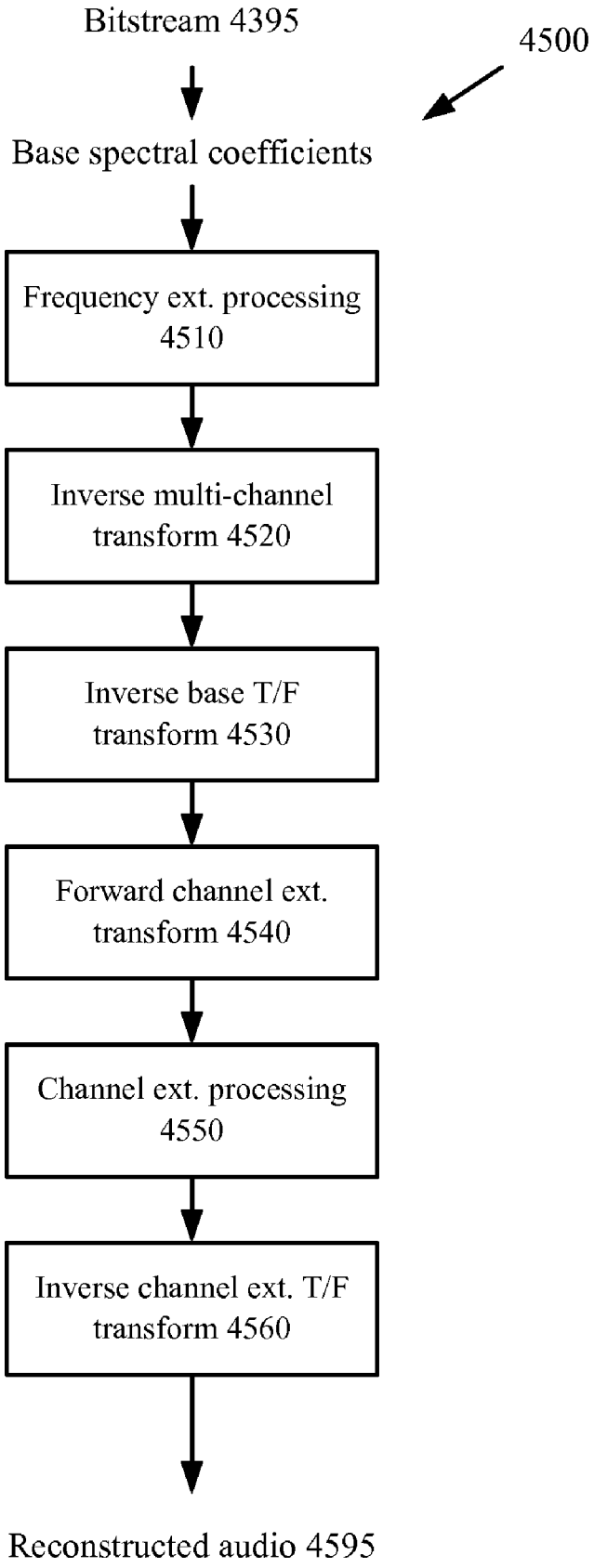
Figure 46:
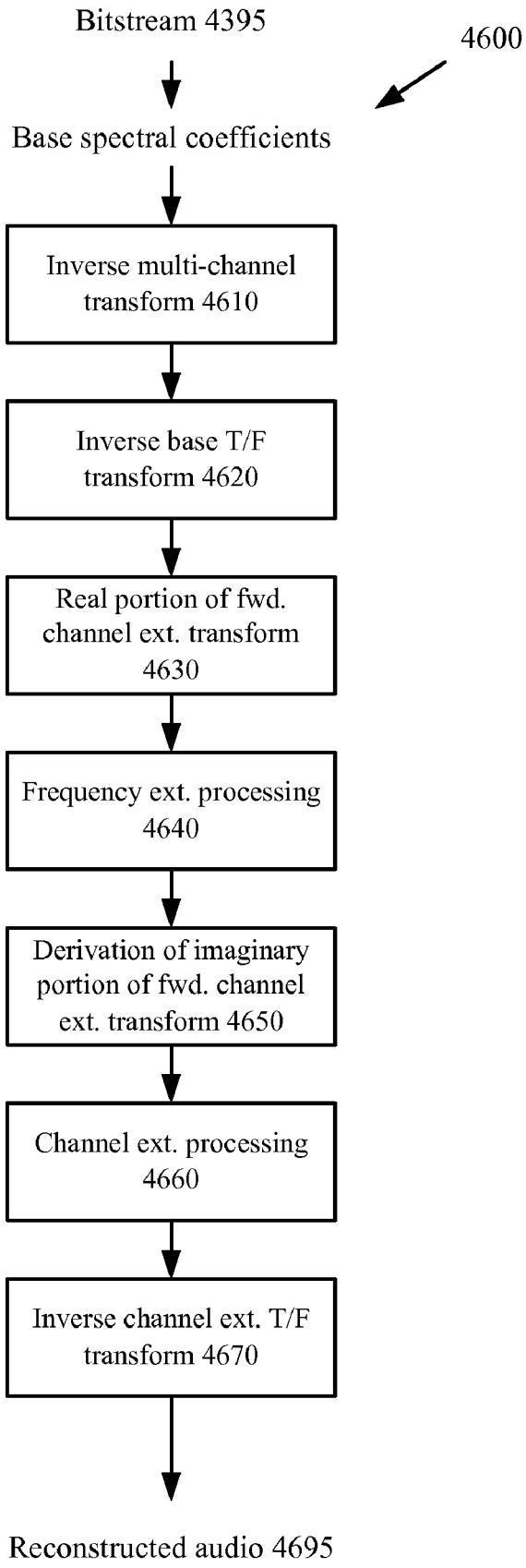

FIGS. 44, 45 and 46 are diagrams showing aspects of decoders 4400, 4500 and 4600 that decode a bitstream such as bitstream 4395 produced by example encoder 4300. In the decoders, 4400, 4500 and 4600, some modules (e.g., entropy decoding, inverse quantization/weighting, additional post-processing) that are present in some decoders are not shown for simplicity. Also, the modules shown may in some cases be rearranged, combined, or divided in different ways. For example, although single paths are shown, the processing paths may be divided conceptually into two or more processing paths.

In decoder 4400, base spectral coefficients are processed with an inverse base multi-channel transform 4410, inverse base T/F transform 4420, forward T/F frequency extension transform 4430, frequency extension processing 4440, inverse frequency extension T/F transform 4450, forward T/F channel extension transform 4460, channel extension processing 4470, and inverse channel extension T/F transform 4480 to produce reconstructed audio 4495.

However, for practical purposes, this decoder may be undesirably complicated. Also, the channel extension transform is complex, while the other two are not. Therefore, other decoders can be adjusted in the following ways: the T/F transform for frequency extension coding can be limited to (1) base T/F transform, or (2) the real portion of the channel extension T/F transform.

This allows configurations such as those shown in FIGS. 45 and 46.

In FIG. 45, decoder 4500 processes base spectral coefficients with frequency extension processing 4510, inverse multi-channel transform 4520, inverse base T/F transform 4530, forward channel extension transform 4540, channel extension processing 4550, and inverse channel extension T/F transform 4560 to produce reconstructed audio 4595.

In FIG. 46, decoder 4600 processes base spectral coefficients with inverse multi-channel transform 4610, inverse base T/F transform 4620, real portion of forward channel extension transform 4630, frequency extension processing 4640, derivation of the imaginary portion of forward channel extension transform 4650, channel extension processing 4660, and inverse channel extension T/F transform 4670 to produce reconstructed audio 4695.

Any of these configurations can be used, and a decoder can dynamically change which configuration is being used. In one implementation, the transform used for the base and frequency extension coding is the MLT (which is the real portion of the MCLT (modulated complex lapped transform) and the transform used for the channel extension transform is the MCLT. However, the two have different subframe sizes.

Each MCLT coefficient in a subframe has a basis function which spans that subframe. Since each subframe only overlaps with the neighboring two subframes, only the MLT coefficients from the current subframe, previous subframe, and next subframe are needed to find the exact MCLT coefficients for a given subframe.

The transforms can use same-size transform blocks, or the transform blocks may be different sizes for the different kinds of transforms. Different size transforms blocks in the base coding transform and the frequency extension coding transform can be desirable, such as when the frequency extension coding transform can improve quality by acting on smaller-time-window blocks. However, changing transform sizes at base coding, frequency extension coding and channel extension coding introduces significant complexity in the encoder and in the decoder. Thus, sharing transform sizes between at least some of the transform types can be desirable.

As an example, if the base coding transform and the frequency extension coding transform share the same transform block size, the channel extension coding transform can have a transform block size independent of the base coding/frequency extension coding transform block size. In this example, the decoder can comprise frequency reconstruction followed by an inverse base coding transform. Then, the decoder performs a forward complex transform to derive spectral coefficients for scaling the coded, combined channel. The complex channel extension coding transform uses its own transform block size, independent of the other two transforms. The decoder reconstructs the physical channels in the frequency domain from the coded, combined channel (e.g., a sum channel) using the derived spectral coefficients, and performs an inverse complex transform to obtain time-domain samples from the reconstructed physical channels.

As another example, if the base coding transform and the frequency extension coding transform have different transform block sizes, the channel extension coding transform can have the same transform block size as the frequency extension coding transform block size. In this example, the decoder can comprise of an inverse base coding transform followed by a forward reconstruction domain transform and frequency extension reconstruction. Then, the decoder derives the complex forward reconstruction domain transform spectral coefficients.

In the forward transform, the decoder can compute the imaginary portion of MCLT coefficients (also referred to below as the DST coefficients) of the channel extension transform coefficients from the real portion (also referred to below as the DCT or MLT coefficients). For example, the decoder can calculate an imaginary portion in a current block by looking at real portions from some coefficients (e.g., three coefficients or more) from a previous block, some coefficients (e.g., two coefficients) from the current block, and some coefficients (e.g., three coefficients or more) from the next block.

The mapping of the real portion to an imaginary portion involves taking a dot product between the inverse modulated DCT basis with the forward modulated discrete sine transform (DST) basis vector. Calculating the imaginary portion for a given subframe involves finding all the DST coefficients within a subframe. This can only be non-0 for DCT basis vectors from the previous subframe, current subframe, and next subframe. Furthermore, only DCT basis vectors of approximately similar frequency as the DST coefficient that we are trying to find have significant energy. If the subframe sizes for the previous, current, and next subframe are all the same, then the energy drops off significantly for frequencies different than the one we are trying to find the DST coefficient for. Therefore, a low complexity solution can be found for finding the DST coefficients for a given subframe given the DCT coefficients.

Specifically, we can compute $Xs=A*Xc(-1)+B*Xc(0)+C*Xc(1)$ where $Xc(-1)$, $Xc(0)$ and $Xc(1)$ stand for the DCT coefficients from the previous, current and the next block and Xs represent the DST coefficients of the current block:

1) Pre-compute A, B and C matrix for different window shape/size

2) Threshold A, B, and C matrix so values significantly smaller than the peak values are reduced to 0, reducing them to sparse matrixes 3) Compute the matrix multiplication only using the non-zero matrix elements.

In applications where complex filter banks are needed, this is a fast way to derive the imaginary from the real portion, or vice versa, without directly computing the imaginary portion.

The decoder reconstructs the physical channels in the frequency domain from the coded, combined channel (e.g., a sum channel) using the derived scale factors, and performs an inverse complex transform to obtain time-domain samples from the reconstructed physical channels.

The approach results in significant reduction in complexity compared to the brute force approach which involves an inverse DCT and a forward DST.

c. Reduction of Computational Complexity in Frequency/Channel Extension Coding

The frequency/channel extension coding can be done with base coding transforms, frequency extension coding transforms, and channel extension coding transforms. Switching transforms from one to another on block or frame basis can improve perceptual quality, but it is computationally expensive. In some scenarios (e.g., low-processing-power devices), such high complexity may not be acceptable. One solution for reducing the complexity is to force the encoder to always select the base coding transforms for both frequency and channel extension coding. However, this approach puts a limitation on the quality even for playback devices that are without power constraints. Another solution is to let the encoder perform without transform constraints and have the decoder map frequency/channel extension coding parameters to the base coding transform domain if low complexity is required. If the mapping is done in a proper way, the second solution can achieve good quality for high-power devices and good quality for low-power devices with reasonable complexity. The mapping of the parameters to the base transform domain from the other domains can be performed with no extra information from the bitstream, or with additional information put into the bitstream by the encoder to improve the mapping performance.

d. Improving Energy Tracking of Frequency Extension Coding in Transition Between Different Window Sizes As indicated in Section III.C.3.b, a frequency extension coding encoder can use base coding transforms, frequency extension coding transforms (e.g., extended-band perceptual similarity coding transforms) and channel extension coding transforms. However, when the frequency encoding is switching between two different transforms, the starting point of the frequency encoding may need extra attention. This is because the signal in one of the transforms, such as the base transform, is usually band passed, with a clear-pass band defined by the last coded coefficient. However, such a clear boundary, when mapped to a different transform, can become fuzzy. In one implementation, the frequency extension encoder makes sure no signal power is lost by carefully defining the starting point. Specifically, 1) For each band, the frequency extension encoder computes the energy of the previously (e.g., by base coding) compressed signal—E1.

2) For each band, the frequency extension encoder computes the energy of the original signal—E2.

3) If (E2−E1)>T, where T is a predefined threshold, the frequency extension encoder marks this band as the starting point.

4) The frequency extension encoder starts the operation here, and

5) The frequency extension encoder transmits the starting point to the decoder.

In this way, a frequency extension encoder, when switching between different transforms, detects the energy difference and transmits a starting point accordingly.

4. Shape and Scale Parameters for Frequency Extension Coding a. Displacement Vectors for Encoders Using Modulated DCT Coding As mentioned in Section III.C.3.a above, extended-band perceptual similarity frequency extension coding involves determining shape parameters and scale parameters for frequency bands within time windows. Shape parameters specify a portion of a baseband (typically a lower band) that will act as the basis for coding coefficients in an extended band (typically a higher band than the baseband). For example, coefficients in the specified portion of the baseband can be scaled and then applied to the extended band.

Figure 47:
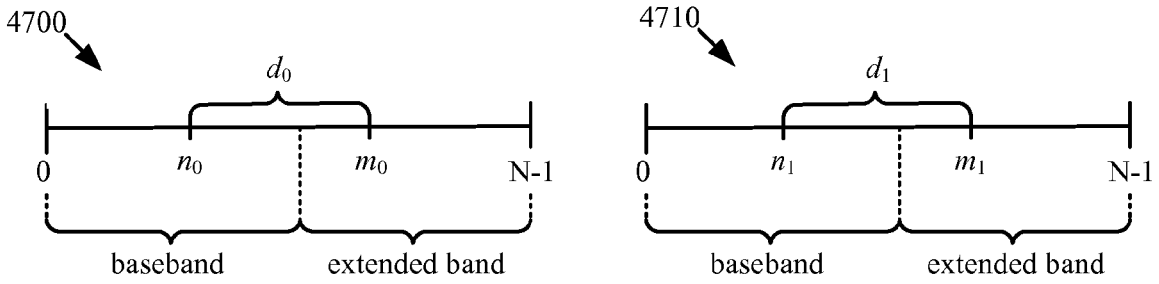
FIG. 47 is a diagram that shows representations of displacement vectors for two audio blocks.

A displacement vector d can be used to modulate the signal of a channel at time t, as shown in FIG. 47. FIG. 47 shows representations of displacement vectors for two audio blocks 4700 and 4710 at time $t_0$ and $t_1$, respectively. Although the example shown in FIG. 47 involves frequency extension coding concepts, this principle can be applied to other modulation schemes that are not related to frequency extension coding.

In the example shown in FIG. 47, audio blocks 4700 and 4710 comprise N sub-bands in the range 0 to N−1, with the sub-bands in each block partitioned into a lower-frequency baseband and a higher-frequency extended band. For audio block 4700, the displacement vector $d_0$ is shown to be the displacement between sub-bands $m_0$ and $n_0$. Similarly, for audio block 4710, the displacement vector $d_1$ is shown to be the displacement between sub-bands $m_1$ and $n_1$ Since the displacement vector is meant to accurately describe the shape of extended-band coefficients, one might assume that allowing maximum flexibility in the displacement vector would be desirable. However, restricting values of displacement vectors in some situations leads to improved perceptual quality. For example, an encoder can choose sub-bands m and n such that they are each always even or odd-numbered sub-bands, making the number of sub-bands covered by the displacement vector d always even. In an encoder that uses modulated discrete cosine transforms (DCT), when the number of sub-bands covered by the displacement vector d is even, better reconstruction is possible.

When extended-band perceptual similarity frequency extension coding is performed using modulated DCTs, a cosine wave from the baseband is modulated to produce a modulated cosine wave for the extended band. If the number of sub-bands covered by the displacement vector d is even, the modulation leads to accurate reconstruction. However, if the number of sub-bands covered by the displacement vector d is odd, the modulation leads to distortion in the reconstructed audio. Thus, by restricting displacement vectors to cover only even numbers of sub-bands (and sacrificing some flexibility in d), better overall sound quality can be achieved by avoiding distortion in the modulated signal. Thus, in the example shown in FIG. 47, the displacement vectors in audio blocks 4700 and 4710 each cover an even number of sub-bands.

b. Anchor Points for Scale Parameters

When frequency extension coding has smaller windows than the base coder, bitrate tends to increase. This is because while the windows are smaller, it is still important to keep frequency resolution at a fairly high level to avoid unpleasant artifacts.

Figure 48:
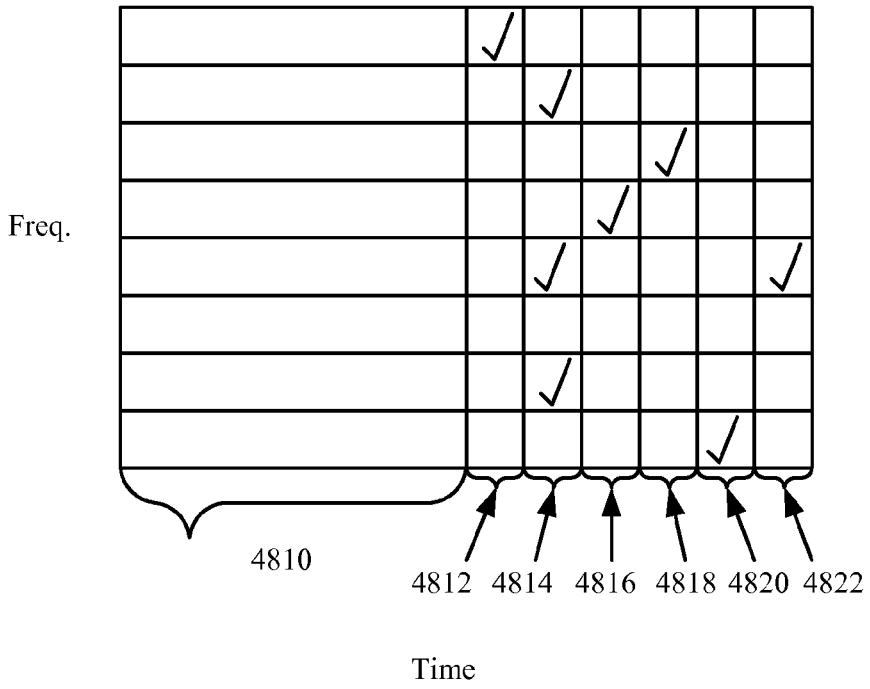
FIG. 48 is a diagram that shows an arrangement of audio blocks having anchor points for interpolation of scale parameters.

FIG. 48 shows a simplified arrangement of audio blocks of different sizes. Time window 4810 has a longer duration than time windows 4812-4822, but each time window has the same number of frequency bands.

The check-marks in FIG. 48 indicate anchor points for each frequency band. As shown in FIG. 48, the numbers of anchor points can vary between bands, as can the temporal distances between anchor points. (For simplicity, not all windows, bands or anchor points are shown in FIG. 48.) At these anchor points, scale parameters are determined. Scale parameters for the same bands in other time windows can then be interpolated from the parameters at the anchor points.

Alternatively, anchor points can be determined in other ways.

5. Reduced Complexity Channel Extension Coding

The channel extension processing described above (in section III.C.2) codes a multi-channel sound source by coding a subset of the channels, along with parameters from which the decoder can reproduce a normalized version of a channel correlation matrix. Using the channel correlation matrix, the decoder process (4400, 4500, 4600) reconstructs the remaining channels from the coded subset of the channels. The parameters for the normalized channel correlation matrix uses a complex rotation in the modulated complex lapped transform (MCLT) domain, followed by post-processing to reconstruct the individual channels from the coded channel subset. Further, the reconstruction of the channels required the decoder to perform a forward and inverse complex transform, again adding to the processing complexity. With the addition of the frequency extension coding (as described in section III.C.3.a above) using the modulated lapped transform (MLT), which is a real-only transform performed in the reconstruction domain, then the complexity of the decoder is even further increased.

In accordance with a low complexity channel extension coding technique described herein, the encoder sends a parameterization of the channel correlation matrix to the decoder. The decoder translates the parameters for the channel correlation matrix to a real transform that maintains the magnitude of the complex channel correlation matrix. As compared to the above-described channel extension approach (in section III.C.2), the decoder is then able to replace the complex scale and rotation with a real scaling. The decoder also replaces the complex post-processing with a real filter and scaling. This implementation then reduces the complexity of decoding to approximately one fourth of the previously described channel extension coding. The complex filter used in the previously described channel extension coding approach involved 4 multiplies and 2 adds per tap, whereas the real filter involves a single multiply per tap.

Figure 49:
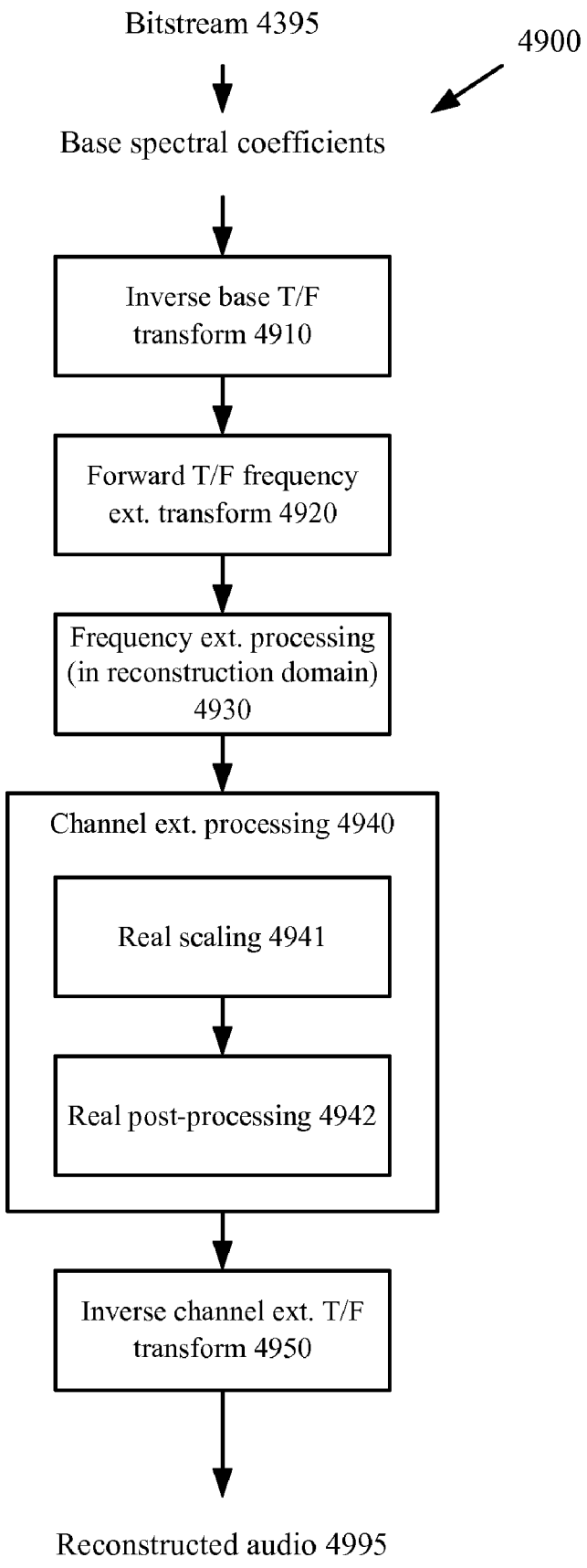
FIG. 49 is a block diagram of aspects of a decoder that performs channel extension decoding and frequency extension decoding.

FIG. 49 shows aspects of a low complexity multi-channel decoder process 4900 that decodes a bitstream (e.g., bitstream 4395 of example encoder 4300). In the decoder process 4900, some modules (e.g., entropy decoding, inverse quantization/weighting, additional post-processing) that are present in some decoders are not shown for simplicity. Also, the modules shown may in some cases be rearranged, combined or divided in different ways. For example, although single paths are shown, the processing paths may be divided conceptually into two or more processing paths.

In the low complexity multi-channel decoder process 4900, the decoder processes base spectral coefficients decoded from the bitstream 4395 with an inverse base T/F transform 4910 (such as, the modulated lapped transform (MLT)), a forward T/F (frequency extension) transform 4920, frequency extension processing 4930, channel extension processing 4940 (including real-valued scaling 4941 and real-valued post-processing 4942), and an inverse channel extension T/F transform 4950 (such as, the inverse MCLT transform) to produce reconstructed audio 4995.

a. Detailed Explanation

In the above-described parameterization of the channel correlation matrix (section III.C.2.c), for the case involving two source channels of which a subset of one channel is coded (i.e., P=2, N=1), the detailed explanation derives that in order to maintain the second order statistics, one finds a 2×2 matrix C such that $WW^*=CZZ^*C^*=XX^*$, where W is the reconstruction, X is the original signal, C is the complex transform matrix to be used in the reconstruction, and Z is the a signal consisting of two components, one being the coded channels actually sent by the encoder to the decoder and the other component being the effect signal created at the decoder using the coded signal. The effect signal must be statistically similar to the coded component but be decorrelated from it. The original signal X is a P×L matrix, where L is the band size being used in the channel extension. Let $$X = \begin{bmatrix} X_0 \\ X_1 \end{bmatrix} \tag{1}$$

Each of the P rows represents the L spectral coefficients from the individual channels (for example the left and the right channels for P=2 case). The first component of Z (herein labeled $Z_0$) is a N×L matrix that is formed by taking one of the components when a channel transform A is applied to X. Let $Z_0=BX$ be the component of Z which is actually coded by the encoder and sent to the decoder. B is a subset of N rows from the P×P channel transform matrix A. Suppose A is a channel transform which transforms (left/right source channels) into (sum/diff channels) as is commonly done. Then, $B=[B_0\ B_1]=[\beta\pm\beta]$, where the sign choice (±) depends on whether the sum or difference channel is the channel being actually coded and sent to the decoder. This forms the first component of Z. The power in this channel being coded and sent to the decoder is given by $\alpha=BXX^*B^*=\beta^2(X_0X^*_0+X_1X^*_1\pm 2\mathrm{Re}(X_0X^*_1)$.

b. LMRM Parameterization

The goal of the decoder is to find C such that $CC^*=XX^*/\alpha$. The encoder can either send C directly or parameters to represent or compute $XX^*/\alpha$. For example in the LMRM parameterization, the decoder sends $$LM=X_0X^*_0/\alpha \tag{2}$$

$$RM=X_1X^*_1/\alpha \tag{3}$$

$$RI=Re(X_0X^*_1)/Im(X_0X^*_1) \tag{4}$$

Since we know that $\beta^2(X_0X^*_0+X_1X^*_1\pm 2\mathrm{Re}(X_0X^*_1))/\alpha=1$, we can calculate $\mathrm{Re}(X_0X^*_1/\alpha=(1/\beta^2LM-RM)/2$, and $\mathrm{Im}(X_0X^*_1)/\alpha=(\mathrm{Re}(X_0X^*_1)/\alpha)/RI$. Then the decoder has to solve $$CC^* = \begin{bmatrix} LM & \frac{\frac{1}{\beta^2}-LM-RM}{2}\left(1+\frac{j}{RI}\right) \\ \frac{\frac{1}{\beta^2}-LM-RM}{2}\left(1-\frac{j}{RI}\right) & RM \end{bmatrix} \tag{5}$$

c. Normalized Correlation Matrix Parameterization

Another method is to directly send the normalized correlation matrix parameterization (correlation matrix normalized by the geometric mean of the power in the two channels). The following description details simplifications for use of this direct normalized correlation matrix parameterization in a low complexity encoder/decoder implementation. Similar simplifications can be applied to the LMRM parameterization. In the direct normalized correlation matrix parameterization, the decoder sends the following three parameters:

$$l = \frac{X_0X_0^*}{\sqrt{X_0X_0^*X_1X_1^*}} \tag{6}$$

$$\sigma = \left|\frac{X_0X_1^*}{\sqrt{X_0X_0^*X_1X_1^*}}\right| \tag{7}$$

$$\theta = \angle\left(\frac{X_0X_1^*}{\sqrt{X_0X_0^*X_1X_1^*}}\right) \tag{8}$$

This then simplifies to the decoder solving the following:

$$CC^* = \frac{\frac{1}{\beta^2}}{l+\frac{1}{l}\pm 2\sigma\cos\theta}\begin{bmatrix} l & \sigma e^{j\theta} \\ \sigma e^{-j\theta} & \frac{1}{l} \end{bmatrix} \tag{9}$$

If C satisfies (9), then so will CU for any arbitrary orthonormal matrix U. Since C is a 2×2 matrix, we have 4 parameters available and only 3 equations to satisfy (since the correlation matrix is symmetric). The extra degree of freedom is used to find U such that the amount of effect signal going into both the reconstructed channels is the same. Additionally the phase component is separated out into a separate matrix which can be done for this case. That is, $$C = \Phi R \tag{10}$$

$$= \begin{bmatrix} e^{j\phi_0} & 0 \\ 0 & e^{j\phi_1} \end{bmatrix}\begin{bmatrix} a & d \\ b & -d \end{bmatrix} \tag{11}$$

$$= \begin{bmatrix} ae^{j\phi_0} & de^{j\phi_0} \\ be^{j\phi_1} & -de^{j\phi_1} \end{bmatrix} \tag{12}$$

where R is a real matrix which simply satisfies the magnitude of the cross-correlation. Regardless of what a, b, and d are, the phase of the cross-correlation can be satisfied by simply choosing $\phi_0$ and $\phi_1$ such that $\phi_0-\phi_1=\theta$. The extra degree of freedom in satisfying the phase can be used to maintain other statistics such as the phase between $X_0$ and BX. That is $$\angle X_0BX = \angle(X_0X_0^* \pm X_0X_1^*) \tag{13}$$

$$= \angle(l \pm \sigma e^{j\theta}) \tag{14}$$

$$= \angle(l \pm \sigma(\cos\theta + j\sin\theta)) \tag{15}$$

$$= \phi_0 \tag{16}$$

This gives $$\phi_0 = \arctan 2\left(\frac{\pm\sigma\sin\theta}{l\pm\sigma\cos\theta}\right) \tag{17}$$

$$\phi_1 = \phi_0 - \theta \tag{18}$$

The values for a, b, and d are found by satisfying the magnitude of the correlation matrix. That is $$RR^* = \begin{bmatrix} a & d \\ b & -d \end{bmatrix}\begin{bmatrix} a & b \\ b & -d \end{bmatrix} \tag{19}$$

$$= \frac{\frac{1}{\beta^2}}{l+\frac{1}{l}\pm 2\sigma\cos\theta}\begin{bmatrix} l & \sigma \\ \sigma & \frac{1}{l} \end{bmatrix} \tag{20}$$

Solving this equation gives a fairly simple solution to R. This direct implementation avoids having to compute eigenvalues/eigenvectors. We get $$R = \frac{1}{\beta\sqrt{\left(l+\frac{1}{l}\pm 2\sigma\cos\theta\right)\left(l+\frac{1}{l}+2\sigma\right)}}\begin{bmatrix} l+\sigma & \sqrt{1-\sigma^2} \\ \frac{1}{l}+\sigma & -\sqrt{1-\sigma^2} \end{bmatrix} \tag{21}$$

Breaking up C into two parts as $C=\Phi R$ allows an easy way of converting the normalized correlation matrix parameters into the complex transform matrix C. This matrix factorization into two matrices further allows the low complexity decoder to ignore the phase matrix Φ, and simply use the real matrix R.

Note that in the previously described channel correlation matrix parameterization (section III.C.2.c), the encoder does no scaling to the mono signal. That is to say, the channel transform matrix being used (B) is fixed. The transform itself has a scale factor which adjusts for any change in power caused by forming the sum or difference channel. In an alternate method, the encoder scales the N=1 dimensional signal so that the power in the original P=2 dimensional signal is preserved. That is the encoder multiplies the sum/difference signal by $$\sqrt{\frac{X_0X_0^* + X_1X_1^*}{\beta^2(X_0X_0^* + X_1X_1^* \pm 2\mathrm{Re}(X_0X_1^*))}} = \sqrt{\frac{l + \frac{1}{l}}{\beta^2\left(l + \frac{1}{l} \pm 2\sigma\cos\theta\right)}} \tag{22}$$

In order to compensate, the decoder needs to multiply by the inverse, which gives $$R = \frac{1}{\sqrt{\left(l + \frac{1}{l}\right)\left(l + \frac{1}{l} + 2\sigma\right)}}\begin{bmatrix} l + \sigma & \sqrt{1-\sigma^2} \\ \frac{1}{l} + \sigma & -\sqrt{1-\sigma^2} \end{bmatrix} \tag{23}$$

In both of the previous methods (21) and (23), call the scale factor in front of the matrix R to be s.

At the channel extension processing stage 4940 of the low complexity decoder process 4900 (FIG. 49), the first portion of the reconstruction is formed by using the values in the first column of the real valued matrix R to scale the coded channel received by the decoder. The second portion of the reconstruction is formed by using the values in the second column of the matrix R to scale the effect signal generated from the coded channel which has similar statistics to the coded channel but is decorrelated from it. The effect signal (herein labeled $Z_{0F}$) can be generated for example using a reverb filter (e.g., implemented as an IIR filter with history). Because the input into the reverb filter is real-valued, the reverb filter itself also can be implemented on real numbers as well as the output from the filter. Because the phase matrix Φ is ignored, there is no complex rotation or complex post-processing. In contrast to the complex number post-processing performed in the previously described approach (section III.C.2 above), this channel extension implementation using real-valued scaling 4941 and real-valued post-processing 4942 saves complexity (in terms of memory use and computation) at the decoder.

As a further alternative variation, suppose instead of generating the effect signal using the coded channel, the decoder uses the first portion of the reconstruction to generate the effect signal. Since the scale factor being applied to the effect signal $Z_{0F}$ is given by sd, and since the first portion of the reconstruction has a scale factor of sa for the first channel and sb for the second channel, if the effect signal is being created by the first portion of the reconstruction, then the scale factor to be applied to it is given by d/a for the first channel and d/b for the second channel. Note that since the effect signal being generated is an IIR filter with history, there can be cases when the effect signal has significantly larger power than that of the first portion of the reconstruction. This can cause an undesirable post echo. To solve this, the scale factor derived from the second column of matrix R can be further attenuated to ensure that the power of the effect signal is not larger than some threshold times the first portion of the reconstruction.

IV. Bitstream Syntax for the Multiple Decoding Processes/Components

With reference again to FIG. 7, the audio encoder 700 encodes the output bitstream 745 using a bitstream syntax that provides syntax elements for representing parameters needed by the various decoding process components for decoding the bitstream and reconstructing the audio output 795. The various decoding process components (i.e., the baseband decoder 760, the spectral peak decoder 770, the frequency extension decoder 780 and the channel extension decoder 790) each have their own way to extract the parameters from the bitstream and process the coded audio content. The following section details one example of a bitstream syntax with syntax elements from which the parameters of the respective decoding processes are extracted. Exemplary decoding procedures for reading the bitstream syntax also are defined in the decoding tables presented below.

The basic coding unit of the bitstream 745 is the tile (e.g., as illustrated in the example tile configuration of FIG. 6, discussed above). The audio decoder 770 decodes a tile by invoking the various decoding components (baseband decoder 760, spectral peak decoder 770, frequency extension decoder 780 and channel extension decoder 790) on the coded contents of the tile, as shown in the following syntax table of the tile decoding procedure.

TABLE 1

Tile Decoding Procedure.

| Syntax | # bits |
|---|---|
| plusDecodeTile( ) | |
| { | |
| plusDecodeBase( ) | |
| plusDecodeChex( ) | |
| plusDecodeFex( ) | |
| reconProcUpdateCodingFexFlag( ) | |
| plusDecodeReconFex( ) | |
| } | |

The example bitstream syntax uses a superframe header structure. Rather than signaling all configuration parameters in each frame, some configuration parameters (e.g., for low bit rate extensions) are sent only at intervals in frames designated as "superframes." The bitstream syntax includes a syntax element, labeled bPlusSuperframe in the following tables, which designates a frame as a superframe that contains these configuration parameters. By avoiding having to send the configuration parameters each frame in this way, the superframe header structure conserves bitrate, which is particularly significant for bitstreams coded at very low bitrates. At decoding, the decoder can start decoding the bitstream at any intermediate frame. However, the decoder decodes only the base band portion of the bitstream. The decoder does not start applying the low bit rate extensions until arriving at a superframe. The superframe structure of the bitstream syntax thus has the trade-off of degraded reconstruction quality while "seeking" the superframe, while achieving a reduction in the coded bitrate.

TABLE 2

Tile Header Decoding Procedure.

| Syntax | # bits |
|---|---|
| plusDecodeTileHeader ( ) | |
| { | |
| if (iPlusVersion>=2 && 0==iCurrTile) | |
| plusDecodeSuperframeHeaderFirstTile( ) | |
| if (iPlusVersion>=2 && cTiles−1==iCurrTile && | |
| !bLastTileHeaderDecoded) | |
| plusDecodeSuperframeHeaderLastTile( ) | |
| setPlusOrder( ) | |
| } | |

TABLE 3

Superframe Header Decoding Procedure.

| Syntax | # bits |
|---|---|
| plusDecodeSuperframeHeaderFirstTile ( ) | |
| { | |
| bPlusSuperframe | 1 |
| if (bPlusSuperframe) | |
| { | |
| if (iPlusVersion==3) | |
| { | |
| bBasePeakPresent | 1 |
| } | |
| bBasePlusPresent | 1 |
| bCodingFexPresent | 1 |
| if (bBasePlusPresent) | |
| { | |
| plusDecodeBasePlusHeader( ) | |
| } | |
| if (bCodingFexPresent) | |
| { | |
| plusDecodeCodingFexHeader( ) | |
| } | |
| if (bBasePlusPresent \|\| bCodingFexPresent) | |
| { | |
| plusDecodeSuperframeHeaderLastTile( ) | |
| } | |
| } | |

TABLE 4

Superframe Header Decoding Procedure.

| Syntax | # bits |
|---|---|
| plusDecodeSuperframeHeaderLastTile ( ) | |
| { | |
| if (bPlusSuperframe) | |
| { | |
| bChexPresent | 1 |
| bReconFexPresent | 1 |
| if (bChexPresent) | |
| { | |
| plusDecodeChexHeader( ) | |
| } | |
| if (bReconFexPresent) | |
| { | |
| plusDecodeReconFexHeader( ) | |
| } | |
| if (bChexPresent \|\| bReconFexPresent) | |
| { | |
| iTileSplitType | 1-2 |
| /* | |
| iTileSplitType | |
| 0: TileSplitBaseSmall | |
| 10: TileSplitBasic | |
| 11: TileSplitArbitrary | |
| */ | |
| } | |
| } | |
| if ((bChexPresent \|\| bReconFexPresent) && | |
| iTileSplitType==ReconProcTileSplitArbitrary) | |
| { | |
| for (iTile=0; iTile < iNTilesPerFrameBasic; | |
| iTile++) | |
| { | |
| bTileSplitArbitrary[iTile] | 1 |
| } | |
| } | |
| bLastTileHeaderDecoded = TRUE | |
| } | |

A. Bitstream Syntax for Baseband Decoding Procedures

The bitstream syntax and decoding procedures for the baseband decoder 760 are shown in the following tables. The bitstream syntax of the example audio encoder 700 and decoder 750 provides an alternative coding of the base band spectrum region (called the "base plus" coding layer), which can replace a legacy base band spectrum region coding layer. This base plus coding layer can be coded in one of various modes, which are called "exclusive," "overlay," and "extend" modes.

In the exclusive mode, the base plus layer replaces the legacy base coding layer. The legacy base layer is coded as silence, while the actual coding of the input audio is done as the base plus layer. The bitstream syntax for the base plus coding layer encodes syntax elements for decoding techniques that provide better coding efficiency, which include: (1) final mask (scale factor); (2) a variation of entropy coding for coefficients; and (3) tool boxes for signaling particular coding features. Examples of some encoding and decoding techniques utilized in the base plus coding layer include those described by Thumpudi et al., "PREDICTION OF SPECTRAL COEFFICIENTS IN WAVEFORM CODING AND DECODING," U.S. Patent Application Publication No. US-2007-0016415-A1; Thumpudi et al., "REORDERING COEFFICIENTS FOR WAVEFORM CODING OR DECODING," U.S. Patent Application Publication No. US-2007-0016406-A1; and Thumpudi et al., "CODING AND DECODING SCALE FACTOR INFORMATION," U.S. Patent Application Publication No. US-2007-0016427-A1.

In the overlay mode, the base plus layer is designed to complement the audio coded using the legacy base band coding layer. The overlay mode codes for the "overlay" spectral hole filling technique described above, which codes parameters to fill "holes" of zero-level coefficients in the base band spectrum region.

The extend mode also complements the legacy base band coding layer. This mode codes information in the base plus coding layer to fill missing high frequencies above the upper bound of the coded base band region, using the frequency extension techniques for filling missing high frequencies also described above.

The following base band decoding procedure reads parameters for decoding the base plus layer from a header of the base plus layer.

TABLE 5

Base Decoding.

| Syntax | # bits |
|---|---|
| plusDecodeBasePlusHeader( ) | |
| { | |
| bBasePlusOverlayMode | 1 |
| if (!bBasePlusOverlayMode) | |
| { | |
| bScalePriorToChannelXForm | 1 |
| bLinearQuantization | 1 |
| if (!bLinearQuantization) | |
| NLQIndex | 2 |
| bFrameParamUpdate | 1 |
| fUseProMaskRunLevelTbl | 1 |
| fLowDelayWindow | 1 |
| if (fLowDelayWindow) | |
| iOverlapWindowDelay (0->1, 10->2, 11->4) | 1-2 |
| } | |
| Else | |
| { | |
| iHoleWidthMinIdx | 1 |
| iHoleSegWidthMinIdx | 1 |
| bSingleWeightFactor | 1 |
| iWeightQuantMultiplier | 2 |
| bWeightFactorOnCodedChannel | 1 |
| fFrameParamUpdate | 1 |
| } | |
| } | |

The following base band decoding procedure is invoked from the above tile decoding procedure. This procedure checks a single bit flag indicating whether the base plus coding layer is present.

TABLE 6

Base Decoding

| Syntax | # bits |
|---|---|
| plusDecodeBase( ) | |
| { | |
| if (bBasePlusPresent) | |
| { | |
| fBasePlusTileCoded | 1 |
| bpdecDecodeTile( ) | |
| } | |
| } | |

The decoding procedure in the following table then invokes the appropriate decoding procedure for the base plus coding layer's mode.

TABLE 7

Base Decoding.

| Syntax | # bits |
|---|---|
| bpdecDecodeTile( ) | |
| { | |
| if (fBasePlusTileCoded) | |
| { | |
| if (fOverlayMode) | |
| basePlusDecodeOverlayMode( ) | |

TABLE 7-continued

Base Decoding.

| Syntax | # bits |
|---|---|
| Else | |
| basePlusDecodeTileExclusiveMode( ) | |
| } | |
| } | |

The decoding procedure for the overlay mode is shown in the following decoding table.

TABLE 8

Base Plus Overlay Mode Decoding Procedure.

| Syntax | # bits |
|---|---|
| basePlusDecodeOverlayMode( ) | |
| { | |
| if (bFirstTileInFrame) | |
| basePlusDecodeFirstTileHeaderOverlayMode( ) | |
| if (FALSE == bWeightFactorOnCodedChannel) | |
| baseplusDecodeWeightFactorOverlayMode( ) | |
| for (iCh=0; iCh < cChInTile; iCh++) | |
| { | |
| ulPower | 1 |
| if (ulPower) | |
| { | |
| if (bWeightFactorOnCodedChannel) | |
| { | |
| if (bSingleWeighFactor) | |
| { | |
| iMaxWeightFactor | CEILLOG2 (MAX_WEIGHT_FACTOR/ iWeightQuantMultiplier) |
| } | |
| Else | |
| { | |
| basePlusDecodeRLCCoefQOverlay( ) | |
| } | |
| } | |
| } | |
| } | |
| plusDecodeBasePeak( ) | |
| for (iCh=0; iCh < cChInTile; iCh) | |
| { | |
| plusDecodeBasePeak_Channel( ) | |
| } | |
| } | |

The decoding procedure for the exclusive mode is shown in the following decoding table.

| Syntax | # bits |
|---|---|
| basePlusDecodeExclusiveMode( ) | |
| { | |
| if (bFirstTileInFrame) | |
| prvBasePlusDecodeFirstTileHeaderExclusiveMode( ) | |
| prvBasePlusEntropyDecodeChannelXform( ) | |
| prvBasePlusDecodeTileScaleFactors( ) | |
| prvBasePlusDecodeTileQuantStepSize( ) | |
| prvBasePlusDecodeChannelQuantStepSize( ) | |
| for (iCh=0; iCh < cChInTile; iCh) | |

-continued

| Syntax | # bits |
|---|---|
| { | |
| ulPower | 1 |
| if (ulPower) | |
| { | |
| bUseToolboxes | 1 |
| if (bUseToolboxes) | |
| { | |
| iToolboxIndex | 2 |
| if (iToolboxIndex == 0) | |
| { | |
| basePlusDecodeInterleaveModeParams( ) | |
| basePlusDecodeRLCCoefQ( ) | |
| basePlusDeInterleave( ) | |
| } | |
| else if (iToolboxIndex == 1) | |
| { | |
| basePlusDecodePredictionModeParams( ) | |
| basePlusDecodeRLCCoefQ( ) | |
| basePlusDePrediction( ) | |
| } | |
| else if (iToolboxIndex == 2) | |
| { | |
| basePlusDecodePDFShiftModeParams( ) | |
| basePlusDecodeRLCCoefQ( ) | |
| basePlusDePDFShift( ) | |
| } | |
| } | |
| Else | |
| { | |
| basePlusDecodeRLCCoefQ( ) | |
| } | |
| } // ulPower | |
| } // iCh | |
| plusDecodeBasePeak( ) | |
| for (iCh=0; iCh < cChInTile; iCh) | |
| { | |
| plusDecodeBasePeak_Channel( ) | |
| } | |
| } | |

The following syntax tables show the decoding procedures to decode the scale factor and other parameters for the base plus coding layer.

TABLE 9

Scale Factor Decoding Procedure.

| Syntax | # bits |
|---|---|
| baseplusDecodeSFBandTableIndex( ) | |
| { | |
| iScaleFactorTable | 1-3 |
| /* scale factor table for this frame | |
| 0: Table 0 | |
| 10: Table 1 | |
| 110: Table 2 | |
| 111: Table 3 | |
| */ | |
| } | |

TABLE 10

Overlay Window Decoding Procedure.

| Syntax | # bits |
|---|---|
| baseplusDecodeIOverlayWindowDelay( ) | |
| { | |
| iOverlapWindowDelay | 1-2 |
| /* | |
| 0: 1 | |
| 10: 2 | |
| 11: 4 | |
| */ | |
| } | |

TABLE 10-continued

Overlay Window Decoding Procedure.

| Syntax | # bits |
|---|---|

TABLE 11

Exclusive Mode Tile Header Decoding Procedure.

| Syntax | # bits |
|---|---|
| basePlusDecodeFirstTileHeaderExclusiveMode( ) | |
| { | |
| if (fFrameParamUpdate) | |
| { | |
| baseplusDecodeSFBandTableIndex( ) | |
| fScalePriorToChannelXfromAtDec | 1 |
| fLinearQuantization | 1 |
| if (0 == fLinearQuantization) | |
| { | |
| NLQIndex | 2 |
| } | |
| fUsePorMaskRunLevelTbl | 1 |
| } | |
| iScaleFactorQuantizeStepSize | 2 |
| /* scale factor quantization step size | |
| 0: 1dB | |
| 1: 2dB | |
| 2: 3dB | |
| 3: 4dB | |
| */ | |
| } | |

TABLE 12

Base Plus Tile Scale Factor Decoding Procedure.

| Syntax | # bits |
|---|---|
| basePlusDecodeTileScaleFactor( ) | |
| { | |
| for (iChGrp = 0; iChGrp < cBPCHGroup; iChGrp++) | |
| { | |
| if (cChannelsInGrp > 1) | |
| fOneScaleFactorPerChGrp | 1 |
| Else | |
| fOneScaleFactorPerChGrp = 1 | |
| if (fOneScaleFactorPerChGrp) | |
| { | |
| if (fAnchorSFAvailable) | |
| fScaleFactorTemporalPreded | 1 |
| if (!fScaleFactorTemporalPreded) | |
| fScaleFactorSpectralPreded = 1 | |
| fScaleFactorInterleavedCoded | 1 |
| iScaleFactorHuffmanTableIndex // four tables | 2 |
| Call Huffman decoding of scalefactors; | |
| } | |
| Else | |
| { | |
| for (iCh=0; iCh < cChsInTile; iCh++) | |
| { | |
| if (iCh in the current ChGrp) | |
| { | |
| fMaskUpdate | 1 |
| if (fMaskUpate) | |
| { | |
| if (fAnchorSFAvailable) | |
| fScaleFactorTemporalPreded | 1 |
| if (!fFirstChannelInGrp && | |
| !fScaleFactorTempralPreded) | |

TABLE 12-continued

Base Plus Tile Scale Factor Decoding Procedure.

| Syntax | # bits |
|---|---|
| fScaleFactorSpatialPreded | 1 |
| if (!fScaleFactorTemporalPreded && !fScaleFactorSpatialPreded) fScaleFactorSpectralPreded = 1; | |
| fScaleFactorInterleavedCoded | 2 |
| iScaleFactorHuffmanTableIndex; // four tables | |
| Call Huffman decoding of scalefactors; | |
| } | |
| } | |
| } | |
| } | |
| } | |
| } | |

TABLE 13

Base Plus Tile Quantization Step Size Decoding Procedure.

| Syntax | # bits |
|---|---|
| basePlusDecodeTileQuantStepSize( ) | |
| { | |
| iStepSize | 6 |
| iQuantStepSign = (iStepSize & 0x20) ? −1 : 1; | |
| if (iQuantStepSign == −1) | |
| iStepSize != 0xFFFFFFC0; | |
| iQuantStepSize += iStepSize; | |
| if (iStepSize == −32 \|\| iStepSize == 31) | |
| fQuantStepEscaped = 1; | |
| while (fQuantStepEscaped) | |
| { | |
| iStepSize | 5 |
| if (iStepSize != 31) | |
| { | |
| iQuantStepSize += (iStepSize * iQuanStepSign); | |
| Break; | |
| } | |
| iQuanStepSize += 31 * iQuanStepSign; | |
| } | |
| } | |

TABLE 14

Base Plus Tile Channel Quantization Step Size Decoding Procedure.

| Syntax | # bits |
|---|---|
| basePlusDecodeTileChannelQuantStepSize( ) | |
| { | |
| if (pau->m_cChInTile == 1) | |
| Exit; | |
| cBitQuantStepModiferIndex // how many bits we use for Ch QuantStepsize | 3 |
| for (iCh=0; iCh<cChInTile; iCh++) | |
| { | |
| iBPChannelQuant | 1 |
| if (iBPChannelQuant) | |
| { | |
| if (0 == cBitQuantStepModiferIndex) | |
| iBPChannelQuant = 1; | |
| Else | |
| { | |
| iBPChannelQuant[cBitQuantStepModiferIndex]; | |
| iBPChannelQuant++; | |
| } | |
| } | |
| } | |
| } | |

TABLE 15

Base Plus Layer Interleave Mode Parameter Decoding Procedure.

| Syntax | # bits |
|---|---|
| basePlusDecodeInterleaveModeParams( ) | |
| { | |
| iPeriodLimit = cSubFrameSampleHalf / 16; | |
| iPeriod [Log2(iPeriodLimit)]; | |
| iPeriod++; | |
| iPeriodFraction | 3 |
| iFirstInterleavePeriod | 3 |
| cMaxPeriods = (cSubFrameSampleHalf * 8) / (iPeriod * 8 + iPeriodFraction); | |
| iLastInterleavePeriod | [CEILLOG2 (cMaxPeriods)]; |
| iPreroll | 2 |
| } | |

TABLE 16

Base Plus Layer Prediction Mode Parameter Decoding Procedure.

| Syntax | # bits |
|---|---|
| basePlusDecodePredictionModeParams( ) | |
| { | |
| fUsePredictor | 1 |
| if (fUsePredictor) | |
| { | |
| iCoefQLPCOrder | 1-4 |
| /* | |
| 0: order 1 | |
| 10: order 2 | |
| 110: order 4 | |
| 1110: order 8 | |
| */ | |
| iCoefQLPCShift | 3 |
| if (cSubband > 128) | |
| { | |
| iCoefQLPCSegment | [LOG2(min (8, cSubband/ 128))] |
| } | |
| else | |
| { | |
| iCoefQLPCSegment = 1; | |
| } | |
| if (iCoefQLPCSegment > 1) | |
| { | |
| iCoefQLPCMask | iCoefQLPC Segment |
| } | |
| for (iSeg = 0; iSeg < iCoefQLPCSegment; iSeg++) | |
| { | |
| If (iCoefQLPCMask >> iSeg & 1) | |
| { | |
| For (i = 0; i = iCoefQLPCOrder; i++) | |
| { | |
| iCoefQPredictor[iSeg][i] | [iQCoefLPC Shift + 2] |
| } | |
| } | |
| } | |
| } | |

TABLE 17

Base Plus Layer Shift Mode Parameter Decoding Procedure.

| Syntax | # bits |
|---|---|
| basePlusDecodePDFShiftModeParams( ) | |
| { | |
| iPeriodLimit = cSubband/8 | |

TABLE 17-continued

| Base Plus Layer Shift Mode Parameter Decoding Procedure. | |
|---|---|
| Syntax | # bits |
| iPeriod | LOG2(iPeriod Limit) |
| iPeriod++; | |
| iInsertPos | CEILLOG2 (iPeriod/ 2) |
| } | |

TABLE 18

| Base Plus Layer Overlay Mode Tile Header Decoding Procedure. | |
|---|---|
| Syntax | # bits |
| baseplusDecodeFirstTileHeaderOverlayMode( ) | |
| { | |
| if (fFrameParamUpdate) | |
| { | |
| iHoleWidthIdex | 1 |
| iHoleSegWidethMinIdx | 1 |
| bSingleWeightFactor | 1 |
| iWeightQuantMultiplier | 2 |
| bWeightFactorOnCodedChannel | 1 |
| } | |
| } | |

TABLE 19

| Base Plus Layer Overlay Mode Weight Factor Decoding Procedure. | |
|---|---|
| Syntax | # bits |
| baseplusDecodeWeightFactorOverlayMode( ) | |
| { | |
| for (iCh = 0; iCh < cChInTile; iCh++) | |
| { | |
| if (bSingleWeightFactor) | |
| { | |
| iMaxWeightFactor | [CEILLOG2 (MAX_WEIGHT_FACTOR/ iWeightQuantMultiplier]; |
| } | |
| Else | |
| { | |
| Call huffman decoding of weight factors. | |
| } | |
| } | |
| } | |

B. Bitstream Syntax for Sparse Spectral Peak Decoding Procedure.

One example of a bitstream syntax and decoding procedure for the spectral peak decoder 770 (FIG. 7) is shown in the following syntax tables. This syntax and decoding procedure can be varied for other alternative implementations of the sparse spectral peak coding technique (described in section III.A above), such as by assigning different code lengths and values to represent coding mode, shift (S), zero run (R), and two levels ($L_0$,$L_1$). In the following syntax tables, the presence of spectral peak data is signaled by a one bit flag ("bBasePeakPresentTile"). The data of each spectral peak is signaled to be one of four types:

1. "BasePeakCoefNo" signals no spectral peak data;

2. "BasePeakCoefInd" signals intra-frame coded spectral peak data;

3. "BasePeakCoefInterPred" signals inter-frame coded spectral peak data; and

4. "BasePeakCoefInterPredAndInd" signals combined intra-frame and inter-frame coded spectral peak data.

When inter-frame spectral peak coding mode is used, the spectral peak is coded as a shift ("iShift") from its predicted position and two transform coefficient levels (represented as "iLevel," "iShape," and "iSign" in the syntax table) in the frame. When intra-frame spectral peak coding mode is used, the transform coefficients of the spectral peak are signaled as zero run ("cRun") and two transform coefficient levels ("iLevel," "iShape," and "iSign").

The following variables are used in the sparse spectral peak coding syntax shown in the following tables:

iMaskDiff/iMaskEscape: parameter used to modify mask values to adjust quantization step size from base step size.

iBasePeakCoefPred: indicates mode used to code spectral peaks (no peaks, intra peaks only, inter peaks only, intra & inter peaks).

BasePeakNLQDecTbl: parameter used for nonlinear quantization.

iShift: S parameter in (S,(L0,L1)) trio for peaks which are coded using inter-frame prediction (specifies shift or specifies if peaks from previous frame have died out).

cBasePeaksIndCoeffs: number of intra coded peaks.

bEnableShortZeroRun/bConstrainedZeroRun: parameter to control how the R parameter is coded in intra-mode peaks.

cRun: R parameter in the R,(L0,L1) value trio for intra-mode peaks.

iLevel/iShape/iSign: coding (L0,L1) portion of trio.

iBasePeakShapeCB: codebook used to control shape of (L0,L1)

TABLE 20

| Baseband Spectral Peak Decoding Procedure. | | |
|---|---|---|
| Syntax | # bits | Notes |
| plusDecodeBasePeak( ) | | |
| { | | |
| if (any bits left?) | | |
| bBasePeakPresentTile | 1 | fixed length |
| } | | |

TABLE 21

Baseband Spectral Peak Decoding Procedure.

| Syntax | # bits | Notes |
|---|---|---|
| plusDecodeBasePeak_Channel( ) | | |
| { | | |
| iMaskDiff | 2-7 | variable length |
| if (iMaskDiff==g_bpeakMaxMaskDelta−g_bpeakMinMaskDelta+2 ‖ iMaskDiff==g_bpeakMaxMaskDelta−g_bpeakMinMaskDelta+1) | | |
| iMaskEscape | 3 | fixed length |
| if (ChannelPower==0) | | |
| exit | | |
| iBasePeakCoefPred | 2 | fixed length |
| /* 00: BasePeakCoefNo, 01: BasePeakCoefInd 10: BasePeakCoefInterPred, 11: BasePeakCoefInterPredAndInd */ | | |
| if (iBasePeakCoefPred==BasePeakCoefNo) | | |
| exit | | |
| if (bBasePeakFirstTile) | | |
| BasePeakNLQDecTbl | 2 | fixed length |
| iBasePeakShapeCB | 1-2 | variable length |
| /* 0: CB=0, 10: CB=1, 11: CB=2 */ | | |
| if (iBasePeakCoefPred==BasePeakCoefInterPred ‖ iBasePeakCoefPred==BasePeakCoefInterPredAndInd) | | |
| { | | |
| for (i=0; i<cBasePeakCoefs; i++) | | |
| iShift /* −5,−4,...0,...4,5, and remove */ | 1-9 | variable length |
| } | | |
| Update cBasePeakCoefs | | |
| if (iBasePeakCoefPred==BasePeakCoefInd ‖ iBasePeakCoefPred==BasePeakCoefInterPredAndInd) | | |
| { | | |
| cBasePeaksIndCoefs | 3-8 | variable length |
| bEnableShortZeroRun | 1 | fixed length |
| bConstrainedZeroRun | 1 | fixed length |
| cMaxBitsRun=LOG2(SubFrameSize >> 3) | | |
| iOffsetRun=0 | | |
| if (bEnableShortZeroRun) | | |
| iOffsetRun=3 | | |
| iLastCodedIndex = iBasePeakLastCodedIndex; | | |
| for (i=0; i<cBasePeakIndCoefs; i++) | | |
| { | | |
| cBitsRun=CEILLOG2(SubFrameSize−iLastCodedIndex −1−iOffsetRun) | | |
| if (bConstrainedZeroRun) | | |
| cBitsRun=max(cBitsRun, cMaxBitsRun) | | |
| if (bEnableShortZeroRun) | | |
| cRun | 2-cBitsRun | variable length |
| Else | | |
| cRun | cBitsRun | variable length |
| iLastCodedIndex+=cRun+1 | | |
| cBasePeakCoefs++ | | |
| } | | |
| } | | |
| for (i=0; i<cBasePeakCoefs; i++) | | |
| { | | |
| iLevel | 1-8 | variable length |
| switch (iBasePeakShapeCB) | | |
| { | | |
| case 0: iShape=0 | | S |

TABLE 21-continued

Baseband Spectral Peak Decoding Procedure.

| Syntax | # bits | Notes |
|---|---|---|
| case 1: iShape | 1-3 | variable length |
| case 2: iShape | 2-4 | variable length |
| } | | |
| iSign | 1 | fixed length |
| } | | |
| } | | |

C. Bitstream Syntax for Frequency Extension Decoding Procedure.

One example of a bitstream syntax and decoding procedure for the frequency extension decoder 780 (FIG. 7) is shown in the following syntax tables. This syntax and decoding procedure can be varied for other alternative implementations of the frequency extension coding technique (described in section III.B above).

The following syntax tables illustrate one example bitstream syntax and frequency extension decoding procedure that includes signaling the band structure used with the band partitioning and varying transform window size techniques described in section III.B above. This example bitstream syntax can be varied for other alternative implementations of these techniques. In the following syntax tables, the use of uniform band structure, binary increasing and linearly increasing band size ratio, and arbitrary configurations discussed above are signaled.

TABLE 22

Frequency Extension Header Decoding Procedure.

| Syntax | # bits |
|---|---|
| plusDecodeCodingFexHeader( ) | |
| { | |
| if (iPlusVersion==2) | |
| freqexDecodeCodingGlobalParam( ) | |
| else if (iPlusVersion>2) | |
| freqexDecodeGlobalParamV3(FexGlobalParamUpdateFull) | |
| } | |

TABLE 23

Frequency Extension Decoding Procedure.

| Syntax | # bits |
|---|---|
| freqexDecodeCodingGlobalParam ( ) | |
| { | |
| freqexDecodeCodingGrpD( ) | |
| freqexDecodeCodingGrpA( ) | |
| freqexDecodeCodingGrpB( ) | |
| freqexDecodeCodingGrpC( ) | |
| } | |

TABLE 24

Frequency Extension Decoding Procedure.

| Syntax | # bits |
|---|---|
| freqexDecodeCodingGrpD ( ) | |
| { | |
| bEnableV1Compatible | 1 |
| freqexDecodeReconGrpD( ) | |
| } | |

TABLE 25

Frequency Extension Decoding Procedure.

| Syntax | # bits |
|---|---|
| freqexDecodeReconGrpD ( ) | |
| { | |
| bRecursiveCwGeneration | 1 |
| if (bRecursiveCwGeneration) | |
| iKHzRecursiveCwWidth | 2 |
| iMvRangeType | 2 |
| iMvResType | 2 |
| iMvCodebookSet (0->0, 10->1, 11->2) | 1-2 |
| if (0 == iMvCodebookSet \|\| 1 == iMvCodebookSet) | |
| { | |
| bUseRandomNoise | 1 |
| iNoiseFloorThresh | 2 |
| } | |
| iMaxFreq | 2+ |
| } | |

TABLE 26

Frequency Extension Decoding Procedure.

| Syntax | # bits |
|---|---|
| freqexDecodeCodingGrpA ( ) | |
| { | |
| bScaleBandSplitV2 | 1 |
| bNoArbitraryUniformConfig | 1 |
| } | |

TABLE 27

Frequency Extension Decoding Procedure.

| Syntax | # bits |
|---|---|
| freqexDecodeReconGrpA ( ) | |
| { | |
| bScaleBandSplitV2 | 1 |
| bArbitraryScaleBandConfig | 1 |
| if (!bArbitraryScaleBandConfig) | |
| freqexDecodeNumScMvBands( ) | |
| Else | |
| freqexDecodeArbitraryUniformBandConfig( ) | |
| } | |

TABLE 28

Frequency Extension Decoding Procedure.

| Syntax | # bits |
|---|---|
| freqexDecodeNumScMvBands( ) | |
| { | |
| cScaleBands/cMvBands | 3+ |
| } | |

TABLE 29

Frequency Extension Decoding Procedure.

| Syntax | # bits |
|---|---|
| freqexDecodeCodingGrpB( ) | |
| { | |
| bUseImplicitStartPos | 1 |
| if (bUseImplicitStartPos) | |
| bOverlay | 1 |

TABLE 29-continued

Frequency Extension Decoding Procedure.

| Syntax | # bits |
|---|---|
| Else | |
| iMinFreq = freqexDecodeFreqV2( ) | 3+ |
| if (bUseImplicitStartPos) | |
| cMinRunOfZerosForOverlayIndex | 2 |
| } | |

TABLE 30

Frequency Extension Decoding Procedure.

| Syntax | # bits |
|---|---|
| freqexDecodeCodingGrpC( ) | |
| { | |
| if (bEnableV1Compatible) | |
| iScBinsIndex | 3 |
| freqexDecodeReconGrpC( ) | |
| } | |

TABLE 31

Frequency Extension Decoding Procedure.

| Syntax | # bits |
|---|---|
| freqexDecodeReconGrpC( ) | |
| { | |
| iScFacStepSize | 1 |
| iMvBinsIndex | 3 |
| if (iMvCodebookSet == 0) | |
| { | |
| bEnableNoiseFloor | 1 |
| bEnableExponent | 1 |
| bEnableSign | 1 |
| bEnableReverse | 1 |
| } | |
| Else | |
| { | |
| iMvCodebook | 4-5 |
| } | |
| } | |

TABLE 32

Frequency Extension Decoding Procedure.

| Syntax | # bits |
|---|---|
| plusDecodeReconFexHeader( ) | |
| { | |
| if (iPlusVersion==2) | |
| freqexDecodeReconGlobalParam( ) | |
| else if (iPlusVersion>2) | |
| freqexDecodeGlobalParamV3(FexGlobalParamUpdateFull) | |
| } | |

TABLE 33

Frequency Extension Decoding Procedure.

| Syntax | # bits |
|---|---|
| freqexDecodeReconGlobalParam( ) | |
| { | |
| freqexDecodeReconGrpD( ) | |
| freqexDecodeReconGrpA( ) | |

TABLE 33-continued

Frequency Extension Decoding Procedure.

| Syntax | # bits |
|---|---|
| freqexDecodeReconGrpB( ) | |
| freqexDecodeReconGrpC( ) | |
| } | |

TABLE 34

Frequency Extension Decoding Procedure.

| Syntax | # bits |
|---|---|
| freqexDecodeReconGrpB( ) | |
| { | |
| bBaseBands | 1 |
| if (bBaseBands) | |
| { | |
| bBaseBandSplitV2 | 1 |
| cBaseBands | cBandsBits |
| iMaxBaseFreq = freqexDecodeFreqV2( ) | 3+ |
| iBaseFacStepSize | 1 |
| } | |
| iMinFreq = freqexDecodeFreqV2( ) | 3+ |
| } | |

TABLE 35

Frequency Extension Decoding Procedure.

| Syntax | # bits |
|---|---|
| plusDecodeCodingFex( ) | |
| { | |
| if (bFreqexPresent) | |
| { | |
| bCoded = freqexTileCoded( ) // Check if coded | |
| if (bCoded) | |
| { | |
| if (iPlusVersion == 1) | |
| { | |
| bBasePlus // must be 0 | 1 |
| } | |
| if (!bCodingFexIsLast \|\| iPlusVersion == 1) | |
| { | |
| bCodingFexCoded | 1 |
| } | |
| if (bCodingFexCoded) | |
| { | |
| bReconDomain = FALSE | |
| freqexSetDomainToCoding( ) | |
| freqexDecodeTile( ) | |
| } | |
| } | |
| } | |
| } | |

TABLE 36

Frequency Extension Decoding Procedure.

| Syntax | # bits |
|---|---|
| freqexDecodeTile( ) | |
| { | |
| if (iPlusVersion == 1) | |
| { | |
| freqexDecodeTileConfigV1( ) | |
| } | |
| else if (bReconDomain) | |

TABLE 36-continued

Frequency Extension Decoding Procedure.

| Syntax | # bits |
|---|---|
| { | |
| if (iPlusVersion == 2) | |
| freqexDecodeReconTileConfigV2( ) | |
| else if (iPlusVersion>2) | |
| freqexDecodeReconTileConfigV3( ) | |
| } | |
| else | |
| { | |
| if (iPlusVersion == 2) | |
| freqexDecodeCodingTileConfigV2( ) | |
| else if (iPlusVersion>2) | |
| freqexDecodeCodingTileConfigV3( ) | |
| } | |
| iChCode = 0; | |
| for (iCh=0; iCh < cChInTile; iCh++) | |
| { | |
| if (bNeedChCode[iCh]) | |
| freqexDecodeCh( ) | |
| iChCode++; | |
| } | |
| } | |

TABLE 37

Frequency Extension Decoding Procedure.

| Syntax | # bits |
|---|---|
| freqexDecodeTileConfigV1( ) | |
| { | |
| if (bFirstTileInFrame) | |
| { | |
| iMaxFreq | cEndPosBits |
| if (nChCode > 1) | |
| bUseSingleMv | 1 |
| iScBinsMultiplier | 1+ |
| iMvBinsMultiplier | 1+ |
| bOverlayCoded = FALSE | |
| bNoiseFloorParamsCoded = FALSE | |
| bMinRunOfZerosForOverlayCoded = FALSE | |
| } | |
| bSplitTileIntoSubtiles | 1 |
| for (i=0; i < cNumMvChannels; i++) | |
| { | |
| bUseExponent[i] | 1 |
| bUseNoiseFloor[i] | 1 |
| bUseSign[i] | 1 |
| } | |
| if (bUseNoiseFloor[any channel] && FALSE==bNoiseFloorParamsCoded) | |
| { | |
| bUseRandomMv2 | 1 |
| iNoiseFloorThresh | 2 |
| bNoiseFloorParamsCoded = TRUE; | |
| } | |
| eFxMvRangeType | 2 |
| bUseMvPredLowband | 1 |
| bUseMvPredNoise | 1 |
| for (1=0; i < cNumMvChannels; i++) | |
| { | |
| bUseImplicitStartPos[i] | 1 |
| if (bUseImplicitStartPos[i] && !bMvRangeFull && FALSE==bOverlayCoded) | |
| { | |
| bOverlay | 1 |
| bOverlayCoded = TRUE; | |
| } | |
| } | |
| if (!bUseImplicitStartPos[all channels]) | |
| { | |
| iExplicitStartPos | cStartPosBits |

TABLE 37-continued

Frequency Extension Decoding Procedure.

| Syntax | # bits |
|---|---|
| } | |
| if ((!bUseImplicitStartPos[all channels] \|\| | |
| (bOverlay && bOverlayCoded) \|\| | |
| MvRangeFullNoOverwriteBase==eMvRangeType) && | |
| FALSE==bMinRunOfZerosForOverlayCoded) | |
| { | |
| cMinRunOfZerosForOverlayIndex | 2 |
| bMinRunOfZerosForOverlayCoded = TRUE; | |
| } | |
| freqexDecodeBandConfig( ) | |
| } | |

TABLE 38

Frequency Extension Decoding Procedure.

| Syntax | # bits |
|---|---|
| freqexDecodeBandConfig( ) | |
| { | |
| iConfig=0 | |
| iChannelRem=cMvChannel | |
| while( 1 ) | |
| { | |
| bUseUniformBands[iConfig] | 1 |
| bArbitraryBandConfig[iConfig] | 1 |
| if(bUseUniformBands[iConfig] \|\| | |
| bArbitraryBandConfig[iConfig]) | |
| cScaleBands | [LOG2(cMax Bands)+1] |
| Else | |
| cScaleBands | [LOG2(cMax Bands)] |
| if (bArbitraryBandConfig[iConfig]) | |
| { | |
| iMinRatioBandSizeM | 1-3 |
| freqexDecodeBandSizeM( ) | |
| } | |
| if (iChannelRem==1) | |
| bApplyToAllRemChannel=1 | |
| Else | |
| bApplyToAllRemChannel | 1 |
| for (iCh=0; iCh<cMvChannel; iCh++) | |
| { | |
| if (iCh is not coded) | |
| { | |
| if (!bApplyToAllRemChannel ) | |
| bApplyToThisChannel | 1 |
| if (bApplyToAllRemChannel \|\| | |
| bApplyToThisChannel) | |
| iChanneiRem−− | |
| } | |
| } | |
| if (iChannelRem==0) | |
| break; | |
| iConfig++ | |
| } | |
| } | |

TABLE 39

Frequency Extension Decoding Procedure.

B - BinarySplit
1D - Sc=Mv
L - Linear Split
2D - Sc/Mv

TABLE 39-continued

Frequency Extension Decoding Procedure.

AU - Arbitrary/Uniform Split
[Recon - GrpA]
ScBandSplit/NumBandCoding
00: B-2D 100: B-1D 110: AU-1D
01: L-2D 101: L-1D 111: AU-2D
[Coding - GrpA]
ScBandSplit/NumBandCoding
00: B-1D 100: B-2D 110: AU-1D
01: L-1D 101: L-2D 111: AU-2D

TABLE 40

Frequency Extension Decoding Procedure.

<Update Group>
0: No Update
100: All Update
101: GrpA
1100: GrpB
1101: GrpC
1110: GrpA+GrpB
1111: GrpA+GrpB+GrpC

TABLE 41

Frequency Extension Decoding Procedure.

| Syntax | # bits |
|---|---|
| plusDecodeReconFex( ) | |
| { | |
| if (bReconFexPresent) | |
| { | |
| bReconDomain = TRUE | |
| freqexSwitchCodingDomainToRecon( ) | |
| if (iPlusVersion==2) | |
| freqexDecodeHeaderReconFex( ) | |
| else if (iPlusVersion>2) | |
| freqexDecodeHeaderReconFexV3( ) | |
| for (iTile=0; iTile < cTilesPerFrame; iTile++) | |
| freqexDecodeTile( ); | |
| } | |
| } | |

TABLE 42

Frequency Extension Decoding Procedure.

| Syntax | # bits |
|---|---|
| freqexDecodeHeaderReconFex( ) | |
| { | |
| bAlignReconFexBoundary | 1 |
| if (!bAlignReconFexBoundary) | |
| { | |
| if (!bReconFexLast) | |
| { | |
| bTileReconFex | 2 |
| /* 00: NoRecon | |
| 01: AllRecon | |
| 10: SwitchOnce | |
| 11: ArbitrarySwitch */ | |
| } | |
| Else | |
| { | |
| bTileReconFex | 1 |
| /* 0: AllRecon | |
| 10: SwitchOnce | |
| 11: ArbitrarySwitch */ | |

TABLE 42-continued

Frequency Extension Decoding Procedure.

| Syntax | # bits |
|---|---|
| } | |
| } | |
| if (SwitchOnce) | |
| { | |
| bStartReconFex | 1 |
| iSwitchPos | LOG2(cTiles PerFrameBasic) |
| } | |
| if (ArbitrarySwitch) | |
| { | |
| for (iTile=0; | |
| iTile < cTilesPerFrame; | |
| iTile++) | |
| bTileReconFex[iTile] | 1 |
| } | |
| } | |

TABLE 43

Frequency Extension Decoding Procedure.

| Syntax | # bits |
|---|---|
| freqexDecodeHeaderReconFexV3( ) | |
| { | |
| bTileReconFex | 1 |
| if (bTileReconFex) | |
| { | |
| bAlignReconFexBoundary | 1 |
| if (!bAlignReconFexBoundary) | |
| { | |
| bTileReconFex | 2 |
| /* 00: NoRecon | |
| 01: AllRecon | |
| 10: SwitchOnce | |
| 11: ArbitrarySwitch */ | |
| } | |
| } | |
| if (SwitchOnce) | |
| { | |
| bStartReconFex | 1 |
| iSwitchPos | LOG2(cTiles PerFrameBasic) |
| } | |
| if (ArbitrarySwitch) | |
| { | |
| if (bPlusSuperframe) | |
| cNumTilesCoded | LOG2(cMaxTiles PerFrame) |
| for (iTile=0; | |
| iTile < cTilesPerFrame; | |
| iTile++) | |
| bTileReconFex[iTile] | 1 |
| } | |
| if (bTileReconFex) | |
| { | |
| bTileReconBs | 1 |
| if (bTileReconBs) | |
| { | |
| bTileReconBs | |
| /* 00: AllRecon | |
| 01: Align | |
| 10: SwitchOnce | |
| 11: ArbitrarySwitch */ | |
| if (SwitchOnce) | |
| { | |
| bStartReconBs | 1 |
| iSwitchPos | LOG2(cTiles PerFrameBasic) |
| } | |
| if (ArbitrarySwitch) | |
| { | |

TABLE 43-continued

Frequency Extension Decoding Procedure.

| Syntax | # bits |
|---|---|
| if (bPlusSuperframe&& cNumTilesCoded>0) | |
| cNumTilesCoded | LOG2(cMaxTiles PerFrame) |
| for (iTile=0; | |
| iTile < cTilesPerFrame; | |
| iTile++) | |
| bTileReconFex[iTile] | 1 |
| } | |
| } | |
| } | |
| } | |

TABLE 44

Frequency Extension Decoding Procedure.

| Syntax | # bits |
|---|---|
| freqexDecodeCh( ) | |
| { | |
| if (iPlusVersion==1 \|\| bV1Compatible) | |
| { | |
| for (iBand=0; iBand<cMvBands; iBand++) | |
| { | |
| iScFac[iBand] | |
| if (bNeedMvCoding && (iChCode==0 \|\| !bSingleMv)) | |
| { | |
| iCb[iBand] | 1-2 |
| /* 00: Pred(=0) | |
| 01: Pred+NoiseFloor(=2) | |
| 1: Noise(=1) */ | |
| if ((iCb[iBand]==0 or 2) && !bMvResTypeCoded) | |
| { | |
| bMvResType | 1 |
| bMvResTypeCoded=1; | |
| } | |
| if (bUseExp[iChCode] && iCb[iBand] != 2) | |
| { | |
| fExp[iBand] | 1-2 |
| /* 0: =0.5 | |
| 10: =1.0 | |
| 11: =2.0 */ | |
| } | |
| if (bUseSign[iChCode]) | |
| iSign[iBand] | 1 |
| iMv[iBand] | log2(cMvBins) |
| if (iCb[iBand]==2 && !bUseRandomMv2[iChCode]) | |
| iMv2[iBand] | log2(cMvBins) |
| if (iCb[iBand]==2) | |
| iScFacNoise[iBand] | |
| } | |
| } | |
| } | |
| else | |
| { | |
| if (bReconDomain) | |
| { | |
| if (bFirstTile) | |
| { | |
| cTilesScale=cTilesPerFrame | |
| Call freqexDecodeBaseScaleV2( ) | |
| Call freqexDecodeScaleFacV2( ) | |
| Call freqexDecodeMvMergedV2( ) | |
| } | |
| } | |
| else | |

TABLE 44-continued

Frequency Extension Decoding Procedure.

```
Syntax                                                    # bits
        {
          cTilesScale=1;
          Call freqexDecodeScaleFacV2( )
        }
        for (iBand=0; iBand < cMvBands;
iBand++)
        {
          if (bMvUpdate &&
            bNeedMvCoding &&
            (iChCode==0 || !bSingleMv))
          {
            if (iMvCodebookSet==0)
            {
              iCb[iBand]                                  1-2
              /* 00: Pred(=0)
                 01: Pred+NoiseFloor(=2
or 4)
                  1: Noise(=1) */
            }
            else if
(!rgMvCodeebok[iMvCodebook].bNoiseMv)
            {
              iCb[iBand]=0
            }
            else if
(!rgMvCodeebok[iMvCodebook].bPredMv)
            {
              iCb[iBand]=1
            }
            else
            {
              iCb[iBand]                                  1
            }
            if (iCb[iBand]==0 &&
rgMvCodebook[iMvCodebook].bPredNoiseFloor)
            {
              iCb[iBand]                                  1
              /* 0: =0
                 1: =2 or 4 */
            }
            if (iMvCodebookSet==0)
            {
              if (bUseExp && 2 !=
iCb[iBand])
              {
                fExp[iBand]                               1-2
                /* 0: =0.5
                   10: =1.0
                   11: =2.0 */
              }
              if (bUseSign[0])
              {
                iSign[iBand]                              1
              }
              iMv[iBand]                          log2(cMvBins)
              if (bUseReverse)
                bRev[iBand]                               1
            }
            else
            {
              if ((iCb[iBand]==0 &&
rgMvCodebook[iMvCodebook].bPredExp) ||
                (iCb[iBand]==1 &&
rgMvCodebook[iMvCodebook].bNoiseExp) ||
                (iCb[iBand]==4 &&
rgMvCodebook[iMvCodebook].bPredExp) ||
              {
                fExp[iBand]                               1-2
                /* 0: =0.5
                   1: =1.0
                   2: =2.0 */
              }
              if (((iCb[iBand]==0,2,or
```

TABLE 44-continued

Frequency Extension Decoding Procedure.

```
Syntax                                                    # bits
4) &&
rgMvCodebook[iMvCodebook].bPredSign) ||
                (iCb[iBand]==1 &&
rgMvCodebook[iMvCodebook].bNoiseSign))
                iSign[iBand]                              1
              if (((iCb[iBand]==0,2,or
4) &&
rgMvCodebook[iMvCodebook].bPredMv) ||
                (iCb[iBand]==1 &&
rgMvCodebook[iMvCodebook].bNoiseMv))
                iMv[iBand]                          log2(cMvBins)
              if (((iCb[iBand]==0,2,or
4) &&
rgMvCodebook[iMvCodebook].bPredRev) ||
                (iCb[iBand]==1 &&
rgMvCodebook[iMvCodebook].bNoiseRev))
                bRev[iBand]                               1
              if (iCb==2 &&
!bUseRandomNoise)
                iMv2[iBand]                         log2(cMvBins)
              if (iCb== 2)
                iScFacV2[iBand]
              if (iPlusVersion>2 &&
bReconDomain &&
                iCb==4)
                  iBaseScFacV3[iBand]
            }
          } // bNeedMvCoding
        } // iBand
      } // iVersion
      if (iChCode==0)
        cTilesMvMerged--
      iChCode++
    } // freqexDeocodeCh
```

TABLE 45

Frequency Extension Decoding Procedure.

```
Syntax                                                    # bits
freqexDecodeTileMvMergedV2( )
{
  if (cTilesMvMerged==0 && iChCode == 0)
  {
    bTilesMvMergedAll                                     1
    if (!bTilesMvMergedAll)
      cTilesMvMerged                                      3+
    bMvUpdate=1
  }
}
```

TABLE 46

Frequency Extension Decoding Procedure.

```
Syntax                                                    # bits
    freqexDecodeCodingTileConfigV2( )
    {
      if (bFirstTile)
      {
        bParamUpdate                                      1
        if (bParamUpdate)
        {
          Call <UpdateGrp> // See which group to
be updated
          Call plusDecodeHeaderCodingFex( )
        }
        if (bEnableV1Compatible)
```

TABLE 46-continued

Frequency Extension Decoding Procedure.

| Syntax | # bits |
|---|---|
| { | |
| bV1Compatible | 1 |
| if (bV1Compatible) | |
| Call freqexDecodeTileConfigV1( ) | |
| } | |
| If (nChCode > 1 && !bEnableV1Compatible) | |
| bUseSingleMv | 1 |
| } | |
| if (!bUseImplicitStartPos \|\| bOverlay) | |
| bOverlayOnly | 1 |
| if (iMvCodebookSet==0) | |
| { | |
| if (bEnableNoiseFloor) | |
| bUseNoiseFloor | 1 |
| if (bEnableExponent) | |
| bUseExp | 1 |
| if (bEnableSign) | |
| bUseSign | 1 |
| if (bEnableRev) | |
| bUseRev | 1 |
| } | |
| freqexDecodeNumScMvBands( ) | |
| } | |

TABLE 47

Frequency Extension Decoding Procedure.

| Syntax | # bits |
|---|---|
| freqexDecodeReconTileConfigV2( ) | |
| { | |
| bParamUpdate | 1 |
| if (bParamUpdate) | |
| { | |
| Call <UpdateGrp> | |
| Call freqexDecodeReconGlobalParam( ) | |
| } | |
| if (!fUpdateGrpB) | |
| { | |
| iMinFreq | 1+ |
| } | |
| if (nChCode > 1) | |
| bUseSingleMv | 1 |
| cTilesMvMerged = 0 | |
| } | |

TABLE 48

Frequency Extension Decoding Procedure.

| Syntax | # bits |
|---|---|
| freqexDecodeCodingTileConfigV3( ) | |
| { | |
| if (bFirstTile) | |
| { | |
| bParamUpdate | 1 |
| bUpdateFull=0 | |
| if (bParamUpdate) | |
| { | |
| iGlobalParamUpdate | 1-2 |
| /* 0: GlobalParamUpdateTileList | |
| 10: GlobalParamUpdateList | |
| 11: GlobalParamUpdateFull */ | |
| freqexDecodeGlobalParamV3(iGlobalParamUpdate) | |
| if (iGlobalParamUpdate==GlobalParamUpdateFull) | |
| bUpdateFull=1 | |
| } | |
| if (!bUpdateFull) | |

TABLE 48-continued

Frequency Extension Decoding Procedure.

| Syntax | # bits |
|---|---|
| freqexDecodeGlobalParamV3(GlobalParamUpdateFrame) | |
| if (bEnableV1Compatible) | |
| { | |
| bV1Compatible | 1 |
| if (bV1Compatible) | |
| freqexDecodeTileConfigV1( ) | |
| } | |
| } | |
| if (bV1Compatible) | |
| freqexDecodeTileConfigV1( ) | |
| if (!bUpdateFull) | |
| freqexDecodeGlobalParamV3(GlobalParamUpdateTile) | |
| if (iMvCodebookSet==0) | |
| { | |
| if (bEnableNoiseFloor) | |
| bUseNoiseFloor | 1 |
| if (bEnableExponent) | |
| bUseExp | 1 |
| if (bEnableSign) | |
| bUseSign | 1 |
| if (bEnableRev) | |
| bUseRev | 1 |
| } | |
| } | |

TABLE 49

Frequency Extension Decoding Procedure.

| Syntax | # bits |
|---|---|
| freqexDecodeReconTileConfigV3( ) | |
| { | |
| bParamUpdate | 1 |
| bUpdateFull=0 | |
| if (bParamUpdate) | |
| { | |
| iGlobalParamUpdate | 1 |
| /* 0: GlobalParamUpdateList | |
| 1: GlobalParamUpdateFull */ | |
| freqexDecodeGlobalParamV3(iGlobalParamUpdate) | |
| if (iGlobalParamUpdate==GlobalParamUpdateFull) | |
| bUpdateFull=1 | |
| } | |
| if (!bUpdateFull) | |
| freqexDecodeGlobalParamV3(GlobalParamUpdateFrame) | |
| } | |

TABLE 50

Frequency Extension Decoding Procedure.

| Syntax | # bits |
|---|---|
| freqexDecodeGlobalParamV3(iUpdateType) | |
| { | |
| uUpdateFlag=uUpdateListFrame0=uUpdateListTile0=0 | |
| bDiffCoding=0 | |
| switch (iUpdateType) | |
| { | |
| case FexGlobalParamUpdateFull: | |
| uUpdateFlag=0x001fffff | |
| case FexGlobalParamUpdateList: | |
| uUpdateFlag\|=0x00200000 | |
| uUpdateListFrame0=0x001fffff | |
| case FexGlobalParamUpdateTileList: | |
| uUpdateFlag\|=0x00400000 | |
| uUpdateListTile0=uUpdateListTile | |
| break | |

TABLE 50-continued

Frequency Extension Decoding Procedure.

| Syntax | # bits |
|---|---|
| case FexGlobalParamFrame: | |
| uUpdateFlag=uUpdateListFrame & ~(uUpdateListTile) | |
| bDiffCoding=1 | |
| break | |
| case FexGlobalParamTile: | |
| uUpdateFlag=uUpdateListTile | |
| bDiffCoding=1 | |
| break | |
| } | |
| if (uUpdateFlag & 0x00000001) | |
| iMvBinsIndex | 3 |
| if (uUpdateFlag & 0x00000002) | |
| iCodebookSet /* 0: 0, 10: 1, 11: 2 */ | 1-2 |
| if (uUpdateFlag & 0x00000004) | |
| { | |
| if (iCodebookSet==0) | 3 |
| { | |
| bEnableNoiseFloor | 1 |
| bEnableExponent | 1 |
| bEnableSign | 1 |
| bEnableReverse | 1 |
| } | |
| else | |
| { | |
| iMvCodebook | 2-5 |
| } | |
| } | |
| if (uUpdateFlag & 0x00000008) | |
| bUseRandomNoise | 1 |
| if (uUpdateFlag & 0x00000010) | |
| iNoiseFloorThresh | 2 |
| if (uUpdateFlag & 0x00000020) | |
| iMvRangeType | 2 |
| if (uUpdateFlag & 0x00000040) | |
| iMvResType | 2 |
| if (uUpdateFlag & 0x00000080) | |
| { | |
| bRecursiveCwGeneration | 1 |
| if (bRecursiveCwGeneration) | |
| ikHzRecursiveCwWidth | 2 |
| } | |
| if (uUpdateFlag & 0x00000100) | |
| bSingleMv | 1 |
| if (uUpdateFlag & 0x00000200) | |
| iScFacStepSize | 1 |
| if (uUpdateFlag & 0x00000400) | |
| bScaleBandSplitV2 | 1 |
| if (uUpdateFlag & 0x00000800) | |
| { | |
| bArbitraryUniformBandConfig | 1 |
| if (!bArbitraryUniformBandConfig) | |
| { | |
| bRegularCoding=1 | |
| if (bDiffCoding) | |
| { | |
| bChange | 1 |
| if (!bChange) | |
| bRegularCoding=0 | |
| } | |
| if (bRegularCoding) | |
| freqexDecodeNumScMvBands( ) | |
| } | |
| else | |
| { | |
| freqexDecodeArbitraryUniformBandConfig( ) | |
| } | |
| } | |
| if (uUpdateFlag & 0x00001000) | |
| { | |
| bRegularCoding=1 | |
| if (bDiffCoding) | |
| { | |
| bRegularUpdate | 1 |
| if (!bRegularUpdate) | |

TABLE 50-continued

Frequency Extension Decoding Procedure.

| Syntax | # bits |
|---|---|
| { | |
| bChange | 1 |
| if (bChange) | |
| { | |
| iDiff | 2 |
| iSign | 1 |
| } | |
| bRegularCoding=0 | |
| } | |
| } | |
| if (bRegularCoding) | |
| freqexDecodeFreqV2( ) | 3+ |
| } | |
| if (uUpdateFlag & 0x00002000) | |
| { | |
| bRegularCoding=1 | |
| if (bDiffCoding) | |
| { | |
| bRegularUpdate | 1 |
| if (!bRegularUpdate) | |
| { | |
| bChange | 1 |
| if (bChange) | |
| { | |
| iDiff | 2 |
| iSign | 1 |
| } | |
| bRegularCoding=0 | |
| } | |
| } | |
| if (bRegularCoding) | |
| freqexDecodeFreqV2( ) | 3+ |
| } | |
| if (uUpdateFlag & 0x00004000) | |
| bUseCb4 | 1 |
| if (uUpdateFlag & 0x00008000) | |
| { | |
| if (bReconDomain) | |
| bBaseBandSplitV2 | 1 |
| else | |
| bUseImplicitStartPos | 1 |
| } | |
| if (uUpdateFlag & 0x00010000) | |
| { | |
| if (bReconDomain) | |
| { | |
| bRegularCoding=1 | |
| if (bDiffCoding) | |
| { | |
| if (bTileReconBs) | |
| { | |
| bRegularCoding=0 | |
| } | |
| else | |
| { | |
| bChange | 1 |
| if (!bChange) | |
| bRegularCoding=0 | |
| } | |
| } | |
| if (bRegularCoding) | |
| { | |
| bAnyBaseBand=1 | |
| if (!bDiffCoding) | |
| bAnyBaseBand | 1 |
| if (bAnyBaseBand) | |
| cBaseBands | cBandsBits |
| } | |
| } | |
| else | |
| { | |
| cMinRunOfZerosForOverlayIndex | 3 |
| } | |
| } | |
| if (uUpdateFlag & 0x00020000) | |

TABLE 50-continued

Frequency Extension Decoding Procedure.

```
Syntax                                                    # bits
  {
    if (bReconDomain)
    {
      bRegularCoding=1
      if (bDiffCoding)
      {
        bRegularUpdate                                      1
        if (!bRegularUpdate)
        {
          bChange                                           1
          if (bChange)
          {
            iDiff                                           2
            iSign                                           1
          }
          bRegularCoding=0
        }
      }
      if (bRegularCoding)
        freqexDecodeFreqV2( )                               3+
    }
    else
    {
      cMaxRunOfZerosPerBandForOverlayIndex                  3
    }
  }
  if (uUpdateFlag & 0x00040000)
  {
    if (bReconDomain)
      iBaseFacStepSize                                      1
    else
      bOverlay                                              1
  }
  if (uUpdateFlag & 0x00080000 && !bReconDomain)
    iEndHoleFillConditionIndex /* 0: 0, 10: 1,              1-2
11: 2 */
  if (uUpdateFlag & 0x00100000 && !bReconDomain)
  {
    bEnableV1Compatible                                     1
    if (bEnableV1Compatible)
      iScBinsIndex                                          3
  }
  if (uUpdateFlag & 0x00200000)
  {
    while (uUpdateListFrame0)
    {
      uUpdate                                               1
      uUpdateListFrame0>>=1
    }
  }
  if (uUpdateFlag & 0x00400000)
  {
    while (uUpdateListTile0)
    {
      if (uUpdateListTile0 & 0x1)
      {
        uUpdate                                             1
        uUpdateListTile0>>=1
      }
    }
  }
}
```

TABLE 51

Codebook Set For Frequency Extension Decoding Procedure.

```
iMvCodebookSet=1:
00: (0/1/2,Mv,Exp,Sign,Rev, NoiseFloor)
01: (0/1/2,Mv,Exp,Sign,          ,NoiseFloor)
10: (0/1/2,Mv,Exp,                ,NoiseFloor)
1100: (0/1,Mv,Exp,Sign,Rev)
```

TABLE 51-continued

Codebook Set For Frequency Extension Decoding Procedure.

```
1101: (0/1,Mv,Exp,          Rev)
1110: (0,Mv,Exp,Sign) or (1,Mv,Sign)
1111: (0,Mv,Exp) or (1,Mv)
iMvCodebookSet=2
00: (0,Mv,Exp,Sign) or (1,Mv,Sign)
01: (0,Mv,Exp,Sign)
10: (0,Mv,Exp,Sign,Rev)
11000: (0,Mv,Exp,Sign,Rev) or (1,Mv,Sign)
11001: (0/1,Mv,Exp,Sign,Rev)
11010: (0/1,Mv,Exp,          ,Rev)
11011: (0,Mv,Exp) or (1,Mv)
11100: (0,Mv,Exp,Rev)
11101: (0,Mv,Exp)
11110: (0,Mv)
11111: (1,Mv)
```

TABLE 52

Frequency Extension Decoding Procedure.

```
Syntax                                                    # bits
  freqexDecodeScaleFrameV2( )
  {
    if (iChCode==0)
    {
      bBasePowerRef                                         1
      if (!bBasePowerRef)
        iFirstScFac[0]                                      ~5
      iPredType[0]=Intra
      for (iTile=0; iTile<cTiles; iTile++)
      {
        iPredType[iTile]                                    1-2
        /* 0: InterPred
           10: IntraPred
           11: IntplPred */
        if (iPredType[iTile]==IntraPred)
            iFirstScFac[iTile]                              ~5
      }
    }
    else
    {
      bChPred                                               1
      if (bChPred)
      {
        for (iTile=0; iTile<cTiles;
iTile++)
          iPredType[iTile] = ChPred;
        iChPredOffset [1]
        if (1 == iChPredOffset)
        {
          x                                                 2
          iChPredOffsetSign                                 1
        }
      }
      else
      {
        Same as iChCode=0 case
      }
    }
    Decode run-level for IntraPred residual +
signs
    Decode run-level for InterPred residual +
signs
    Decode run-level for IntplPred residual +
signs
    Decode run-level for ChPred residual +
signs
    Decode remaining sign
  }
```

TABLE 53

Frequency Extension Decoding Procedure.

| Syntax | # bits |
|---|---|
| freqexDecoedBaseScaleFrameV2( ) | |
| { | |
| for (iTile=0; iTile<cTilesPerFrame; iTile++) | |
| { | |
| iBasePredType[iTile] | 1 |
| /* 0: =IntraPred | |
| 1: =ReconPred */ | |
| if (iBasePredType[iTile]==IntraPred) | |
| iFirstBaseFac[iTile] | ~5 |
| } | |
| Decode run-level for IntraPred residual + signs | |
| Decode run-level for ReconPred residual + signs | |
| Decode remaining sign | |
| } | |

D. Bitstream Syntax for Channel Extension Decoding Procedure.

One example of a bitstream syntax and decoding procedure for the channel extension decoder 790 (FIG. 7) is shown in the following syntax tables. This syntax and decoding procedure can be varied for other alternative implementations of the channel extension coding technique (described in section III.C above).

Based on the above derivation of the low complexity version channel correlation matrix parameterization (in section III.C.5), the coding syntax defines various channel extension coding syntax elements. This includes syntax elements for signaling the band configuration for channel extension decoding, as follows:

- iNumBandIndex: index into table which tells number of bands being used.
- iBandMultIndex: index into table which specifies which band size multiplier array is being used for given number of bands. In other words, the index specifies how band sizes relate to each other.
- bBandConfigPerTile: Boolean to specify whether number of bands or band size multiplier is being specified per tile.
- iStartBand: starting band at which channel extension should start (before start of channel extension, traditional channel coding is done).
- bStartBandPerTile: Boolean to specify whether starting band is being specified per tile.

The bitstream syntax also includes syntax elements for the channel extension parameters to control transform conversion and reverb control, as follows:

- iAdjustScaleThreshIndex: the power in the effect signal is capped to a value determined by this index and the power in the first portion of the reconstruction
- eAutoAdjustScale: which of the two scaling methods is being used (is the encoder doing the power adjustment or not?), each results in a different computation of s which is the scale factor in front of the matrix R.
- iMaxMatrixScaleIndex: the scale factor s is capped to a value determined by this index
- eFilterTapOutput: determines generation of the effect signal (which tap of the IIR filter cascade is taken as the effect signal).
- eCxChCoding/iCodeMono: determines whether B=[β β] or B=[β−β]
- bCodeLMRM: whether the LMRM parameterization or the normalized power correlation matrix parameterization is being used.

Further, the bitstream syntax has syntax elements to signal quantization step size, as follows:

- iQuantStepIndex: index into table which specifies quantization step sizes of scale factor parameters.
- iQuantStepIndexPhase: index into table which specifies quantization step sizes of phase of cross-correlation.
- iQuantStepIndexLR: index into table which specifies quantization step sizes of magnitude of cross-correlation.

The bitstream syntax also includes a channel coding parameter, eCxChCoding, which is an enumerated value that specifies whether the base channel being coded is the sum or difference. This parameter has four possible values: sum, diff, value sent per tile, or value sent per band.

These syntax elements are coded in a channel extension header, which is decoded as shown in the following syntax tables.

TABLE 54

Channel Extension Header

| Syntax | # bits |
|---|---|
| plusDecodeChexHeader( ) | |
| { | |
| iNumBandIndex | iNumBandIndexBits |
| if (g_iCxBands[pcx-> | |
| m_iNumBandIndex] > | |
| g_iMinCxBandsForTwoConfigs) | |
| iBandMultIndex | 1 |
| else | |
| iBandMultIndex = 0 | |
| bBandConfigPerTile | 1 |
| iStartBand | log2(g_iCxBands[pcx-> m_iNumBandIndex]) |
| bStartBandPerTile | 1 |
| bCodeLMRM | 1 |
| iAdjustScaleThreshIndex | iAdjustScaleThreshBits |
| eAutoAdjustScale | 1-2 |
| iMaxMatrixScaleIndex | 2 |
| eFilterTapOutput | 2-3 |
| iQuantStepIndex | 2 |
| iQuantStepIndexPhase | 2 |
| if (!bCodeLMRM) | |
| iQuantStepIndexLR | 2 |
| eCxChCoding | 2 |
| } | |

A flag bit in the next syntax table of the channel extension decoding procedure specifies whether the current frame has channel extension parameters coded or not.

TABLE 55

Channel Extension Decoding Procedure.

| Syntax | # bits |
|---|---|
| plusDecodeCx( ) | |
| { | |
| if (!bCxIsLast) | |
| bCxCoded | 1 |
| else | |
| bCxCoded = (any bits left?) | |
| if (bCxCoded) | |
| chexDecodeTile( ) | |
| } | |

The example bitstream syntax partitions tiles into segments. Each segment consists of a group of tile. Each segment's parameters are coded in the tile which is in the center of that segment (or the closest one if the segment has an even number of tiles). Such tile is called an "anchor tile." The parameters used for a given tile are found by linearly interpolating the parameters from the left and right anchor points.

The example bitstream syntax includes the following syntax elements that specify parameters for channel extension of each tile, and decoded in the procedure shown in the syntax table below.

- bParamsCoded: specifies whether chex parameters are coded for this tile or not (i.e., is this an anchor tile?).
- bEvenLengthSegment: specifies whether the current tile is in an even length segment or an odd length segment, which is to aid in determining exact segment boundaries.
- bStartBandSame: specifies whether the start band is the same as that for the previous segment.
- bBandConfigSame: specifies whether the band configuration (i.e., the number of bands, and the band size multiplier) is the same as that for the previous segment.
- eAutoAdjustScaleTile: specifies whether automatic scale adjustment is done or not.
- eFilterTapOutputTile: has four possible values identifying which of the filter output taps (0-3) is to be used for generation of the effect signal.
- eCxChCodingTile: specifies the coded channel for the tile is sum, difference or value sent per band.
- predType*: specifies the prediction being used for channel extension parameters. It has the possible values of no prediction, prediction done across frequency, prediction done across time (except that the no prediction case is not allowed for predTypeLRScale, since it is not used). For prediction across frequency, the first band is not predicted.
- iCodeMono: specifies whether the coded band is sum or difference, and is only sent when the eCxChCodingTile parameter specifies value sent per band.

In the LMRM parameterization, the following parameters are sent with each tile.

- lmSc: the parameter corresponding to LM
- rmSc: the parameter corresponding to RM
- lrRI: the parameter corresponding to RI On the other hand, in the normalized correlation matrix parameterization, the following parameters are sent with each tile.

- lScNorm: the parameter corresponding to 1.
- lrScNorm: the parameter corresponding to the value of $\sigma$.
- lrScAng: the parameter corresponding to the value of $\theta$.

These channel extension parameters are coded per tile, which is decoded at the decoder as shown in the following syntax table.

TABLE 56

Channel Extension Tile Syntax

| Syntax | # bits |
|---|---|
| chexDecodeTile( ) | |
| { | |
| bParamsCoded | 1 |
| if (!bParamsCoded) | |
| { | |
| copyParamsFromLastCodedTile( ) | |
| } | |
| Else | |
| { | |
| bEvenLengthSegment | 1 |
| bStartBandSame = bBandConfigSame = TRUE | |
| if (bStartBandPerTile && bBandConfigPerTile) | |
| bStartBandSame/bBandConfigSame | 1-3 |
| else if (bStartBandPerTile) | |
| bStartBandSame | 1 |
| else if (bBandConfigPerTile) | |
| bBandConfigSame | 1 |

TABLE 56-continued

Channel Extension Tile Syntax

| Syntax | # bits |
|---|---|
| if (!bBandConfigSame) | |
| { | |
| iNumBandIndex | 3 |
| if (g_iCxBands[iNumBandIndex] > g_iMinCxBandsForTwoConfigs) | |
| iBandMultIndex | 1 |
| Else | |
| iBandMultIndex = 0 | |
| } | |
| if (!bStartBandSame) | |
| iStartBand | log2( g_iCxBands[ iNumBandIndex]) |
| if (ChexAutoAdjustPerTile == eAutoAdjustScale) | |
| eAutoAdjustScaleTile | 1 |
| else | |
| eAutoAdjustScaleTile = eAutoAdjustScale | |
| if (ChexFilterOutputPerTile == eFilterTapOutput) | |
| eFilterTapOutputTile | 2 |
| else | |
| eFilterTapOutputTile = eFilterTapOutput | |
| if (ChexChCodingPerTile == eCxChCoding) | |
| eCxChCodingTile | 1-2 |
| else | |
| eCxChCodingTile = eCxChCoding | |
| if (bCodeLMRM) | |
| { | |
| predTypeLMScale | 1-2 |
| predTypeRMScale | 1-2 |
| predTypeLRAng | 1-2 |
| } | |
| else | |
| { | |
| predTypeLScale | 1-2 |
| predTypeLRScale | 1 |
| predTypeLRAng | 1-2 |
| } | |
| for (iBand=0; iBand < g_iChxBands[iNumBandIndex]; iBand++) | |
| { | |
| if (eCxChCodingTile == ChexChCodingPerBand) | |
| iCodeMono[iBand] | 1 |
| else | |
| iCodeMono[iBand]= (ChexMono == eCxChCoding) ? 1 : 0 | |
| if (bCodeLMRM) | |
| { | |
| lmSc[iBand] | |
| rmSc[iBand] | |
| lrScAng[iBand] | |
| } | |
| else | |
| { | |
| lScNorm[iBand] | |
| lrScNorm[iBand] | |
| lrScAng[iBand] | |
| } | |
| } // iBand | |
| } // bParamCoded | |
| } | |

In view of the many possible embodiments to which the principles of our invention may be applied, we claim as our invention all such embodiments as may come within the scope and spirit of the following claims and equivalents thereto.

We claim:

1. A method of decoding a compressed audio bitstream containing syntax elements conforming to a bitstream syntax, the bitstream syntax defining a base coding layer and a base plus coding layer for coding a base band spectrum region of audio content, the method comprising:

reading the base plus coding layer of the compressed audio bitstream;

parsing a first syntax element from the base plus coding layer specifying a coding mode of the base plus coding layer from among at least an exclusive mode and an overlay mode;

in case of the exclusive mode, processing coded audio content of the base plus coding layer alone to reconstruct the base band spectrum region portion of an output audio signal;

in case of the overlay mode, processing coded audio content of the base coding layer and the base plus coding layer to reconstruct the base band spectrum region portion of an output audio signal, wherein the coded audio content of the base plus coding layer is combined to fill spectral holes in the coded audio content of the base coding layer; and playing the output audio signal.

2. The method of claim 1 wherein the coding mode of the base plus coding layer is from among choices further comprising an extend mode, and the method further comprises:

in case of the extend mode, processing coded audio content of the base coding layer and the base plus coding layer to reconstruct portions of an output audio signal comprising the base band spectrum region and an extended spectrum region above an upper bound of the base band spectrum region, wherein the coded audio content of the base plus coding layer is used to fill the extended spectrum region.

3. The method of claim 2 wherein the parameters for the exclusive mode comprise a scale factor, an entropy coding scheme, and tool box set of coding features used in coding the audio content of the base plus coding layer.

4. The method of claim 2 wherein the tool box set of coding features specify a combination of a predictor, interleave period, and shift parameters used in coding the audio content of the base plus coding layer.

5. The method of claim 1 further comprising, in the case of the extend mode:

reading a plurality of syntax elements specifying parameters for processing the coded audio content of the base plus coding layer in the extend mode; and processing the coded audio content of the base plus coding layer using the parameters.

6. The method of claim 1 further comprising, in the case of the exclusive mode:

reading a plurality of syntax elements specifying parameters for processing the coded audio content of the base plus coding layer in the exclusive mode; and processing the coded audio content of the base plus coding layer using the parameters.

7. The method of claim 1 further comprising, in the case of the overlay mode:

reading a plurality of syntax elements specifying parameters for processing the coded audio content of the base plus coding layer in the overlay mode; and processing the coded audio content of the base plus coding layer using the parameters.

8. The method of claim 7 wherein the parameters for the overlay mode comprise a weight factor and power of a coded channel of the audio content in the base plus coding layer.

9. The method of claim 7 wherein the parameters for the overlay mode comprise a hole width, a hole of a coded channel of the audio content in the base plus coding layer.

10. The method of claim 1, wherein the bitstream syntax further defines a base peak coding layer for coding a portion of audio content using a sparse spectral peak coding, the method further comprising:

parsing a plurality of syntax elements from the base peak coding layer specifying parameters used in the sparse spectral peak coding; and processing coded audio content of the base peak coding layer to reconstruct the portion of audio content in an output audio signal.

11. The method of claim 10 wherein the parameters comprise:

a coded peak type from among at least a choice of no peak data, intra-frame coded peak, and inter-frame coded peak;

in the case of an intra-frame coded peak, a zero run length and subsequent two coefficient levels; and in the case of an inter-frame coded peak, a shift from a predicted position of the peak and two coefficient levels.

12. The method of claim 1, wherein, the bitstream syntax further defines a frequency extension coding layer for coding a portion of audio content using a frequency extension coding, the method further comprising:

reading the frequency extension coding layer of the compressed audio bitstream;

parsing a plurality of syntax elements from the frequency extension coding layer specifying parameters used in the frequency extension coding, wherein the parameters comprise parameters specifying frequency extension coding using a different transform window size than a base coding layer; and processing coded audio content of the frequency extension coding layer to reconstruct the portion of audio content in an output audio signal.

13. The method of claim 12 wherein the parameters comprise parameters identifying tiles coded using frequency extension coding with a different transform window size than a based coding layer.

14. The method of claim 12 wherein the parameters comprise dynamic band configuration parameters specifying spectral band locations where frequency extension coding is applied.

15. The method of claim 12 wherein said dynamic band configuration parameters specify start and end positions of spectral bands coded using vector quantization techniques.

16. The method of claim 12 wherein the parameters comprise displacement vector search range, step size for displacement vector quantization, scale factor and codeword modifications.

17. The method of claim 1, wherein the bitstream syntax further defines a channel extension coding layer for coding a portion of audio content using a channel extension coding, the method further comprising:

reading the channel extension coding layer of the compressed audio bitstream;

parsing a plurality of syntax elements from the channel extension coding layer specifying parameters used in the channel extension coding; and processing coded audio content of the channel extension coding layer to reconstruct the portion of audio content in an output audio signal.

18. The method of claim 17 wherein the parameters comprise a band configuration parameterization, which comprises a number of bands, a size relation among bands, and a starting band of the channel extension coding.

19. The method of claim 17 wherein the parameters comprise reverb control parameters, which comprise a scaling of an effect signal, and filter tap at which the effect signal is generated.

20. The method of claim 17 wherein the parameters comprise channel correlation parameters, which comprise choice of an LMRM parameterization or normalized correlation matrix parameterization from which a channel correlation matrix is derived.

21. The method of claim 17 wherein the parameters to control an automatic scale adjustment.

22. The method of claim 17 wherein the parameters comprise a prediction type from among no prediction, prediction across time and prediction across frequency.

23. The method of claim 17 wherein the parameters comprise a coded channel type from among sum, and difference.

* * * * *